US007505715B2

(12) United States Patent
Kamoshida et al.

(10) Patent No.: US 7,505,715 B2
(45) Date of Patent: Mar. 17, 2009

(54) CHARGING ROLLER AND IMAGE FORMING APPARATUS WITH THE SAME

(75) Inventors: Shinichi Kamoshida, Nagano-ken (JP); Atsunori Kitazawa, Nagano-ken (JP); Tadahiro Mizutani, Nagano-ken (JP); Ken Ikuma, Nagano-ken (JP); Kazuyoshi Ohashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 11/461,730

(22) Filed: Aug. 1, 2006

(65) Prior Publication Data

US 2007/0025766 A1 Feb. 1, 2007

(30) Foreign Application Priority Data

| | | |
|---|---|---|
| Aug. 1, 2005 | (JP) | 2005-222907 |
| Aug. 1, 2005 | (JP) | 2005-222908 |
| Aug. 1, 2005 | (JP) | 2005-222909 |
| Aug. 1, 2005 | (JP) | 2005-222910 |
| Aug. 1, 2005 | (JP) | 2005-222911 |
| Aug. 30, 2005 | (JP) | 2005-248740 |
| Aug. 30, 2005 | (JP) | 2005-248741 |

(51) Int. Cl.
*G03G 15/00* (2006.01)

(52) U.S. Cl. ..... 399/159; 399/115; 399/116

(58) Field of Classification Search ..... 399/107, 399/115, 159, 160, 161, 168, 174, 175, 176, 399/116, 117; 492/18, 47
See application file for complete search history.

(56) References Cited

U.S. PATENT DOCUMENTS

| | | | | |
|---|---|---|---|---|
| 6,516,169 | B2 * | 2/2003 | Niimi et al. | 399/159 |
| 6,721,523 | B2 * | 4/2004 | Sugiura et al. | 399/176 |
| 7,321,742 | B2 * | 1/2008 | Fujishiro et al. | 399/159 |

FOREIGN PATENT DOCUMENTS

| | | | |
|---|---|---|---|
| JP | 2001-296723 | | 10/2001 |
| JP | 2002-99135 | * | 4/2002 |
| JP | 2004-109151 | | 4/2004 |

* cited by examiner

*Primary Examiner*—Hoan H Tran
(74) *Attorney, Agent, or Firm*—Hogan & Hartson LLP

(57) ABSTRACT

An image forming apparatus has an image carrier with rotary shafts extending from both ends that are rotatably supported on an apparatus body by bearings. Gap members fixed to both end portions of a charging roller are brought in contact with the peripheral surface of the image carrier with some pressure to form a charge gap between the image carrier and the charging roller so that the charging roller charges the image carrier in a non-contact state with the charge gap. The gap members have a small-diameter portion on the inside thereof and a large-diameter portion on the outside thereof such that the small-diameter portions face each other.

44 Claims, 31 Drawing Sheets

PRIOR ART

PRIOR ART

CHARGING ROLLER AND IMAGE FORMING APPARATUS WITH THE SAME

CROSS-REFERENCE TO RELATED APPLICATIONS

This application is based upon and claims the benefit of priority from prior Japanese Patent Application No. 2005-222908, filed Aug. 1, 2005, Japanese Patent Application No. 2005-222907, filed Aug. 1, 2005, Japanese Patent Application No. 2005-222910, filed Aug. 1, 2005, Japanese Patent Application No. 2005-222911, filed Aug. 1, 2005, Japanese Patent Application No. 2005-222909, filed Aug. 1, 2005, Japanese Patent Application No. 2005-248741, filed Aug. 30, 2005, Japanese Patent Application No. 2005-248740, filed Aug. 30, 2005, the entire contents of which are incorporated herein by reference.

BACKGROUND

1. Technical Field

The present invention relates to a technology of a charging roller having ring-like gap members or gap members composed of tape-like film members fixed to both end portions thereof to form a predetermined charge gap relative to an image carrier so that the charging roller charges the image carrier in non-contact state. The present invention also relates to a technology of an image forming apparatus, composed of an electrophotographic apparatus such as an electrostatic copying machine, a printer, and a facsimile, provided with the charging roller.

2. Related Art

As examples of image forming apparatuses, image forming apparatuses each provided with a charging roller which has a predetermined charge gap relative to an image carrier so as to conduct non-contact charging of the image carrier have been known by JP-A-2001-296723 (hereinafter, referred to as Document 1) and JP-A-2004-109151 (hereinafter, referred to as Document 2). As shown in FIG. 34A, a charging roller "a" used for each of image forming apparatuses respectively disclosed in Document 1 and Document 2 comprises a metal core "b" and a resistive layer "c" covering the peripheral surface of the metal core "b". The resistive layer "c" is composed of an elastic member having conductive property. On the peripheral surfaces of the both end portions of the resistive layer "c", a pair of gap members "d", "e" which are composed of tape-like film members having insulation properties are wrapped into ring-like shapes and fixed or a pair of ring-like gap members "d", "e" having insulation properties are fixed. The gap members "d", "e" are brought in contact with the peripheral surface of a photoconductive drum "f" as an image carrier, whereby a predetermined charge gap G is defined. In this case, respective bearings "i", "j" of rotary shafts "g", "h" which coaxially extend from the ends of the metal core "b" are pressed toward the photoconductive drum "f" by biasing force of compression spring "k", "m", thereby bringing the gap members "d", "e" in contact with the peripheral surface of the photoconductive drum "f" with some pressure.

Non-contact charging of the photoconductive drum "f" achieved by the charging roller "a" through the charge gap G produces less ozone. Further, the non-contact charging prevents foreign matter such as toner particles adhering to the photoconductive drum "f" from adhering to the charging roller "a" and also prevents substances contained in the resistive layer "c" of the charging roller "a" from adhering to the photoconductive drum "f", thereby improving the chargeability of the photoconductive drum "f" by the charging roller "a".

Generally, a driving gear fixed to the rotary shaft of the metal core "b" is connected to a driving gear fixed to the rotary shaft of the photoconductive drum "f" via a power transmission gear train, but not shown, so that driving force from the motor is transmitted to the driving gear for the charging roller "a" via the driving gear of the photoconductive drum "f" and the power transmission gear train, thereby rotating the charging roller "a".

By the way, in the charging roller disclosed in Document 1, when the tape-like film member is wrapped around the charging roller, a joint portion is generated between an end and the other end of the film member. On the other hand, to constantly obtain stable charge on the image carrier, the charge gap G must be always kept constant at any position in any direction when the charging roller "a" is rotated. For this, the tape-like film members as the gap members "d", "e" are required to be wrapped around the charging roller "a" not to generate a space between the both ends of each film member (both ends in the circumferential direction of the charging roller "a") and not to superpose the both ends on each other in the vertical direction (the radial direction of the charging roller "a"). However, to achieve such wrapping of the film member around the charging roller "a", it is required not only to set the length of the film member with exquisite precision but also to wrap the film member to the charging roller "a" with exquisite precision. Accordingly, it is required to carry out extremely strict dimensional control of the film members, thus deteriorating the productivity and also increasing the cost.

If the precision for setting the length of the film member composing each gap member and the precision for wrapping the film member to the charging roller "a" are lowered to improve the productivity of the charging roller and to reduce the cost, it is inevitable that a space is generated between the ends of the gap member which is wrapped almost all the way around the charging roller or these ends are superposed on each other in the vertical direction. However, under the aforementioned condition, there is a portion without gap member in the axial direction of the charging roller or a variation in thickness of the gap member at the joint position of the charging roller. When the joint portion comes to a nip portion (contact portion) between the image carrier and the gap member, the charge gap G varies. Consequently, it is impossible to always obtain stable charging of the image carrier.

In the gap member of the charging roller disclosed in Document 1, as shown in FIG. 34B and FIG. 34C, the film member as the gap member "d" is formed to have tilt ends $d_1$, $d_2$ and to have such a length as to form a space "s" between the ends $d_1$, $d_2$ when wrapped around the charging roller "a". Accordingly, in a state that the film member is wrapped around the charging roller "a", the gap member "d" exists all the way in the circumferential direction of the charging roller "a" as seen in axial direction of the charging roller "a". Therefore, the constant charge gap G is maintained even with the joint portion and without strict dimensional control of the film member. The same is true for the film member as the other gap member "e", but not illustrated.

As shown in FIG. 34D and FIG. 34E, the film member as the gap member "d" is formed to have a length longer than the circumferential length of the charging roller "a" so that the other end portion $d_2$ of the film member is lapped with one end portion $d_1$ of the film member and is shifted in the axial direction of the charging roller "a" when the film member is wrapped around the charging roller "a". Accordingly, the gap member "d" exists all the way in the circumferential direction of the charging roller "a" as seen in axial direction of the charging roller "a". Therefore, similarly, the constant charge gap G is maintained without strict dimensional control of the film member. The same is true for the film member as the other gap member "e", but not illustrated.

Another method for making the gap member "d" to exist all the way in the circumferential direction of the charging roller "a" as seen in the axial direction of the charging roller "a" is also disclosed in Document 1, but the description will be omitted.

However, the charging roller "a" for non-contact charging to be used for an image forming apparatus, disclosed in the aforementioned Document 1 and Document 2, is structured such that the rotary shafts "g", "h" positioned outside of the pair of gap members "d", "e" are pressed toward the photoconductive drum "f" by springs (in this specification, a portion between the gap members "d", "e" is referred to the inside of the gap members "d", "e" while portions opposite to the inside relative to the gap members "d", "e" are referred to the outside of the gap members "d", "e".). Therefore, as shown in FIG. 35, the contact portions between the gap members "d", "e" and the photoconductive drum "f" function as fulcrums and portions, to which spring biasing force is applied, of the rotary shafts "g", "h" outside of the gap members "d", "e" function as power points so as to cause deflection (bending deformation) Dr of the portion "$a_1$", positioned inside the gap members "d", "e", of the charging roller "a" in a direction apart from the photoconductive drum "f". Normally, the maximum of deflection Dr of the charging roller "a" is positioned at the middle point in the axial direction between the gap members "d", "e".

Since the rotary shaft "i", "j" coaxially projecting in the axial direction from the both ends of the photoconductive drum "f" are rotatably supported on the apparatus body (not shown) by bearings, the photoconductive drum "f" is pressed by the gap members "d", "e" so as to cause deflection (bending deformation) Do in a direction apart from the charging roller "a", i.e. the direction opposite to that of the deflection Dr of the charging roller "a". Normally, the maximum of deflection Do of the photoconductive drum "f" is positioned at the middle point in the axial direction thereof.

Since the charging roller "a" and the photoconductive drum "f" deflect in the opposite directions, the charge gap G between the charging roller "a" and the photoconductive drum "f" varies in the axial direction, i.e. becomes not constant. Therefore, the uniform charge on the photoconductive drum "f" by the charging roller "a" is impossible. There is a problem that it is difficult to obtain stable charge.

Especially, recently it is more strongly desired to reduce the size and reduce the footprint of image forming apparatuses of electrophotographic type such as a printer of electrophotographic type. Accordingly, process units and function parts inside thereof are required to be smaller and to have high accuracy and it is required to place them optimally. It is therefore required to reduce the sizes of photoconductive drum and charging roller. If the outer diameter or the thickness of the photoconductive drum or the outer diameter of the charging roller is reduced, the aforementioned problem must be bigger.

As the charging roller "a" is driven to rotate directly by driving force of the motor via the driving gear of the photoconductive drum "f" and the power transmission gear train, the charging roller "a" receives pressure from the photoconductive drum "f" in a direction apart from the photoconductive drum "f" so that the charge gap G between the charging roller "a" and the photoconductive drum "f" varies and becomes unstable. Accordingly, the uniform charge on the photoconductive drum "f" by the charging roller "a" in the axial direction is impossible. There is a problem that it is difficult to obtain stable charge. Especially, this problem is significantly bigger in case where the charging roller "a" is composed of a non-elastic member.

If the charging roller "a" is adapted to be not directly driven via the gear train, the charging roller "a" is adapted to be driven to rotate by driving torque of the photoconductive drum "f" which is transmitted to the charging roller "a" by means of friction between the gap members "d", "e" and the photoconductive drum "f". However, as the circumferential environment varies or the friction coefficient between the gap member "d", "e" and the photoconductive drum "f" varies due to adhesion of foreign matter such as toner particles to the gap members "d", "e", the driving torque of the photoconductive drum "f" is not effectively transmitted to the charging roller "a" so that the rotation of the charging roller "a" becomes unstable. The unstable rotation of the charging roller "a" causes vibration due to contact between the charging roller "a" and the photoconductive drum "f" so that the charge gap G varies slightly. Especially, in case where the charging roller "a" is composed of a non-elastic member, this vibration may become strongly apparent. This is because the non-elastic charging roller is different from the elastic charging roller made of rubber or the like in that the contact between the charging roller "a" and the photoconductive drum "f" is substantially line contact so that it is impossible to ensure enough nip pressure at the contact between the charging roller "a" and the photoconductive drum "f" and it is therefore difficult to stably drive the charging roller "a" over the long term.

In the image forming apparatus disclosed in Documents 1 and 2, a transfer roller to be in contact with the photoconductive drum is arranged in a region opposite to the charging roller relative to a line which is passing through the center of the photoconductive drum and is perpendicular to a line connecting the center of the photoconductive drum and the center of the charging roller, thereby somewhat preventing the photoconductive drum from being deflected by the pressure from the charging roller as mentioned above.

In the image forming apparatus disclosed in Documents 1 and 2, however, the deflection of the photoconductive drum due to the pressure of the charging roller can not be effectively prevented because the transfer roller is just arranged in the region opposite to the charging roller relative to the perpendicular line. In the image forming apparatus disclosed in Documents 1 and 2, therefore, it is difficult to readily obtain the high-precision charge gap which is uniform in the axial direction.

Further, when the film members as the gap members "d", "e" are just wrapped around the peripheral surface of the charging roller "a" in the manner as the charging roller disclosed in Document 1, there is a problem that, as the pressure contact between the gap members "d", "e" and the photoconductive drum is repeated, at least one of the ends of the gap members "d", "e" unstick and ride up from the photoconductive drum. Especially the end on the side starting the ingress into the nip portion between the gap member "d", "e" and the photoconductive drum "f" easily unstick because pressing force from the photoconductive drum is repeatedly applied to the aforementioned end at the nip portion in the direction promoting unsticking. In case where the photoconductive drum "f" and the charging roller "a" are stopped from rotating when the portion of the second gap member "e" is positioned at the nip portion between the photoconductive drum "f" and the second gap member "e", there is the following problem when the portion not projecting outside of the peripheral surface 3*s* including the rear end of the other end portion $\mathbf{3}e_2$ is in contact with the photoconductive drum "f". That is, the photoconductive drum "f" and the charging roller "a" rotate at substantially the same circumferential velocity but there is slight differential speed between the circumferential velocity of the photoconductive drum "f" and the circumferential velocity of the charging roller "a" and only the photoconductive drum "f" slightly rotates due to backlash of the gear train for transmitting torque at the moment of the stop of the charging roller "a". Consequently, it is very rare case, but the other end portion of the gap member "d", "e" may also unstuck from the charging roller "a". Further, in case of non-elastic charging roller "a", the unsticking of the gap members "d", "e" occurs with increasing frequency.

If the end(s) of the gap members "d", "e" ride up, the charge gap G by the gap members "d", "e" varies according to the rotation of the charging roller and can not kept constant. Therefore, it is difficult to conduct uniform and stable charge relative to the photoconductive drum.

SUMMARY

The first object of the invention is to provide an image forming apparatus of a type that a charging roller charges an image carrier in non-contact state with a charge gap which is set by bringing gap members, fixed to both end portions of the charging roller, in contact with the image carrier with some pressure, in which high-precision charge gap which is uniform in the axial direction can be obtained so as to ensure stable charge.

The second object of the invention is to provide an image forming apparatus in which stable charge is ensured by preventing charge gap from varying due to direct driving of the charging roller and the charging roller can be stably rotated.

The third object of the invention is to provide a charging roller of a type charging an image carrier in non-contact state with a charge gap which is set by bringing tape-like gap members which are fixed to both end portions thereof and thus have respective joint portions in contact with the image carrier with some pressure, in which unsticking of the gap members can be prevented over the long term so as to ensure stable charge, and to provide an image forming apparatus comprising the same.

To accomplish these objects, an image forming apparatus according to an aspect of the invention comprises a charging roller having gap members fixed to both end portions thereof, respectively. The gap members are brought in contact with the peripheral surface of the image carrier with some pressure, thereby setting a charge gap relative to the image carrier. The charging roller charges the image carrier in non-contact state with the charge gap. In this case, the gap members are each formed to have a small-diameter portion on the inside thereof and a large-diameter portion on the outside thereof such that the respective small-diameter portions are positioned to face each other.

In the image forming apparatus according to an aspect of the invention, each gap member of the charging roller is composed of a single piece or two or more pieces. Further, in the image forming apparatus according to an aspect of the invention, each gap member is formed in a truncated cone shape.

An image forming apparatus according to an aspect of the invention comprises: at least an image carrier of which rotary shafts extending from both ends thereof are rotatably supported on an apparatus body by bearings; and a charging roller having gap members fixed to both end portions thereof, respectively. The gap members are brought in contact with the peripheral surface of the image carrier with some pressure, thereby setting a charge gap between the image carrier and the charging roller so that the charging roller charges the image carrier in non-contact state with the charge gap. The charging roller employed in the image forming apparatus according to the aspect of the invention is a charging roller according to any one of the aspects of the invention.

The image forming apparatus according to an aspect of the invention further comprises pressing members for pressing at least either of non-charging areas inside the gap members of the charging roller and the gap members toward the image carrier, respectively. At least either of the non-charging areas inside the gap members of the charging roller and the gap members are pressed by the pressing members toward the image carrier so as to bring the gap members in contact with the peripheral surface of the image carrier with some pressure.

An image forming apparatus according to an aspect of the invention further comprises pressing members for pressing non-charging areas inside the gap members of the charging roller, respectively. The non-charging areas inside the gap members of the charging roller are pressed by the pressing members toward the image carrier, thereby bringing the gap member in contact with the peripheral surface of the image carrier.

In the image forming apparatus according to an aspect of the invention, the pressing members are arranged to press also the gap members toward the image carrier. Further in the image forming apparatus according to an aspect of the invention, each pressing member is composed of a first pressing member which presses the gap member toward the image carrier and a second pressing member which is formed separately from the first pressing member and presses the non-charging area inside the gap member of the charging roller toward the image carrier. Further in the image forming apparatus according to an aspect of the invention, the pressing force of the second pressing member for pressing the non-charging area inside the gap member of the charging roller is set to be larger than the pressing force of the first pressing member for pressing the gap member.

Further, an image forming apparatus according to an aspect of the invention comprises: at least an image carrier of which rotary shafts extending from both ends thereof are rotatably supported on an apparatus body by bearings; and a charging roller having gap members fixed to both end portions thereof, respectively. The gap members are brought in contact with the peripheral surface of the image carrier with some pressure so as to form a charge gap between the image carrier and the charging roller so that the charging roller charges the image carrier in non-contact state with the charge gap. In addition, the image forming apparatus further comprises pressing members for pressing the gap members toward the image carrier, respectively. At least one of the pressing members is driven to rotate by driving force of a power source. Further in the image forming apparatus according to an aspect of the invention, the charging roller is a non-elastic member and the pressing members are elastic members.

In the image forming apparatus according to an aspect of the invention further comprises a cleaning member which is disposed between the pressing members. The pressing members and the cleaning member are arranged on a rotary shaft which is driven to rotate by driving force of the power source. In addition, the charging roller is a non-elastic member and the pressing members are elastic members. Further in the image forming apparatus according to an aspect of the invention, the pressing members and the cleaning member are formed integrally.

An image forming apparatus according to an aspect of the invention comprises: at least an image carrier of which rotary shafts extending from both ends thereof are rotatably supported on an apparatus body by bearings; a charging roller having gap members fixed to both end portions thereof, respectively; and a pressing member which is located on the opposite side of the charging roller relative to a line passing through the center of the image carrier and perpendicular to a line connecting the center of the image carrier and the center of the charging roller. The gap members are brought in contact with the peripheral surface of the image carrier with some pressure to form a charge gap between the image carrier and the charging roller so that the charging roller charges the image carrier in non-contact state with the charge gap, and the image carrier is pressed by the pressing member. The width of the pressing member is set to be smaller than the distance between the inner edges of the gap members fixed to the end portions of the charging roller.

The image forming apparatus according to an aspect of the invention further comprises a cleaning member which is in contact with the charging roller to clean the charging roller. The width of the cleaning member is set to be larger than the distance between the outer edges of the gap members and the charging roller is pressed by the cleaning member toward the image carrier. Further, the pressing member for pressing the image carrier is an image forming component member which is in contact with the image carrier to perform image forming action, and the width of the image forming component member is set to be smaller than the distance between the gap members.

Further, the image forming component member is a transfer roller which is in contact with the image carrier to transfer an image on the image carrier to a transfer medium, and the width of the transfer roller is set to be smaller than the distance between the gap members.

The image forming apparatus according to an aspect of the invention further comprises pressing members which are arranged on both ends of the cleaning member to press the gap members toward the image carrier.

The cleaning member is formed in a roller shape. Further, the cleaning member is formed in a barrel shape of which the outer diameter at the middle is larger than the outer diameter at the both ends.

A charging roller according to an aspect of the invention comprises: a first gap member of a tape-like shape which is fixed to one end portion of the charging roller and thus has a joint portion; and a second gap member of a tape-like shape which is fixed to the other end portion of the charging roller and thus has a joint portion. The first and second gap members are brought in contact with the peripheral surface of an image carrier with some pressure so as to form a charge gap between the image carrier and the charging roller. The charging roller rotates during the rotation of the image carrier to charge the image carrier in non-contact state with the charge gap. A first gap member entrance side contact-preventing means for preventing one end portion of the first gap member on a side entering into the contact portion relative to the image carrier from having contact with the image carrier is formed in one end portion of the charging roller. Further, a second gap member entrance side contact-preventing means for preventing one end portion of the second gap member on a side entering into the contact portion relative to the image carrier from having contact with the image carrier is formed in the other end portion of the charging roller. Further, a first gap member exit side contact-preventing means for preventing the other end portion of the first gap member on a side exiting from the contact portion relative to the image carrier from having contact with the image carrier is formed in the one end portion of the charging roller. Furthermore, a second gap member exit side contact-preventing means for preventing the other end portion of the second gap member on a side exiting from the contact portion relative to the image carrier from having contact with the image carrier is formed in the other end portion of the charging roller.

In the charging roller according to an aspect of the invention, the first and second gap member entrance side contact-preventing means are composed of first and second entrance side concavities, respectively. The first and second gap member exit side contact-preventing means are composed of first and second exit side concavities, respectively. In addition, the one end portion of the first gap member is fixed to the first entrance side concavity and the one end portion of the second gap member is fixed to the second entrance side concavity. The other end portion of the first gap member is fixed to the first exit side concavity and the other end portion of the second gap member is fixed to the second exit side concavity.

In the charging roller according to an aspect of the invention, the first entrance side concavity and the first exit side concavity are formed at positions which are different from each other in the circumferential direction. The second entrance side concavity and the second exit side concavity are formed at positions which are different from each other in the circumferential direction.

In the charging roller according to an aspect of the invention, the first entrance side concavity and the second entrance side concavity are formed at positions which are different from each other in the circumferential direction. The first exit side concavity and the second exit side concavity are formed at positions which are different from each other in the circumferential direction.

In the charging roller according to an aspect of the invention, the width of the one end portion of the first gap member which is fixed to the first entrance side concavity and the width of the other end portion of the first gap member which is fixed to the first exit side concavity are set to be smaller than the other portion of the first gap member. The width of the one end portion of the second gap member which is fixed to the second entrance side concavity and the width of the other end portion of the second gap member which is fixed to the second exit side concavity are set to be smaller than the other portion of the second gap member.

An image forming apparatus according to an aspect of the invention comprises: at least an image carrier on which a latent image and a developer image are formed; a charging roller for charging the image carrier in non-contact state; a writing device for writing the latent image on the image carrier; a developing device for developing the latent image on the image carrier with developer; and a transfer device for transferring the developer image on the image carrier. The charging roller employed in the image forming apparatus according to the aspect of the invention is a charging roller according to any one of the aspects of the invention.

A charging roller according to an aspect of the invention comprises: gap members of tape-like shape which are fixed to both end portions of the charging and thus have respective joint portions. The gap members are brought in contact with the peripheral surface of an image carrier with some pressure so as to form a charge gap between the image carrier and the charging roller. The charging roller rotates during the rotation of the image carrier to charge the image carrier in non-contact state with the charge gap. The charging roller further comprises gap member end contact-preventing means for preventing one end portions of the gap members on a side entering into the contact portion relative to the image carrier from having contact with the image carrier. The gap member end contact-preventing means are disposed on the both end portions of the charging roller, respectively.

In the charging roller according to an aspect of the invention, the gap member end contact-preventing means disposed on the both end portions are both concavities. The respective one end portions of the gap members are at least partially fixed to the concavities. As for the concavities, the concavity at the one end side and the concavity at the other end side are formed at the same position in the circumferential direction or formed at positions which are different from each other in the circumferential direction. In addition, the width of the portions of the gap members which are fixed to the concavities is set to be smaller than the other portions of the gap members.

An image forming apparatus according to an aspect of the invention comprises: at least an image carrier on which a latent image and a developer image are formed; a charging roller for charging the image carrier in non-contact state; a writing device for writing the latent image on the image carrier; a developing device for developing the latent image on the image carrier with developer; and a transfer device for transferring the developer image on the image carrier. The charging roller employed in the image forming apparatus according to the aspect of the invention is a charging roller according to any one of aspects of the invention.

In the image forming apparatus according to the aspect of the invention, the gap members fixed to the both end portions of the charging roller are each formed to have a small-diameter portion on the inside thereof and a large-diameter portion on the outside thereof and at least either of the portions of the charging roller inside the gap members and the gap members are pressed toward the image carrier by the pressing members, whereby the charging roller and the image carrier are forcedly deflected in the same direction because of the gap members having the inclined peripheral surfaces such that the diameter of the gap members decrease toward the inside. Accordingly, the charge gap between the charging roller and the image carrier can be maintained to be a certain value (50 μm) or less and to be substantially constant in the axial direction.

Therefore, the charge on the image carrier by the charging roller becomes substantially uniform in the axial direction so as to provide stable charge over the long term. Especially, the deflection of the charging roller and the deflection of the image carrier have respective maximums at the same position i.e. the middle point between the pair of gap members, thereby making the charge gap to be further precisely uniform in the axial direction and thus providing further stable charge relative to the image carrier.

Since the portions of the charging roller to be pressed by the pressing members are non-charging areas of the charging roller, the stable charge relative to the image carrier can be conducted without being affected even with a problem on the charge of the image carrier, for example frictional electrification, due to the contact between the pressing members and the charging roller.

Since the charge gap can be constant in the axial direction even with the deflection of the charging roller and the deflection of the image carrier, the charging roller can be designed to have reduced outer diameter and the image carrier can be designed to have reduced outer diameter and reduced thickness. Therefore, it can effectively meet the demands for size reduction and space saving of the image forming apparatus which are recently strongly desired as mentioned above.

In the image forming apparatus of the aspect of the invention, the portions of the charging roller inside the gap members fixed to the both end portions of the charging roller are pressed toward the image carrier by the pressing member, whereby the gap members are brought in contact with the image carrier to set a charge gap and, in addition, the charging roller and the image carrier can be both deflected in the same direction. Accordingly, the charge gap between the charging roller and the image carrier can be formed to be a certain value (50 μm) or less and to be substantially constant in the axial direction. Therefore, the charge on the image carrier by the charging roller can be made uniform in the axial direction, thereby providing stable charge over the long term. Especially, the deflection of the charging roller and the deflection of the image carrier have respective maximums at the same position i.e. the middle point between the pair of gap members, thereby making the charge gap to be further precisely uniform in the axial direction and thus providing further stable charge relative to the image carrier.

Since the portions of the charging roller to be pressed by the pressing members are non-charging areas of the charging roller, the stable charge relative to the image carrier can be conducted without being affected even with a problem on the charge of the image carrier, for example frictional electrification, due to the contact between the pressing members and the charging roller.

Since the charge gap can be constant in the axial direction even with the deflection of the charging roller and the deflection of the image carrier, the charging roller can be designed to have reduced outer diameter and the image carrier can be designed to have reduced outer diameter and reduced thickness. Therefore, it can effectively meet the demands for size reduction and space saving of the image forming apparatus which are recently strongly desired as mentioned above.

Since the gap members are also pressed toward the image carrier by the pressing members, the contact of the gap members with the image carrier can be further ensured, thereby further stably forming the charge gap. As compared to the conventional manner in which the rotary shafts of the charging roller outside of the gap members are pressed, this arrangement in which the gap members are pressed by the pressing members makes the charging roller hard to deflect in a direction apart from the image carrier. Therefore, the charge gap can be further securely formed to be a certain value (50 μm) or less, thereby providing further stable charge over the long term.

Since the first pressing member for pressing the gap member and the second pressing member for pressing the non-charging area inside the gap member of the charging roller are formed as separate members, the pressing force for pressing the gap member and the pressing force for pressing the non-charging area inside the gap member of the charging roller can be controlled separately. Accordingly, the deflection of the portion of the charging roller inside the pair of the gap members can be controlled to further exactly follow the deflection of the image carrier. Therefore, the charge gap can be made constant in the axial direction with higher precision.

Further, by setting the pressing force by the second pressing members for pressing the non-charging areas inside the gap members to be larger than the pressing force by the first pressing members for pressing the gap members, the portion of the charging roller inside the pair of the gap members can be efficiently deflected to follow the deflection of the image carrier. Therefore, the charge gap can be further effectively made constant in the axial direction.

In the image forming apparatus according to the aspect of the invention, the charging roller is pressed toward the image carrier by the pressing members via the gap members and the charging roller is rotated by driving torque of the image carrier and driving torque of the pressing members via the gap members, that is, the charging roller is not driven directly via gear train, the charging roller can be prevented from being subjected to vibration due to the driving of the gear and can be prevented from being affected by pushing force from the gear arranged on one side of the charging roller, thereby providing stable charge over the long term.

Since the charging roller can be stably and securely rotated even though the charging roller is not directly driven, vibration due to the contact between the charging roller and the image carrier can be dampened, thereby effectively preventing the charge gap from varying. In this case, since the charging roller is a non-elastic member, enough nip pressure can be obtained at the contact between the charging roller and the image carrier, thereby effectively dampening the vibration.

Since the portion of the charging roller between the gap members is pressed toward the image carrier by the cleaning member, the charging roller and the image carrier can be both deflected in the same direction. Accordingly, the charge gap between the charging roller and the image carrier can be formed to be a certain value (50 μm) or less and to be substantially constant in the axial direction. Therefore, the charge on the image carrier by the charging roller can be made uniform in the axial direction, thereby providing stable charge over the long term. Especially, the deflection of the charging roller and the deflection of the image carrier have respective maximums at the same position i.e. the middle point between the pair of gap members, thereby making the charge gap to be further precisely uniform in the axial direction and thus providing further stable charge relative to the image carrier.

Further, since the gap members are pressed toward the image carrier by the pressing members, the contact of the gap members with the image carrier can be further ensured, thereby further stably forming the charge gap. As compared to the conventional manner in which the rotary shafts of the charging roller outside of the gap members are pressed, this arrangement in which the gap members are pressed by the pressing members makes the charging roller hard to deflect in a direction apart from the image carrier. Therefore, the charge gap can be further uniform in the axial direction.

Since the charge gap can be constant in the axial direction even with the deflection of the charging roller and the deflection of the image carrier, the charging roller can be designed to have reduced outer diameter and the image carrier can be designed to have reduced outer diameter and reduced thickness. Therefore, it can effectively meet the demands for size reduction and space saving of the image forming apparatus which are recently strongly desired as mentioned above.

Since the pressure members and the cleaning member are integrally formed, overall size reduction is achieved, thereby further effectively achieving space saving. Further, the charging roller is pressed toward the image carrier by the cleaning member so as to adjust the charge gap and is also cleaned by the cleaning member, thereby further ensuring stable charge over the long term.

Since the pressing members are composed of elastic members such as rubber, vibration caused on the charging roller can be effectively dampened and the torque of the pressing member can be securely transmitted to the charging roller via the gap members. Therefore, the charging roller can be further stably driven to rotate.

In the image forming apparatus of the aspect of the invention, since the image carrier is pressed by the pressing member which is located on the opposite side of the charging roller relative to a line passing through the center of the image carrier and perpendicular to a line connecting the center of the image carrier and the center of the charging roller, deflection of the image carrier due to pressing by the charging roller can be reduced. Accordingly, the charge gap between the charging roller and the image carrier can be formed to be a certain value (50 μm) or less and to be substantially constant in the axial direction. Therefore, the charge on the image carrier by the charging roller can be made uniform in the axial direction, thereby providing stable charge over the long term.

Further, since the width of the pressing member is set to be smaller than the distance between the inner edges of the gap members, deflection of the portion of the image carrier corresponding to the portion of the charging roller between the gap members, i.e. deflection of the charging area of the image carrier containing image forming are, is securely reduced. Accordingly, the charge gap between the charging roller and the image carrier can be set to be substantially constant in the axial direction and to be a certain value (50 μm) or less.

Since the charge gap can be constant in the axial direction even with the deflection of the image carrier, the charging roller can be designed to have reduced outer diameter and the image carrier can be designed to have reduced outer diameter and reduced thickness. Therefore, it can effectively meet the demands for size reduction and space saving of the image forming apparatus which are recently strongly desired as mentioned above.

Further, since the pressing member is composed of an image forming component member such as a transfer roller, the need of special pressing member for pressing the image carrier can be eliminated. Therefore, the increase in number of parts can be prevented while making the charge gap constant in the axial direction, thereby flexibly meeting the demands for size reduction and space saving of the image forming apparatus.

Since the gap members and the portion of the charging roller between the gap members are pressed by the cleaning member, the charging roller and the image carrier are forcedly deflected in the same direction. Accordingly, the charge gap between the charging roller and the image carrier can be farther effectively set be a certain value (50 μm) or less and to be uniform in the axial direction. Therefore, the charge on the image carrier by the charging roller can be made further uniform in the axial direction, thereby providing further stable charge over the long term. Especially, the deflection of the charging roller and the deflection of the image carrier have respective maximums at the same position i.e. the middle point between the pair of gap members, thereby making the charge gap to be further precisely uniform in the axial direction and thus providing further stable charge.

Since the width of the cleaning member is set to be larger than the distance between the outer edges of a pair of gap members and the gap members are pressed toward the image carrier by the cleaning member, foreign matter such as toner particles adhering to the surfaces of the gap members can be removed by the cleaning member. Accordingly, the charge gap G can be maintained to be constant in the axial direction and to a certain value (50 μm) or less.

Further, in the image forming apparatus according to the aspect of the invention, since the portion of the charging roller between the pair of gap members is pressed toward the image carrier, the charging roller and the image carrier are forcedly deflected in the same direction. Accordingly, the charge gap between the charging roller and the image carrier can be further effectively set be a certain value (50 μm) or less and to be uniform in the axial direction. Especially, the deflection of the charging roller and the deflection of the image carrier have respective maximums at the same position i.e. the middle point between the pair of gap members, thereby making the charge gap to be further precisely uniform in the axial direction and thus providing further stable charge.

Since the charge gap can be constant in the axial direction even with the deflection of the charging roller and the deflection of the image carrier, the charging roller can be designed to have reduced outer diameter and the image carrier can be designed to have reduced outer diameter and reduced thickness. Therefore, it can effectively meet the demands for size reduction and space saving of the image forming apparatus which are recently strongly desired as mentioned above.

Since the cleaning member is formed into a barrel shape, the charging roller can be deflected to have the maximum point of deflection at the middle point of the charging roller, where corresponds to the maximum point of deflection of the image carrier when pressed by the gap members, according to the profile of the barrel shape. Accordingly, the charge gap is effectively set to be a certain value (50 μm) or less and set to be further uniform in the axial direction.

Since the gap members are pressed toward the image carrier by the pressing members, respectively, the gap members are further securely brought in contact with the image carrier, thereby further stably forming the charge gap. As compared to the conventional manner in which the rotary shafts of the charging roller outside of the gap members are pressed, this arrangement in which the gap members are pressed by the pressing members makes the charging roller hard to deflect in a direction apart from the image carrier. Therefore, the charge gap is effectively set to be a certain value (50 μm) or less, thereby providing further stable charge over the long term.

Since the pressing members are arranged on both ends of the cleaning member, the pressing members and the cleaning member are integrally formed. Accordingly, overall size reduction is achieved, thereby further effectively achieving space saving.

In the image forming apparatus according to the aspect of the invention, the first and second gap members composed of tape-like members are present all around the charging roller in the circumferential direction to extend in the axial direction, the one end portions, on the side entering into the contact portion relative to the image carrier, and the other end portions, on the side exiting from the contact portion relative to the image carrier, of the first and second gap members are prevented from having contact with the image carrier by the first and second gap member entrance side contact-preventing means and the first and second gap member exit side contact-preventing means even when the first and second gap members enter into the contact portions relative to the image carrier, whereby the first and second gap members are securely prevented from unsticking from the charging roller even when printing action, i.e. image forming action is conducted for a prolonged period and even when the image carrier and the charging roller are stopped from rotating when the other end portions of the first and second gap members are positioned at the contact portions relative to the image carrier. Especially when the charging roller is composed of a non-elastic member which increases the frequency of the unsticking of the gap members, the unsticking of the first and second gap members is effectively prevented. Therefore, uniform and stable charge gap can be maintained over the long term so as to provide stable charge on the image carrier, thereby providing high-quality images over the long term.

In the image forming apparatus according to the aspect of the invention, the gap members composed of tape-like members are present all around the charging roller in the circumferential direction to extend in the axial direction, the one end portions, on the side entering into the contact portion relative to the image carrier, of the gap members are prevented from having contact with the image carrier by the gap member entrance side contact-preventing means even when the gap members enter into the contact portions relative to the image carrier, whereby the gap members are securely prevented from unsticking from the charging roller even when printing action, i.e. image forming action is conducted for a prolonged period. Especially when the charging roller is composed of a non-elastic member which increases the frequency of the unsticking of the gap members, the unsticking of the gap members is effectively prevented. Therefore, uniform and stable charge gap can be maintained over the long term so as to provide stable charge on the image carrier, thereby providing high-quality images over the long term.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings.

Figure 1:
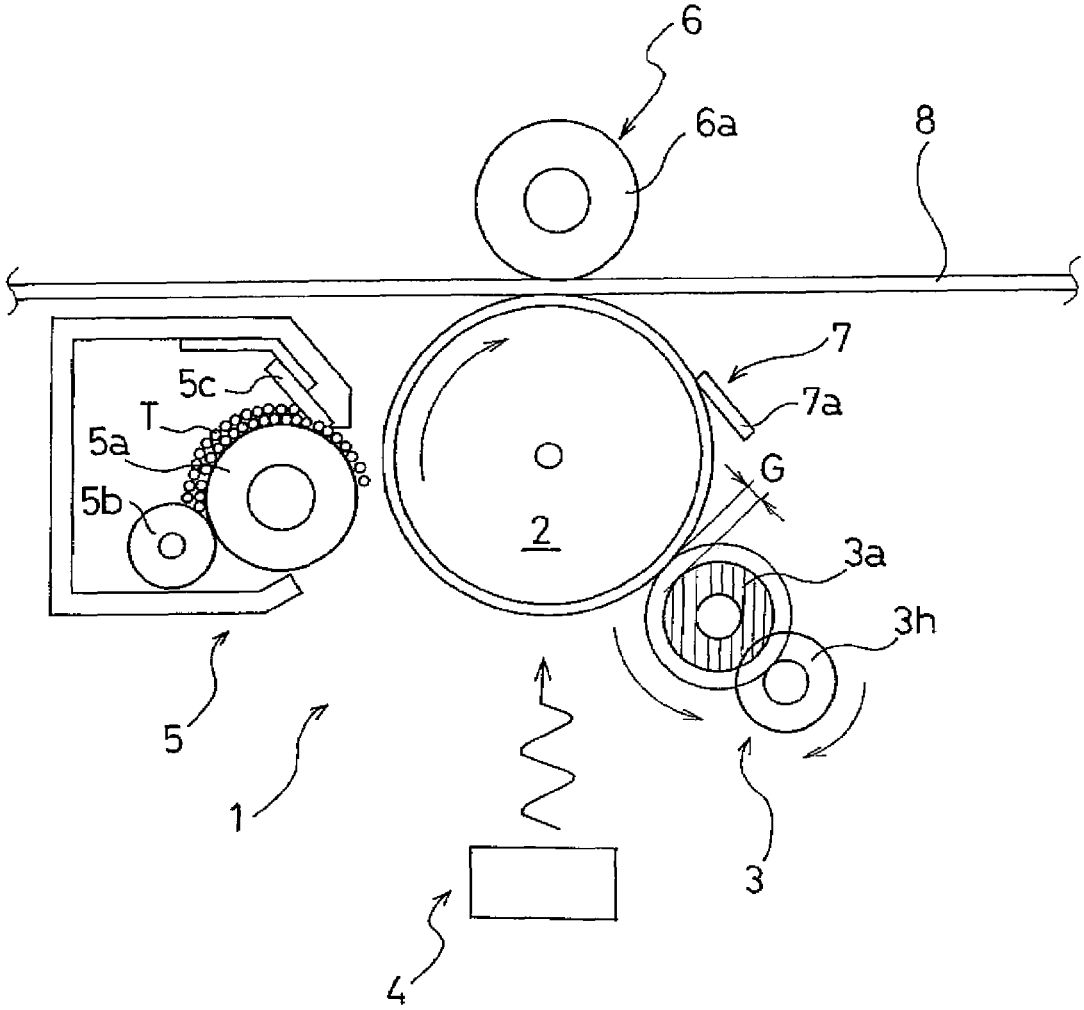
FIG. 1 is an illustration schematically and partially showing an image forming apparatus of a first embodiment according to the invention.

FIG. 1 is an illustration schematically and partially showing an image forming apparatus of a first embodiment according to the invention.

As shown in FIG. 1, the image forming apparatus 1 of this embodiment comprises a photoconductor 2 as an image carrier on which a electrostatic latent image and a toner image are formed and further comprises, in order of the rotational direction (clockwise direction as seen in FIG. 1) of the photoconductor 2 from the upstream, a charging device 3, an optical writing device 4, a developing device 5, a transfer device 6, and a cleaning device 7 which are arranged around the photoconductor 2.

The photoconductor 2 of this embodiment is composed of a photoconductive drum. Similarly to a conventionally known photoconductive drum, the photoconductor 2 comprises a cylindrical metal tube and a photoconductive layer having a predetermined film thickness covering the peripheral surface of the metal tube. As the metal tube of the photoconductor 2, a conductive tube such as made of aluminum is used. As the photoconductive layer, an organic photoreceptor which is conventionally known is used. The photoconductor 2 has rotary shafts 2*a*, 2*b* (shown in FIG. 4A) coaxially projecting from the both ends thereof in the axial direction, which are rotatably supported on an apparatus body (not shown) by bearings.

Figure 2:
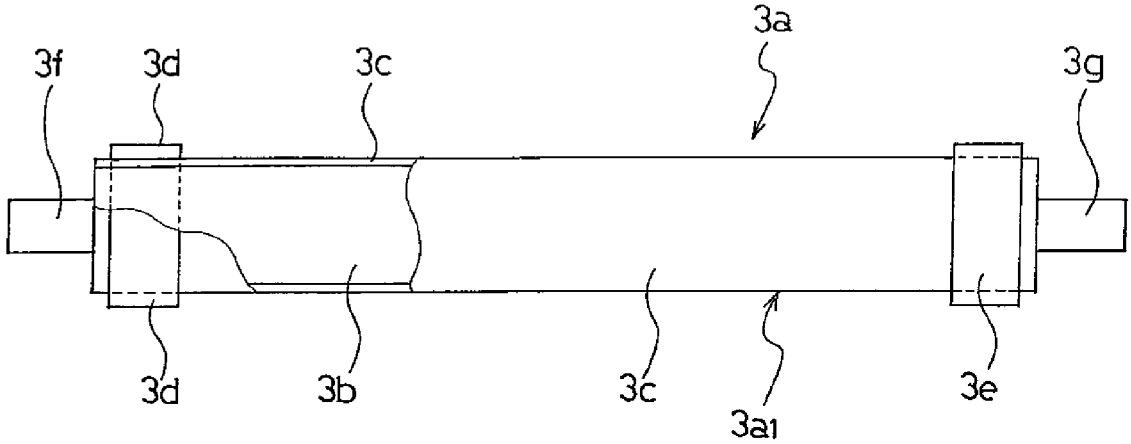
FIG. 2 is an illustration schematically showing a charging roller to be used in the image forming apparatus of the first embodiment shown in FIG. 1, with a portion thereof being broken away.

The charging device 3 has a non-contact type charging roller 3*a* of this embodiment. As shown in FIG. 2, the non-contact type charging roller 3*a* comprises a metal core 3*b* which is a conductive shaft such as a metal shaft having conductive property. For example, as the conductive shaft, a shaft comprising a SUM 22 and a Ni plating covering the surface of the SUM 22 may be used.

A resistive layer 3*c* is formed on the peripheral surface of the metal core 3*b* by spraying conductive coating material. At both end portions of the resistive layer 3*c*, a pair of gap members 3*d*, 3*e* composed of elastic members having electrical insulating properties are fixed around the peripheral surfaces thereof. The resistive layer 3*c* between the gap members 3*d*, 3*e* functions as a charging portion $3a_1$ for conducting uniform charge on the photoconductor 2 with a predetermined charge gap G therebetween.

Figure 3A:
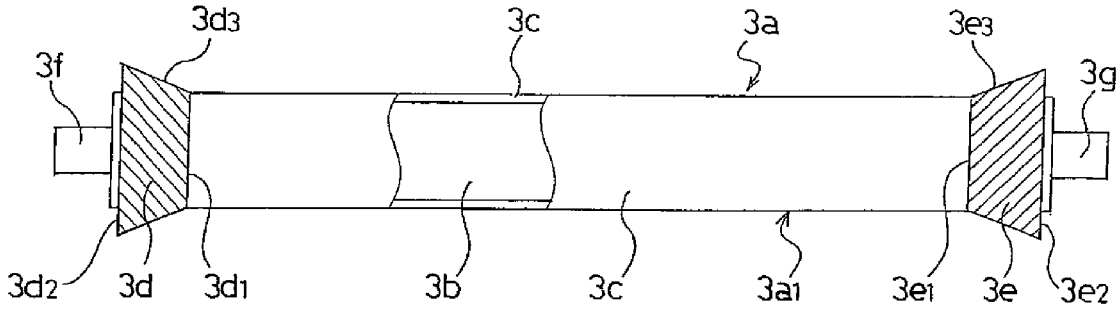
FIG. 3A is an illustration schematically showing an illustrative example of the charging roller used in the image forming apparatus of the embodiment shown in FIG. 1, with a portion thereof being broken away.

As shown in FIG. 3A, the gap members 3*d*, 3*e* are formed in completely the same ring-like truncated cone shape and are arranged to produce a symmetrical appearance as seen in FIG. 3A. In this case, the gap members 3*d*, 3*e* are disposed such that small-diameter portions thereof are positioned inside to face each other.

The gap members 3*d*, 3*e* are formed in the following manner. That is, liquid is prepared by solving resin such as polyimide (PI) resin into solvent such as dimethylsulfoxide (DMSO) (available from Sankyo Chemical Co., Ltd.). The prepared liquid is coated onto the end portions of the charging roller by dip coating while continuously increasing the drawing speed so as to form the gap members 3*d*, 3*e* into the truncated cone shapes which comprise predetermined small-diameter portions $3d_1$, $3e_1$, large-diameter portions $3d_2$, $3e_2$, and peripheral surfaces $3d_3$, $3e_3$ of such a predetermined inclination that the diameters of the gap members 3*d*, 3*e* decrease toward the inside. Therefore, the gap members 3*d*, 3*e* have predetermined inclined film thicknesses. The diameters of the small-diameter portions $3d_1$, $3e_1$ of the gap members 3*d*, 3*e* are set to be the same as the outer diameter (diameter) of the charging roller 3*a*. The charging roller 3*a* comprises rotary shafts 3*f*, 3*g* coaxially projecting in the axial direction from both ends of the metal core 3*b*. The rotary shafts 3*f*, 3*g* are rotatably supported on the apparatus body by bearings.

Figure 4A:
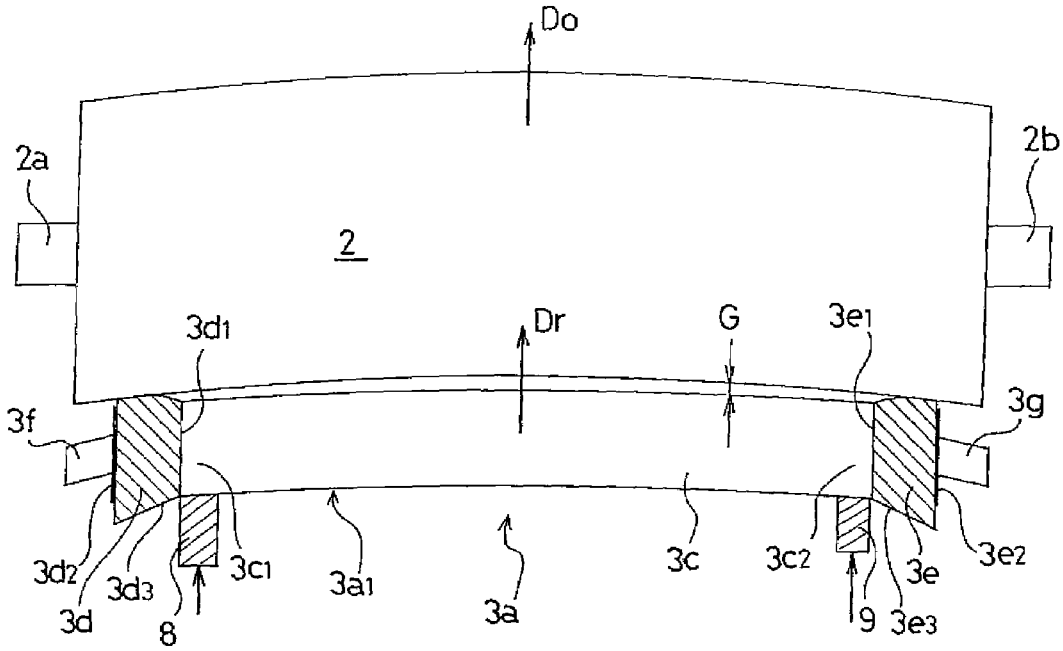
FIG. 4A is an illustration schematically showing behavior of the charging roller and a photoconductor used in the image forming apparatus of the embodiment shown in FIG. 3A.

As shown in FIG. 4A, the gap members 3*d*, 3*e* sets a predetermined charge gap G between the resistive layer 3*c* and the photoconductor 2 when pressed against the peripheral surface of the photoconductor 2. The charge gap G is set based on the thickness of the gap members 3*d*, 3*e* after elastically deflecting. In this case, portions $3c_1$, $3c_2$ of the resistive layer 3*c* of the charging roller 3*a* are pressed toward the photoconductor 2 by a pair of pressing members 8, 9 with predetermined force, whereby the gap members 3*d*, 3*e* are brought in contact with the peripheral surface of the photoconductor 2 with some pressure. The portions $3c_1$, $3c_2$ of the resistive layer 3*c* of the charging roller 3*a* are non-charging areas, i.e. not contributing the charge on the photoconductor 2, of the resistive layer 3*c*. The non-charging areas of the charging roller 3*a* face non-image areas of the photoconductor 2. Accordingly, the pressing members 8, 9 press the portions of the charging roller 3*a* not affecting the image area of the photoconductor 2.

The pressing members 8, 9 are made of, for example, rubber to have symmetrical forms. The pressing members 8, 9 have inclined pressing portions for pressing the gap members 3*d*, 3*e* toward the photoconductor 2, respectively. The inclination of the inclined pressing portions are set to be equal to the inclination of the peripheral surfaces $3d_3$, $3e_3$ of the gap members 3*d*, 3*e*. The resistive layer 3*c* between the gap members 3*d*, 3*e* functions as a charging portion for conducting non-contact uniform charge on the photoconductor 2 with the predetermined charge gap G.

The optical writing device 4 writes an electrostatic latent image on the photoconductor 2 by laser beam or the like. The developing device 5 comprises a development roller 5*a*, a toner supply roller 5*b*, and a toner thickness regulating blade 5*c*. Toner T as developer is supplied onto the development roller 5*a* by the toner supply roller 5*b*. The toner T on the development roller 5*a* is regulated to have constant thickness by the toner thickness regulating blade 5*c* and is transferred to the photoconductor 2. The electrostatic latent image on the photoconductor 2 is developed with the transferred toner T so as to form a toner image on the photoconductor 2.

The transfer device 6 has a transfer roller 6*a*. The toner image on the photoconductor 2 is transferred to a transfer medium 13 such as a transfer paper or an intermediate transfer medium by the transfer roller 6*a*. When the toner image is transferred to the transfer paper as the transfer medium 13, the toner image on the transfer paper is fixed by a fuser (not shown) so as to form an image on the transfer paper. On the other hand, when the toner image is transferred to the intermediate transfer medium as the transfer medium 13, the toner image on the intermediate transfer medium is further transferred to a transfer paper and, after that, the toner image on the transfer paper is fixed by a fuser (not shown) so as to form an image on the transfer paper.

The cleaning device 7 has a cleaning member 7*a* such as a cleaning blade. The photoconductor 2 is cleaned by the cleaning member 7*a* so as to remove and collect residual toner on the photoconductor 2 after transfer.

In the image forming apparatus 1 of this embodiment having the aforementioned structure, the pair of gap members 3*d*, 3*e* of the charging roller 3*a*, of which the rotary shafts 3*f*, 3*g* are rotatably supported on the apparatus body, are pressed toward the photoconductor 2 by the pressing members 8, 9, whereby the portion $3a_1$ of the charging roller 3*a* between the gap members 3*d*, 3*e* is forcedly deflected to have deflection (bending deformation) Dr in a direction toward the photoconductor 2 as shown in FIG. 4A because the peripheral surfaces of the gap members 3*d*, 3*e* which are inclined in the axial direction such that the diameters of the gap members 3*d*, 3*e* decrease toward the inside are pressed onto the peripheral surface of the photoconductor 2. Normally, the maximum of deflection Dr of the charging roller 3*a* is positioned at the middle point in the axial direction between the gap members 3*d*, 3*e* (the middle point between the gap members 3*d*, 3*e*).

On the other hand, since the photoconductor 2 is pressed by the pair of gap members 3*d*, 3*e* similarly to the aforementioned conventional image forming apparatus, the photoconductor 2 is deflected to have deflection (bending deformation) Do in the same direction as that of the deflection Dr of the charging roller 3*a*. Normally, the maximum of deflection Do of the photoconductor 2 is positioned at the middle point in the axial direction (the middle point between the gap members 3*d*, 3*e*).

When the charging roller 3*a* is forcedly deflected in the same direction as that of the deflection of the photoconductor 2, the charge gap G between the charging roller 3*a* and the photoconductor 2 varies little in the axial direction and is substantially constant in the axial direction to be about 50 μm or less even with the deflection of the charging roller 3*a* and the deflection of the photoconductor 2. Therefore, the charge on the photoconductor 2 by the charging roller 3*a* becomes substantially uniform in the axial direction so as to provide stable charge over the long term. Especially, the deflection of the charging roller 3*a* and the deflection of the photoconductor 2 have respective maximums at the same position i.e. the middle point between the pair of gap members 3*d*, 3*e* and are thus substantially parallel to each other, thereby making the charge gap G to be further precisely uniform in the axial direction and thus providing further stable charge.

According to the image forming apparatus 1 of this embodiment, the gap members 3*d*, 3*e* fixed to the both end portions of the charging roller 3*a* are formed to have the small-diameter portions $3d_1$, $3e_1$ on the inside and the large-diameter portions $3d_2$, $3e_2$ on the outside and the portions $3c_1$, $3c_2$ of the resistive layer 3*c* of the charging roller 3*a* inside the gap members 3*d*, 3*e* are pressed toward the photoconductor 2 by the pressing members 8, 9, whereby the charging roller 3*a* and the photoconductor 2 are forcedly deflected in the same direction because of the gap members 3*d*, 3*e* having the inclined peripheral surfaces such that the diameter of the gap members 3*d*, 3*e* decrease toward the inside. Accordingly, the charge gap G between the charging roller 3*a* and the photoconductor 2 can be maintained to be a certain value (50 μm) or less and to be substantially constant in the axial direction. Therefore, the charge on the photoconductor 2 by the charging roller 3*a* can be made uniform in the axial direction, thereby providing stable charge over the long term. Especially, the deflection of the charging roller 3*a* and the deflection of the photoconductor 2 have respective maximums at the same position i.e. the middle point between the pair of gap members 3*d*, 3*e*, thereby making the charge gap G to be further precisely uniform in the axial direction and thus providing further stable charge relative to the photoconductor 2.

Since the portions $3c_1$, $3c_2$ of the charging roller 3*a* to which the pressing members 8, 9 press are non-charging areas of the charging roller 3*a*, the stable charge relative to the photoconductor 2 can be conducted without being affected even with a problem on the charge of the photoconductor 2, for example frictional electrification, due to the contact between the pressing members 8, 9 and the charging roller 3*a*.

Since the charge gap G can be constant in the axial direction even with the deflection of the charging roller 3*a* and the deflection of the photoconductor 2, the charging roller 3*a* can be designed to have reduced outer diameter and the photoconductor 2 can be designed to have reduced outer diameter and reduced thickness. Therefore, it can effectively meet the demands for size reduction and space saving of the image forming apparatus which are recently strongly desired as mentioned above.

Figure 3B:
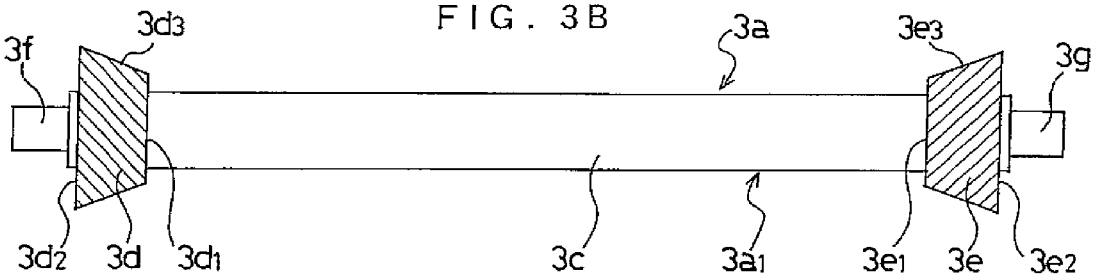
FIG. 3B is an illustration schematically showing a charging roller in a second embodiment of the invention.
Figure 4B:
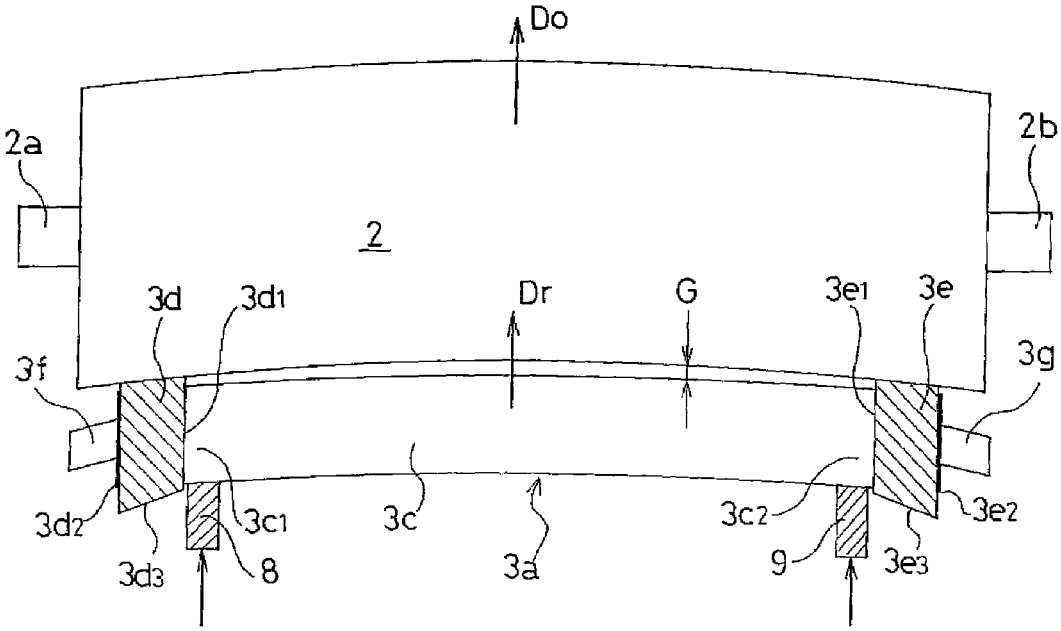
FIG. 4B is an illustration schematically showing a photoconductor and the charging roller of the embodiment shown in FIG. 3B.

FIG. 3B is an illustration schematically showing a charging roller in an image forming apparatus according to a second embodiment of the invention and FIG. 4B is an illustration schematically showing a photoconductor and the charging roller of the second embodiment. It should be noted that, in the following description, the same components as those of the aforementioned embodiment are marked with the same reference numerals so that the detail description of such components will be omitted.

In the charging roller 3*a* of the aforementioned embodiment shown in FIG. 3A, the diameter of the small-diameter portions $3d_1$, $3e_1$ of the gap members 3*d*, 3*e* which are formed in the truncated cone shape is set to be the same as the outer diameter of the charging roller 3*a*. In the charging roller 3*a* of the image forming apparatus 1 of this embodiment, however, as shown in FIG. 3B, the diameter of the small-diameter portions $3d_1$, $3e_1$ are set to be larger than the outer diameter of the charging roller 3*a*, while the gap members 3*d*, 3*e* are formed in the truncated cone shape similarly to the aforementioned embodiment. In this case, the inclination of the peripheral surfaces $3d_3$, $3e_3$ of the gap members 3*d*, 3*e* is set to be the same or substantially the same as the inclination of the peripheral surfaces $3d_3$, $3e_3$ of the gap members 3*d*, 3*e* of the embodiment shown in FIG. 3A. Accordingly, the diameter of the large-diameter portions $3d_2$, $3e_2$ of the gap members 3*d*, 3*e* is set to be larger than the large-diameter portions $3d_2$, $3e_2$ of the gap members 3*d*, 3*e* of the embodiment shown in FIG. 3A.

According to the image forming apparatus 1 of this embodiment the peripheral surfaces $3d_3$, $3e_3$ of the gap members 3*d*, 3*e* can be pressed against the peripheral surface of the photoconductor 2 over the entire axial length of the peripheral surfaces $3d_3$, $3e_3$ as shown in FIG. 4B and the charge gap G can be set by the small-diameter portions $3d_1$, $3e_1$ of the gap members 3*d*, 3*e*, thereby highly precisely setting the charge gap G. In this case, the charge gap G is set based on the thickness of ½ of the difference between the diameter of the small-diameter portions $3d_1$, $3e_1$ of the gap members 3*d*, 3*e* and the outer diameter of the charging roller 3*a*.

Other structure and other works and effects of the image forming apparatus 1 of this embodiment are the same as those of the aforementioned embodiment shown in FIG. 1, FIG. 3A, and FIG. 4A.

Figure 5A:
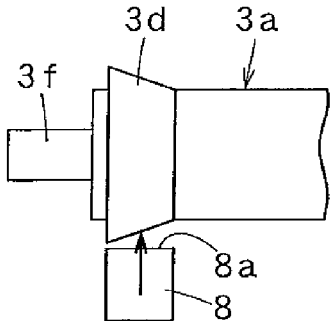
FIG. 5A is an illustration showing an example pressing method of a pressing member.
Figure 5B:
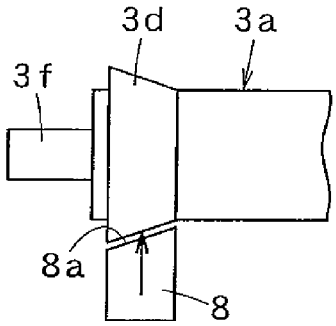
FIG. 5B is an illustration showing another example pressing method of a pressing member.
Figure 5C:
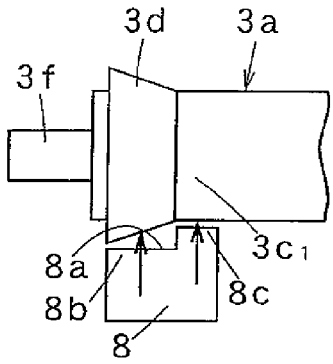
FIG. 5C is an illustration showing still another example pressing method of a pressing member.
Figure 5D:
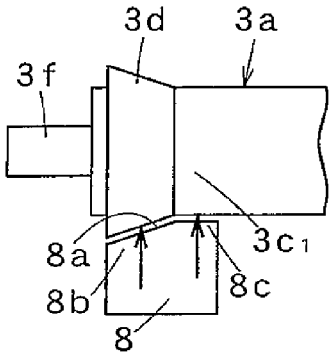
FIG. 5D is an illustration showing still another example pressing method of a pressing member.
Figure 5E:
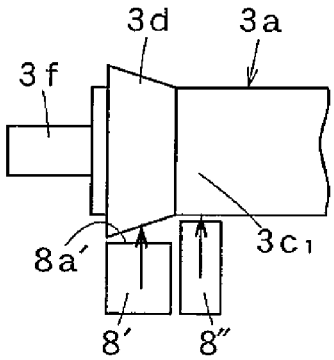
FIG. 5E is an illustration showing still another example pressing method of a pressing member.
Figure 5F:
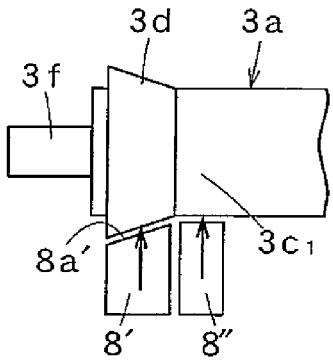
FIG. 5F is an illustration showing still another example pressing method of a pressing member.

Though the pressing members 8, 9 are adapted to press the portions $3c_1$, $3c_2$ inside the gap members 3*d*, 3*e* of the charging roller 3*a* in any one of the aforementioned embodiments shown in FIG. 4A and FIG. 4B, the method of pressing the charging roller 3*a* according to the invention may be any of various methods shown in FIGS. 5A-5F. A pressing method shown in FIG. 5A is a method in which the pressing member 8 is formed to have a pressing surface 8*a* which is flat and parallel to the axial direction of the charging roller 3*a* and the gap member 3*d* is pressed by the flat pressing surface 8*a*. The pressing method shown in FIG. 5B is a method in which the pressing member 8 is formed to have a pressing surface 8*a* which is an inclined flat surface parallel to the inclination of the peripheral surface $3d_3$ of the gap member 3*d* and the gap member 3*d* is pressed by the inclined pressing surface 8*a*. The pressing method shown in FIG. 5C is a method in which the pressing member 8 is formed to have a first pressing portion 8*b* which presses the gap member 3*d* and has a flat pressing surface 8*a* parallel to the axial direction of the charging roller 3*a* and a second pressing portion which presses the portion $3c_1$ of the charging roller 3*a* so that the pressing member 8 presses both the gap member 3*d* and the portion $3c_1$ of the charging roller 3*a*. The pressing method shown in FIG. 5D is a method in which the pressing member 8 is formed to have a first pressing portion 8*b* which presses the gap member 3*d* and has an inclined flat pressing surface 8*a* parallel to the inclination of the peripheral surface $3d_3$ of the gap member 3*d* and a second pressing portion which presses the portion $3c_1$ of the charging roller 3*a* so that the pressing member 8 presses both the gap member 3*d* and the portion $3c_1$, of the charging roller 3*a*. The pressing method shown in FIG. 5E is a method in which the pressing member is composed of a first pressing member 8' which presses the gap member 3*d* and has a flat pressing surface 8*a'* parallel to the axial direction of the charging roller 3*a* and a second pressing member 8" which presses the portion $3c_1$, of the charging roller 3*a*, and the first pressing member 8' and the second pressing member 8" are separate from each other so as to separately press the gap member 3*d* and the portion $3c_1$, of the charging roller 3*a*. The pressing method shown in FIG. 5F is a method in which the pressing member is composed of a first pressing member 8' which presses the gap member 3*d* and has a flat pressing surface 8*a'* parallel to the inclination of the peripheral surface $3d_3$ of the gap member 3*d* and a second pressing member 8" which presses the portion $3c_1$ of the charging roller 3*a*, and the first pressing member 8' and the second pressing member 8" are separate from each other so as to separately press the gap member 3*d* and the portion $3c_1$, of the charging roller 3*a*.

It should be noted that the same pressing method can be adapted as the method for pressing the gap member 3*e* and the portion $3c_2$ of the charging roller 3*a* on the other side.

Figure 3C:
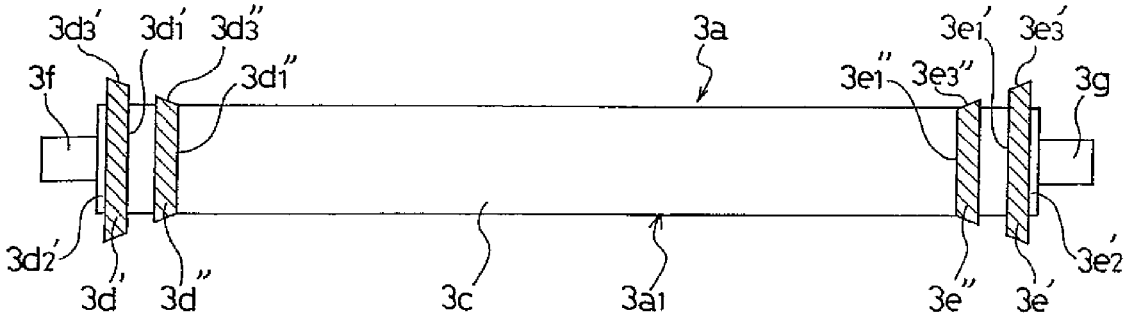
FIG. 3C is an illustration schematically showing a charging roller in a third embodiment of the invention.

FIG. 3C is an illustration schematically showing a charging roller in an image forming apparatus according to a third embodiment of the invention.

Though each of the gap members 3*d*, 3*e* formed in the truncated cone shape is a single piece in the charging roller 3*a* of the aforementioned embodiment shown in FIG. 3A, as shown in FIG. 3C, each of gap members 3*d*, 3*e* is a combination of two pieces, each of which is formed in a truncated cone shape, in the charging roller 3*a* of the image forming apparatus 1 of this embodiment.

That is, the gap members 3*d*, 3*e* are combinations of two piece, that is, first gap members 3*d'*, 3*e'* fixed to both end portions of the charging roller 3*a* and second gap members 3*d"*, 3*e"* fixed to portions inside the first gap members 3*d'*, 3*e'* of the charging roller 3*a* at a predetermined distance, respectively. The first and second gap members 3*d'*, 3*e'*; 3*d"*, 3*e"* are each formed in a truncated cone shape. Small-diameter portions $3d_1'$, $3e_1'$; $3d_1''$, $3e_1''$ of the first and second gap members 3*d'*, 3*e'*; 3*d"*, 3*e"* are positioned at the respective inner sides of the gap members.

The inclinations of the inclined peripheral surfaces $3d_3'$, $3e_3'$; $3d_3''$, $3e_3''$ of the first and second gap members 3*d'*, 3*e'*; 3*d"*, 3*e"* are set equal to each other. The first gap members 3*d'*, 3*e'* and the second gap members 3*d"*, 3*e"* are positioned such that inclinations of the peripheral surfaces $3d_3'$, $3e_3'$ of the first gap members 3*d'*, 3*e'* extend along the extensions of the inclinations of the peripheral surfaces $3d_3''$, $3e_3''$ of the second gap members 3*d"*, 3*e"*. Further, the diameter of the small-diameter portions $3d_1''$, $3e_1''$ of the second gap members 3*d"*, 3*e"* is set to be the same as the outer diameter of the charging roller 3*a*. That is, the each combination of the first and second gap members 3*d'*, 3*e'*; 3*d"*, 3*e"* is formed into a single truncated cone shape as a whole.

Figure 5G:
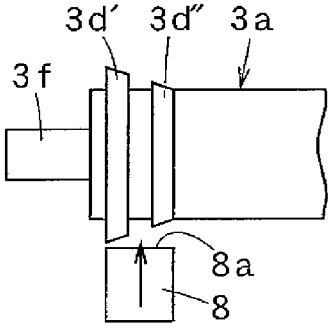
FIG. 5G is an illustration showing still another example pressing method of a pressing member.
Figure 5H:
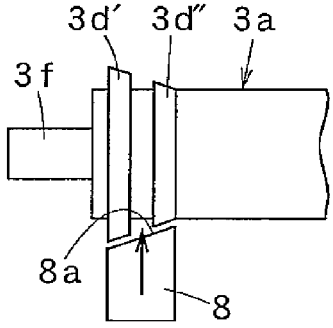
FIG. 5H is an illustration showing still another example pressing method of a pressing member.
Figure 5I:
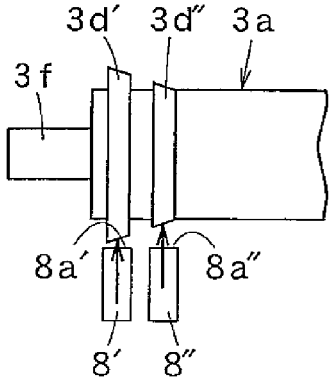
FIG. 5I is an illustration showing still another example pressing method of a pressing member.

Examples of method of pressing the separate-type gap members composed of the first and second gap members 3*d'*, 3*e'*; 3*d"*, 3*e"* include the methods of pressing the portions $3c_1$, $3c_2$ of the charging roller 3*a* in the same manner as shown in FIG. 4A and FIG. 4B. Alternatively, there are methods shown in FIG. 5G and FIG. 5H, similar to the aforementioned examples shown in FIGS. 5A and 5B, in which the pressing member 8 is formed to have a pressing surface 8*a* which is flat and parallel to the axial direction of the charging roller 3*a* and the first and second gap members 3*d'*, 3*d'* are both pressed by the flat pressing surface 8*a* and in which the pressing member 8 is formed to have a pressing surface 8*a* which is an inclined flat surface parallel to the inclination of the peripheral surface $3d_3$ of the gap member 3*d* and the first and second gap members 3*d'*, 3*d"* are both pressed by the inclined pressing surface 8*a*. Further, there is a method shown in FIG. 5I in which first and second pressing members 8', 8" having pressing surfaces 8*a'*, 8*a"* which are flat and parallel to the axial direction of the charging roller 3*a* are used to press the first and second gap members 3*d'*, 3*d"*, respectively. In the method of respectively pressing the first and second gap members 3*d'*, 3*d"* shown in FIG. 5I, the pressing surfaces 8*a'*, 8*a"* of the first and second pressing members 8', 8" may be formed to be inclined surfaces parallel to the inclination of the peripheral surfaces of the first and second gap members 3*d'*, 3*d"*. As an alternative method of pressing the separate-type gap member composed of the first and second gap members 3*d'*, 3*d"*, methods similar to the methods shown in FIG. 5C through FIG. 5F for pressing the aforementioned single-piece-type gap member may be employed, but not shown. It should be noted that the same pressing method can be adapted as the method for pressing the gap member 3*e* and the portion $3c_2$ of the charging roller 3*a* on the other side.

Other structure and other works and effects of the image forming apparatus 1 of this embodiment are the same as those of the aforementioned embodiment shown in FIG. 1, FIG. 3A, and FIG. 4A.

The diameter of the small-diameter portions $3d_1''$, $3e_1''$ of the second gap members 3*d"*, 3*e"* may be set to be larger than the outer diameter of the charging roller 3*a*, similarly to the embodiment shown in FIG. 3B.

Figure 3D:
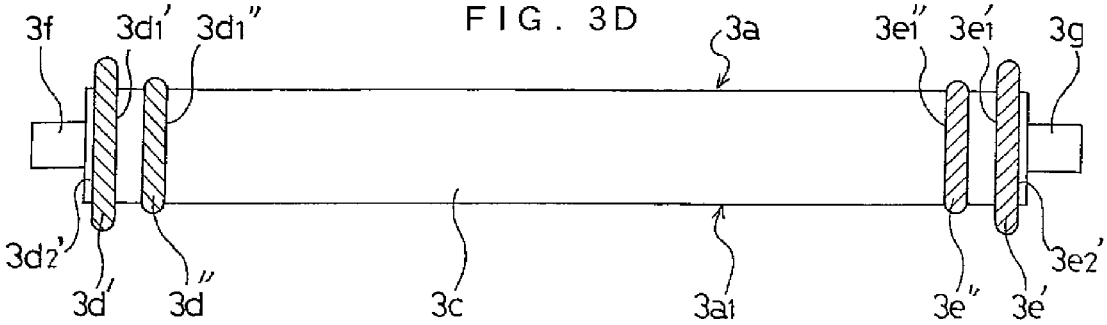
FIG. 3D is an illustration schematically showing a charging roller in a fourth embodiment of the invention.

FIG. 3D is an illustration schematically showing a charging roller in an image forming apparatus according to a fourth embodiment of the invention.

Though each of the first and second gap members 3*d'*, 3*e'*; 3*d"*, 3*e"* of the pair of two-piece-type gap members 3*d*, 3*e* is formed in a truncated cone shape in the charging roller 3*a* of the aforementioned embodiment shown in FIG. 3C, each of first and second gap members 3*d'*, 3*e'*; 3*d"*, 3*e"* of a pair of two-piece-type gap members 3*d*, 3*e* is formed in a circular cylindrical shape in the charging roller 3*a* of this embodiment shown in FIG. 3D.

The peripheral surfaces $3d_3'$, $3e_3'$; $3d_3''$, $3e_3''$ of the first and second gap members 3*d'*, 3*e'*; 3*d"*, 3*e"* are formed to be circular arc and the diameter of the first gap member 3*d'*, 3*e'* is set to be larger than the diameter of the second gap members 3*d"*, 3*e"*. Further, the inclination of a common tangent of both arcs of the peripheral surfaces $3d_3'$, $3d_3''$ of the first and second gap members 3*d'*, 3*d"* is set to be equal to or nearly equal to the inclination of the peripheral surface $3d_3$ of the gap member 3*d* of the aforementioned embodiment shown in FIG. 3A.

Other structure and other works and effects of the image forming apparatus 1 of this embodiment are the same as those of the aforementioned embodiment shown in FIG. 1 and FIG. 3C.

Though the gap member is composed of two pieces in any one of the embodiments shown in FIG. 3C and FIG. 3D, the invention is not limited thereto and the gap member may be composed of three pieces or more. In this case, the gap member composed of three pieces or more is designed such that the diameter of inner piece is smaller than the diameter of outer piece.

By the way, when the non-contact charge is conducted with the charge gap G which is set by the gap members 3*d*, 3*e*, the charging roller 3*a* may partially or entirely come in contact with the photoconductor 2 due to deflection or the like of the gap members 3*d*, 3*e*. Even in this case, there is no problem and the works and effects of the invention can be exhibited when the maximum of the charge gap G in the axial direction is less than the thickness of the gap members 3*d*, 3*e* (that is, 0≦ the maximum of the gap G≦ the maximum thickness of the gap members 3*d*, 3*e*). Therefore, in the invention, non-contact charge conducted with the charge gap G which is set by the gap members 3*d*, 3*e* contains such a case as mentioned above.

Hereinafter, tests which have been conducted for demonstrating the aforementioned works and effects of the image forming apparatus of the invention will be described with reference to examples belonging to the invention and comparative examples not belonging to the invention.

Conditions of photoconductors 2 and conditions of charging rollers 3*a* of image forming apparatuses of the examples and the comparative examples used in the tests, and results of the tests are shown in Table 1.

aluminum tubes of the photoconductors 2 used in the tests Nos. 9 and 10 is 1.0 mm, and the thickness of the aluminum tubes of the photoconductors 2 used in the tests Nos. 11 and 12 is 0.75 mm. Furthermore, the outer diameter of the photoconductors 2 used in the tests Nos. 13 through 20 is 24 mm. Among these, the thickness of the aluminum tubes of the photoconductors 2 used in the tests Nos. 13 and 14 is 1.5 mm, the thickness of the aluminum tubes of the photoconductors 2 used in the tests Nos. 15 and 16 is 1.0 mm, and the thickness of the aluminum tubes of the photoconductors 2 used in the tests Nos. 17 through 20 is 0.75 mm. Any of the photoconductors 2 was selected to have run-out accuracy of 0.01 or less.

The charging rollers 3*a* used in the tests No. 1 through No. 20 were charging rollers each of which used a metal shaft comprising a SUM22 with Ni plating on the surface thereof as a metal core and was processed to have such a configuration

TABLE 1

| | Photoconductor | | Charging roller | | | | | | |
|---|---|---|---|---|---|---|---|---|---|
| | Outer | Tube | Outer | Gap | | | | | |
| Test No. | diameter (ϕ mm) | thickness (mm) | diameter (ϕ mm) | Inside thickness (μm) | Outside thickness (μm) | Width (mm) | Pressing force (gf) | Results | Remarks |
| 1 | 40 | 1.5 | 12 | 12 | 20 | 3 | 500 | G | One-piece type |
| 2 | 40 | 1.5 | 8 | 15 | 25 | 4 | 200 | G | One-piece type |
| 3 | 40 | 1.5 | 10 | 10 | 25 | 4 | 800 | G | One-piece type |
| 4 | 40 | 1.0 | 10 | 20 | 25 | 5 | 800 | G | Separate type |
| 5 | 40 | 1.0 | 12 | 13 | 25 | 5 | 800 | G | Separate type |
| 6 | 40 | 1.0 | 8 | 0 | 20 | 5 | 500 | G | One-piece type |
| 7 | 30 | 1.5 | 12 | 15 | 40 | 5 | 200 | G | Separate type |
| 8 | 30 | 1.5 | 8 | 10 | 25 | 2 | 800 | G | One-piece type |
| 9 | 30 | 1.0 | 10 | 20 | 25 | 5 | 800 | G | Separate type |
| 10 | 30 | 1.0 | 10 | 20 | 20 | 3 | 800 | NG | Spring-press type gap tape |
| 11 | 30 | 0.75 | 12 | 30 | 30 | 5 | 800 | NG | Spring-press type gap tape |
| 12 | 30 | 0.75 | 8 | 20 | 25 | 2 | 800 | G | One-piece type |
| 13 | 24 | 1.5 | 12 | 14 | 40 | 1 | 500 | G | One-piece type |
| 14 | 24 | 1.5 | 12 | 15 | 25 | 5 | 200 | G | Separate type |
| 15 | 24 | 1.0 | 10 | 10 | 20 | 2 | 500 | G | One-piece type |
| 16 | 24 | 1.0 | 8 | 15 | 25 | 5 | 200 | G | Separate type |
| 17 | 24 | 0.75 | 10 | 10 | 20 | 3 | 500 | G | One-piece type |
| 18 | 24 | 0.75 | 8 | 2 | 25 | 5 | 200 | G | Separate type |
| 19 | 24 | 0.75 | 10 | 35 | 35 | 5 | 500 | NG | Spring-press type gap tape |
| 20 | 24 | 0.75 | 8 | 40 | 20 | 5 | 500 | NG | Spring-press type gap tape |

In table 1, photoconductors 2 used in the tests No. 1 through No. 20 are photoconductors each of which comprises an aluminum tube and a photoconductive layer which is formed on the peripheral surface of the aluminum tube to have a wall thickness of 25 μm by coating the same material as organic photoconductive material used for a photoconductive layer of a photoconductor of a printer LP-9000C manufactured by Seiko Epson Corporation. In this case, the outer diameter of the photoconductors 2 used in the tests Nos. 1 through 6 is 40 mm. Among these, the thickness of the aluminum tubes of the photoconductors 2 used in the tests Nos. 1 through 3 is 1.5 mm and the thickness of the aluminum tubes of the photoconductors 2 used in the tests Nos. 4 through 6 is 1.0 mm. Further, the outer diameter of the photoconductors 2 used in the tests Nos. 7 through 12 is 30 mm. Among these, the thickness of the aluminum tubes of the photoconductors 2 used in the tests Nos. 7 and 8 is 1.5 mm, the thickness of the to be installed to a remodeled machine of the aforementioned printer LP-9000C. The metal shafts were processed by centerless grinding to have run-out accuracy of 0.01 or less. As indicated in Table 1, the outer diameter of the metal shafts used in the tests Nos. 1, 5, 7, 11, 13, and 14 is 12 mm, the outer diameter of the metal shafts used in the tests Nos. 3, 4, 9, 10, 15, 17, and 19 is 10 nm, and the outer diameter of the metal shafts used in the tests Nos. 2, 6, 8, 12, 16, 18, and 20 is 8 mm.

Coating liquid was prepared by mixing electro-conductive tin oxide ($SnO_2$) and polyurethane (PU) resin at a weight ratio (wt ratio) of 1:9 and dispersing the mixture into ion conductive material and water. The coating liquid was coated by spraying so as to form a resistive layer of 20 μm in thickness. Examples of the electro-conductive $SnO_2$ are those indicated in Table 2 which are available from Jemco Inc. The details are described in Website (http://www.jemco-mmc.co.ip/corporate/index.html) of Jemco Inc.

TABLE 2

| Name | Property | Application |
|---|---|---|
| Tin-Antimony Oxides Sn-Sb Oxides Trade Name T-1 | 1) Aspect steel blue powder 2) Powder resistivity 1-3Ω•cm (100kg/cm$^2$ with pressure) 3) Particle form spherical 4) Primary particle diameter 0.02μm 5) Specific gravity 6.6 | Antistatic additive This can provide transparent conductive layer as membrane because the particle diameter is smaller than the optical wavelength. |
| Tin-Antimony Oxides Dispersed Sn-Sb Oxides Dispersed Trade Name TDL | 1) Aspect blue liquid (water base) 2) Solid content concentration 17 wt% 3) Solid content average particle diameter 100 nm 4) Specific gravity 1.17 | Antistatic additive This is water base dispersion of antimony-doped tin oxide This can provide transparent conductive layer. |
| Liquid Paint of Tin-antimony Oxides/dispersion Liquid Paint of Sn-Sb Oxides Paint Trade Name ES | 1) Aspect blue liquid 2) Surface resistivity of paint layer $10^{6-9}$ Ω/□ | 1) Antistatic ad ditive 2) Near-infrared cut material This can provide high-transparent conductive layer and near-infrared cut layer because the particle size of paint is smaller than optical wavelength. |
| Titanium oxide/Tin-Antimony Oxides $TiO_2$/Sn-Sb Oxides Trade Name W-1 | 1) Aspect grayish white powder 2) Powder resistivity 3-10Ω•cm (100kg/cm$^2$ with pressure) 3) Particle form spherical 4) Primary particle diameter 0.2μm 5) Specific gravity 4.6 | Antistatic additive This can be mixed with resin so as to provide electro-conductive material of white color or various colors. |

The electro-conductive $SnO_2$ used in the examples and the comparative examples is Trade name "T-1" of Jemco Inc. The "T-1" is tin-antimony oxides. Of course, in the invention, other electro-conductive $SnO_2$ may be employed. The ion conductive material is used for giving conductive property to the conductive paint. Employed as the ion conductive material in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0\text{-}5.0)\times10^{10}$ Ωcm.

Figure 6A:
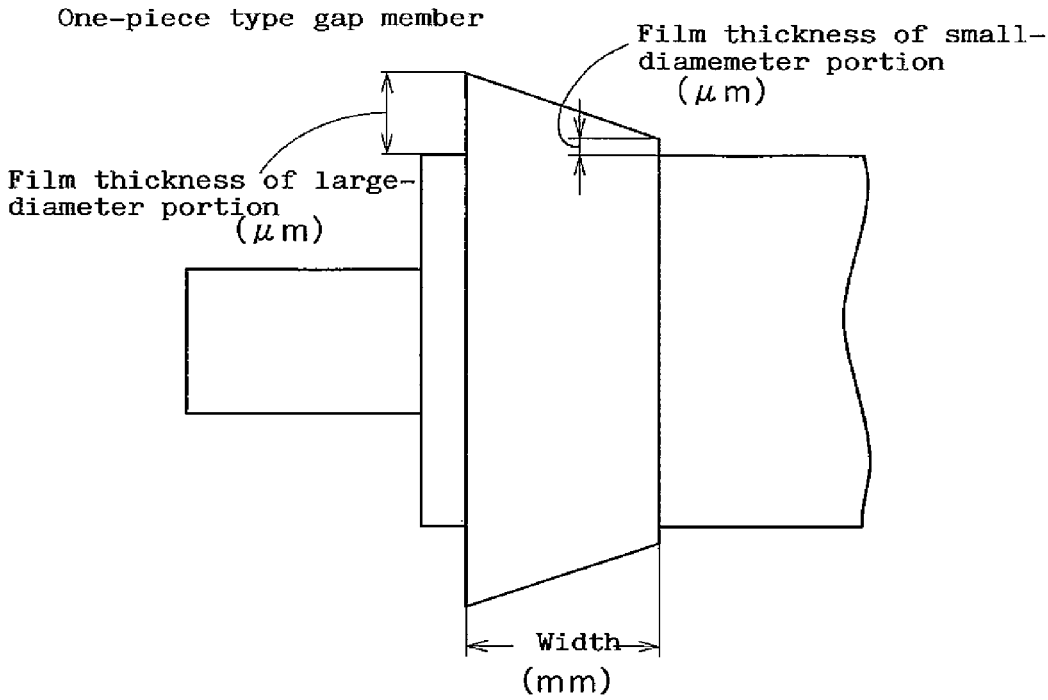
FIG. 6A is an illustration showing an integral gap member among gap members used in tests.

As for the gap members for providing gap condition, the gap members used in the tests Nos. 1 through 9 and Nos. 12 through 18 are formed into truncated cone shape. Among these, the gap members 3*d*, 3*e* used in the tests Nos. 1 through 3, 6, 8, 12, 13, 15, and 17 are of one-piece type (one-piece type gap members) as shown in FIG. 6A, similarly to the examples shown in FIG. 3A and FIG. 3B. In the gap members 3*d*, 3*e* used in the test No. 1, the film thickness (inside thickness shown in FIG. 6A) of the small-diameter portions $3d_1$, $3e_1$ is 12 μm and the film thickness (outside thickness shown in FIG. 6A) of the large-diameter portions $3d_2$, $3e_2$ is 20 μM. In the gap members 3*d*, 3*e* used in the test No. 2, the film thickness of the small-diameter portions $3d_1$, $3e_1$ is 15 μm and the film thickness of the large-diameter portions $3d_2$, $3e_2$ is 25 μm. In the gap members 3*d*, 3*e* used in the tests Nos. 3 and 8, the film thickness of the small-diameter portions $3d_1$, $3e_1$ is 10 μm and the film thickness of the large-diameter portions $3d_2$, $3e_2$ is 25 μm. In the gap members 3*d*, 3*e* used in the test No. 6, the film thickness of the small-diameter portions $3d_1$, $3e_1$ is 0 μm (that is, the diameter of the small-diameter portion $3d_1$, $3e_1$ is equal to the outer diameter of the charging roller 3*a*) and the film thickness of the large-diameter portions $3d_2$, $3e_2$ is 20 μm. In the gap members 3*d*, 3*e* used in the test No. 12, the film thickness of the small-diameter portions $3d_1$, $3e_1$ is 20 μm and the film thickness of the large-diameter portions $3d_2$, $3e_2$ is 25 μm. In the gap members 3*d*, 3*e* used in the test No. 13, the film thickness of the small-diameter portions $3d_1$, $3e_1$ is 14 μm and the film thickness of the large-diameter portions $3d_2$, $3e_2$ is 40 μm. In the gap members 3*d*, 3*e* used in the tests Nos. 15 and 17, the film thickness of the small-diameter portions $3d_1$, $3e_1$ is 10 μm and the film thickness of the large-diameter portions $3d_2$, $3e_2$ is 20 μm.

The width (width shown in FIG. 6A) of the gap members 3*d*, 3*e* used in the tests Nos. 1 and 17 is 3 mm, the width of the gap members 3*d*, 3*e* used in the tests Nos. 2, 3, and 17 is 4 mm, and the width of the gap members 3*d*, 3*e* used in the test No. 6 is 5 mm, the width of the gap members 3*d*, 3*e* used in the tests Nos. 8, 12, and 15 is 2 mm, and the width of the gap members 3*d*, 3*e* used in the test No. 13 is 1 mm.

Figure 6B:
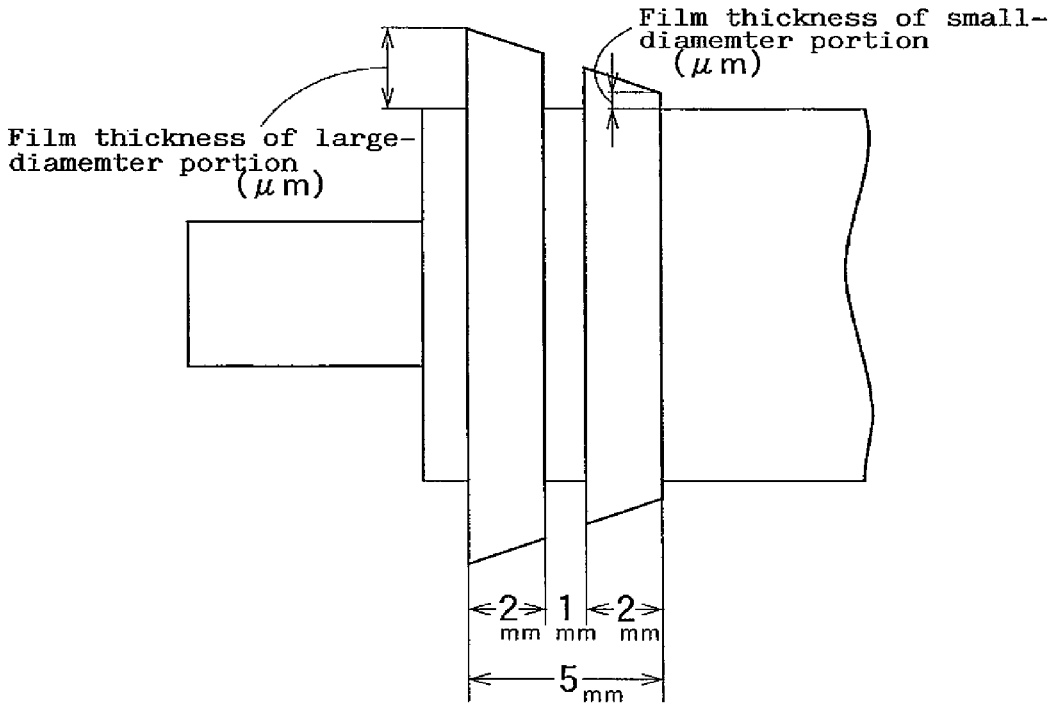
FIG. 6B is an illustration showing a separate gap member among the gap members used in tests.

The gap members 3*d*', 3*e*'; 3*d*", 3*e*" used in the tests Nos. 4, 5, 7, 9, 14, 16, and 18 are of two-piece type (separate type gap members) as shown in FIG. 6B, similarly to the example shown in FIG. 3C. In the gap members 3*d*', 3*e*'; 3*d*", 3*e*" used in the tests Nos. 4 and 9, the film thickness (inside thickness shown in FIG. 6B) of the small-diameter portions $3d_1$", $3e_1$" of the inside gap members 3*d*", 3*e*" is 20 μm and the film thickness (outside thickness shown in FIG. 6B) of the large-diameter portions $3d_2$', $3e_2$' of the outside gap members 3*d*', 3*e*' is 25 μm. In the gap members 3*d*', 3*e*'; 3*d*", 3*e*" used in the test No. 5, the film thickness of the small-diameter portions $3d_1$", $3e_1$" of the inside gap members 3*d*", 3*e*" is 13 μm and the film thickness of the large-diameter portions $3d_2$', $3e_2$' of the outside gap members 3*d*', 3*e*' is 25 μm. In the gap members 3*d*', 3*e*'; 3*d*", 3*e*" used in the test No. 7, the film thickness of the small-diameter portions $3d_1$", $3e_1$" of the inside gap members 3*d*", 3*e*" is 15 μm and the film thickness of the large-diameter portions $3d_2$', $3e_2$' of the outside gap members 3*d*', 3*e*' is 40 μm. In the gap members 3*d*', 3*e*'; 3*d*", 3*e*" used in the tests Nos. 14 and 16, the film thickness of the small-diameter portions $3d_1$", $3e_1$" of the inside gap members 3*d*", 3*e*" is 15 μm and the film thickness of the large-diameter portions $3d_2$', $3e_2$' of the outside gap members 3*d*', 3*e*' is 25 μm. In the gap members 3*d*', 3*e*'; 3*d*", 3*e*" used in the test No. 18, the film thickness of the small-diameter portions $3d_1$", $3e_1$" of the inside gap members 3*d*", 3*e*" is 2 μm and the film thickness of the large-diameter portions $3d_2$', $3e_2$' of the outside gap members $3d_1$", 3*e*' is 25 μm.

The width (the entire width shown in FIG. 6B) of the gap members 3*d*', 3*e*'; 3*d*", 3*e*" used in the tests Nos. 4, 5, 7, 9, 14, 16, and 18 is 5 mm. In this case, the widths of the first and second gap members 3*d*', 3*e*'; 3*d*", 3*e*" are all 2 mm, respectively, and the distance between the first and second gap members 3*d*', 3*e*'; 3*d*", 3*e*" is 1 mm.

The gap members 3*d*, 3*e* used in the tests Nos. 10, 11, 19, and 20 were formed by sticking a tape made of polyimide (PI) resin having a film thickness of 20 μm and a width of 5 mm onto the peripheral surfaces of both end portions of the charging roller 3*a*.

The pressing method used in the tests Nos. 1 through 9 and Nos. 12 through 18 is a method in which pressing members 8, 9, each having pressing surface (8*a*) which is parallel to the axial direction of the charging roller 3*a* as shown in FIG. 5A and has a roller shape, is used to press the gap members 3*d*, 3*e* toward the photoconductor 2.

The pressing members 8, 9 are products having an Asker C hardness of 65° and are each formed by making a cylindrical urethane rubber having an outer diameter of 10 mm and an inner diameter of 5 mm and inserting a shaft having an outer diameter of 6 mm made of SUS into the bore of the cylindrical urethane rubber.

Figure 35:
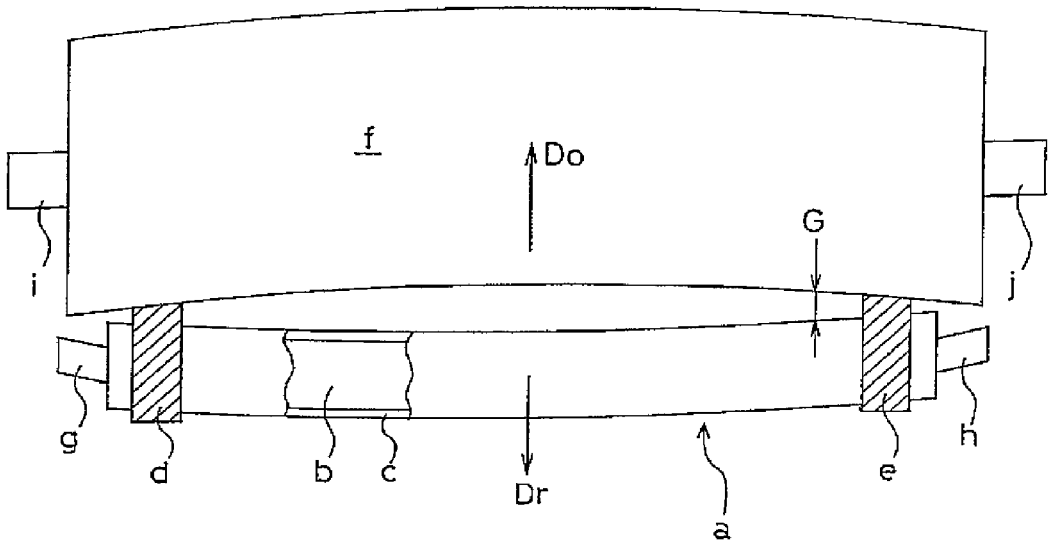
FIG. 35 is an illustration schematically showing the behavior of the charging roller and the photoconductor used in the conventional image forming apparatus.

The pressing method used in the tests Nos. 10, 11, 19, and 20 is a method in which the charging roller 3*a* was pressed by applying load of springs onto bearings (at 10 mm distance from the gap members "d", "e") of the rotary shafts "g", "h" outside of the gap members "d", "e" as shown in FIG. 35.

As indicated in Table 1, in the tests Nos. 1, 6, 13, 15, 17, 19, and 20, the total pressing force was 500 gf. In the tests Nos. 2, 7, 14, 16, and 18, the total pressing force was 200 gf. In the tests Nos. 3 through 5, Nos. 8 through 12, the total pressing force was 800 gf. The pressing force by the pressing members 8, 9 was calculated and adjusted each time. As apparent from the above, the tests Nos. 1 through 9 and Nos. 12 through 18 are the examples of the invention, while the tests Nos. 10, 11, 19, and 20 are the comparative examples of the invention.

As for image forming apparatus as the apparatus for the tests, the aforementioned printer LP-9000C which was partially remodeled for conducting the tests was employed. The printer LP-9000C uses a photoconductor having an outer diameter of 40 mm. For conducting tests using a photoconductor having an outer diameter of not 40 mm, an image forming apparatus of which structure was the same as that of the printer LP-9000C but the scale was different from that of the printer LP-9000C was manufactured and the tests of image formation were conducted with the same engine as that of the printer LP-9000C.

For conducting image forming tests, the circumferential velocity of the photoconductor 2 was set to about 210 mm/sec for every test. For every test, the applied voltage $V_C$ (V) of the charging roller 3*a* was set to:

$$V_C = V_{DC} + V_{AC} - 650 + (1/2)V_{pp} \cdot \sin 2\pi ft$$

(wherein $V_{PP}$=1750V, f=1.3 kHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 50 sheets of A3 size plain paper each on which half tone monochrome toner image of 5% concentration was formed.

The tenth, twentieth, thirtieth, fortieth, and fiftieth sheets of paper were picked up and observed with human eyes. Only when none of the sheets had image spot, it was determined as good charge. In this case, "G" (Good) is indicated on Table 1. When any one of the sheets had image spot, it was determined as no-good charge. In this case, "NG" (No Good) is indicated on Table 1. The marks "G" and "NG" are also used in results of other tests, indicating "Good" and "No Good", respectively.

With any of the image forming apparatuses of the examples in the tests Nos. 1 through 9 and Nos. 12 through 18, the result was good charge, i.e. "G". In any of the comparative examples in the tests Nos. 10 through 12, 19, and 20, the result was no-good charge, i.e. "NG".

The aforementioned tests demonstrated that, in non-contact charge on the photoconductor 2 by the charging roller 3*a*, the aforementioned works and effects of the invention can be obtained by pressing the portions $3c_1$, $3c_2$ of the resistive layer 3*c* in the charging roller 3*a*, which are inside of the gap members 3*d*, 3*e*; 3*d*', 3*e*'; 3*d*", 3*e*", toward the photoconductor 2.

Though the pressing members 8, 9 press the portions $3c_1$, $3C_2$ of the resistive layer 3*c* of the charging roller 3*a*, which are inside of the gap members 3*d*, 3*e*; 3*d*', 3*e*'; 3*d*", 3*e*", toward the photoconductor 2 in any of the aforementioned examples, the pressing members 8, 9 may also press the gap members 3*d*, 3*e*; 3*d*', 3*e*'; 3*d*", 3*e*" toward the photoconductor 2. In this case, since the gap members 3*d*, 3*e*; 3*d*', 3*e*'; 3*d*", 3*e*" are pressed toward the photoconductor 2, the contact between the gap members 3*d*, 3*e*; 3*d*', 3*e*'; 3*d*", 3*e*" and the photoconductor 2 can be further ensured, thereby further stably forming the charge gap G.

In this case, when the pressing member for pressing the portion $3c_1$, $3c_2$ of the resistive layer 3*c* and the pressing member for pressing the gap member 3*d*, 3*e*; 3*d*', 3*e*'; 3*d*", 3*e*" are formed as separate members, the pressing force for pressing the gap member 3*d*, 3*e*; 3*d*', 3*e*'; 3*d*", 3*e*" and the pressing force for pressing the portion $3c_1$, $3c_2$ of the resistive layer 3*c* can be controlled separately. Accordingly, the deflection of the portion $3a_1$ of the charging roller 3*a* inside the pair of the gap members 3*d*, 3*e*; 3*d*', 3*e*$_1$; 3*d*", 3*e*" can be controlled to further exactly follow the deflection Go of the photoconductor 2. Therefore, the charge gap G can be made constant in the axial direction with higher precision. Further, by setting the pressing force for pressing the portions $3c_1$, $3c_2$ of the resistive layer 3*c* inside the gap members 3*d*, 3*e*; 3*d*', 3*e*'; 3*d*", 3*e*" to be larger than the pressing force for pressing the gap members 3*d*, 3*e*; 3*d*', 3*e*'; 3*d*", 3*e*", the portion $3a_1$ of the charging roller 3*a* inside the pair of the gap members 3*d*, 3*e*; 3*d*', 3*e*'; 3*d*", 3*e*" can be efficiently deflected to follow the deflection of the photoconductor 2. Therefore, the charge gap G can be further effectively made constant in the axial direction.

Figure 7:
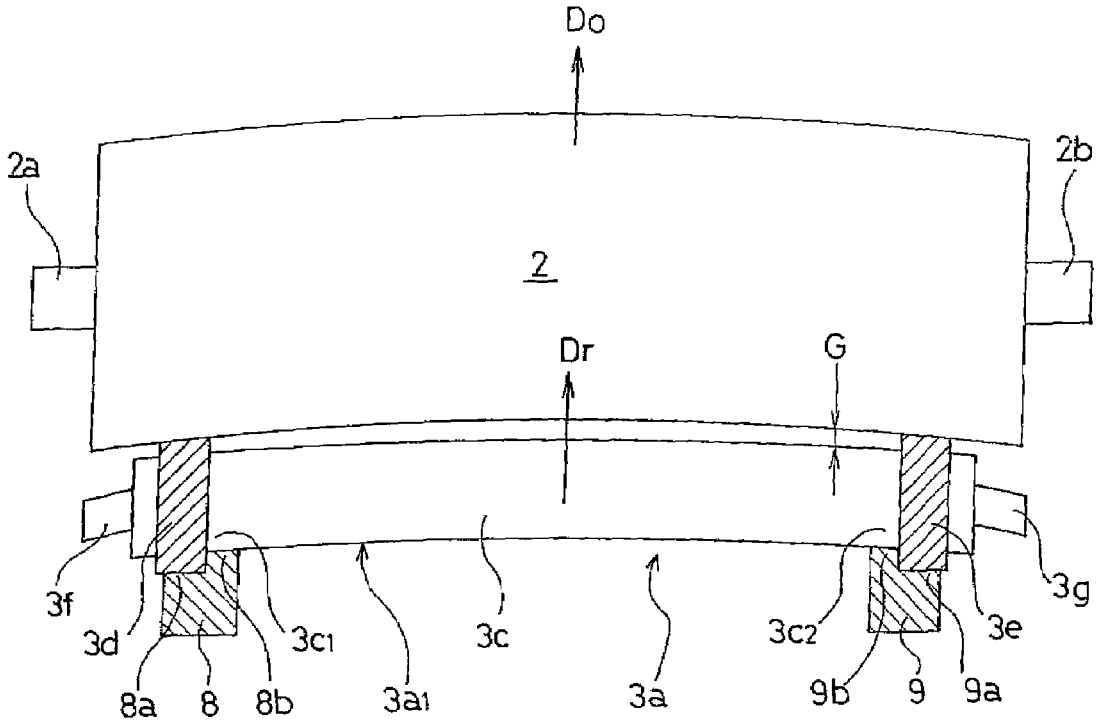
FIG. 7 is an illustration schematically showing a photoconductor and a charging roller in an image forming apparatus of a fifth embodiment according to the invention.

FIG. 7 is an illustration schematically showing a photoconductor and a charging roller in an image forming apparatus of a fifth embodiment according to the invention.

As shown in FIG. 7, a charging roller 3*a* of the fifth embodiment A comprises a metal core 3*b* and a resistive layer 3*c* which is formed on the peripheral surface of the metal core 3*b* by spraying conductive coating material. On the resistive layer 3*c*, gap members 3*d*, 3*e* composed of electrical insulating tape-like film members are fixed to and wound into ring-like shape around the peripheral surfaces of both end portions of the resistive layer 3*c*. The charging roller 3*a* comprises rotary shafts 3*f*, 3*g* coaxially projecting from the both ends of the metal core 3*b* in the axial direction. The rotary shafts 3*f*, 3*g* are rotatably supported on the apparatus body by bearings.

The gap members 3*d*, 3*e* sets a predetermined charge gap G between the resistive layer 3*c* and the photoconductor 2 when pressed against the peripheral surface of the photoconductor 2. The charge gap G is set based on the predetermined thickness of the film members. In this case, the gap members 3*d*, 3*e* and portions $3c_1$, $3c_2$ of the resistive layer 3*c* of the charging roller 3*a* which are adjacent to inner side of the gap members 3*d*, 3*e* are pressed toward the photoconductor 2 by a pair of pressing members 8, 9 with predetermined force, whereby the gap members 3*d*, 3*e* are brought in contact with the peripheral surface of the photoconductor 2 with some pressure.

The pressing members 8, 9 are composed of first pressing portions 8*a*, 9*a* for pressing the gap members 3*d*, 3*e* toward the photoconductor 2 and second pressing portions 8*b*, 9*b* for pressing the portions $3c_1$, $3c_2$ of the resistive layer 3*c* inside the gap members 3*d*, 3*e*, respectively.

In the image forming apparatus 1 of the fifth embodiment having the aforementioned structure, the pair of gap members 3*d*, 3*e* and the portions $3c_1$, $3c_2$ of the resistive layer 3*c* of the charging roller 3*a* positioned inside the gap members 3*d*, 3*e*, of which the rotary shafts 3*f*, 3*g* are rotatably supported on the apparatus body, are pressed toward the photoconductor 2 by the pressing members 8, 9, respectively, so as to bring the gap members 3*d*, 3*e* into contact with the peripheral surface of the photoconductor 2 with some pressure. Accordingly, as shown in FIG. 7, the portion $3a_1$ of the charging roller 3*a* between the gap members 3*d*, 3*e* is forcedly deflected to have deflection (bending deformation) Dr in a direction toward the photoconductor 2. Normally, the maximum of deflection Dr of the charging roller 3*a* is positioned at the middle point in the axial direction between the gap members 3*d*, 3*e* (the middle point between the gap members 3*d*, 3*e*).

On the other hand, the photoconductor 2 is deflected to have deflection (bending deformation) Do of which the maximum is normally positioned at the middle point in the axial direction (the middle point between the gap members 3*d*, 3*e*), similarly to the first embodiment as mentioned above.

When the charging roller 3*a* and the photoconductor 2 are deflected in the same direction, the charge gap G between the charging roller 3*a* and the photoconductor 2 varies little in the axial direction and is substantially constant in the axial direction to be about 50 μm or less even with the deflection of the charging roller 3*a* and the deflection of the photoconductor 2. Therefore, similarly to the first embodiment, the charge on the photoconductor 2 by the charging roller 3*a* becomes substantially uniform in the axial direction so as to provide stable charge over the long term.

According to the image forming apparatus 1 of the fifth embodiment, the pair of gap members 3*d*, 3*e* and the portions $3c_1$, $3c_2$ of the resistive layer 3*c* of the charging roller 3*a* positioned inside the gap members 3*d*, 3*e* are pressed toward the photoconductor 2, whereby the charging roller 3*a* and the photoconductor 2 can be both deflected in the same direction. Accordingly, the charge gap G between the charging roller 3*a* and the photoconductor 2 can be formed to be a certain value (50 μm) or less and to be substantially constant in the axial direction. Therefore, the charge on the photoconductor 2 by the charging roller 3*a* can be made uniform in the axial direction, thereby providing stable charge over the long term. Especially, the deflection of the charging roller 3*a* and the deflection of the photoconductor 2 have respective maximums at the same position i.e. the middle point between the pair of gap members 3*d*, 3*e*, thereby making the charge gap G to be further precisely uniform in the axial direction and thus providing further stable charge relative to the photoconductor 2.

Since the portions $3c_1$, $3c_2$ of the charging roller 3*a* to be pressed by the second pressing portions 8*b*, 9*b* of the pressing members 8, 9 are non-charging areas of the resistive layer 3*c*, the stable charge relative to the photoconductor 2 can be conducted without being affected even with a problem on the charge of the photoconductor 2, for example frictional electrification, due to the contact between the pressing members 8, 9 and the charging roller 3*a*.

Since the gap members 3*d*, 3*e* are pressed toward the photoconductor 2 by the pressing members 8, 9, the contact of the gap members 3*d*, 3*e* with the photoconductor 2 can be further ensured, thereby further stably forming the charge gap G. As compared to the conventional manner in which the rotary shafts of the charging roller "a" outside of the gap members are pressed, this arrangement in which the gap members 3*d*, 3*e* are pressed by the pressing members 8, 9 makes the charging roller 3*a* hard to deflect in a direction apart from the photoconductor 2. Therefore, the charge gap G can be further securely formed to be a certain value (50 μm) or less, thereby providing further stable charge over the long term.

Other structure and other works and effects of the charging roller 3*a* and the image forming apparatus 1 of the fifth embodiment are the same as those of the first embodiment.

Figure 8:
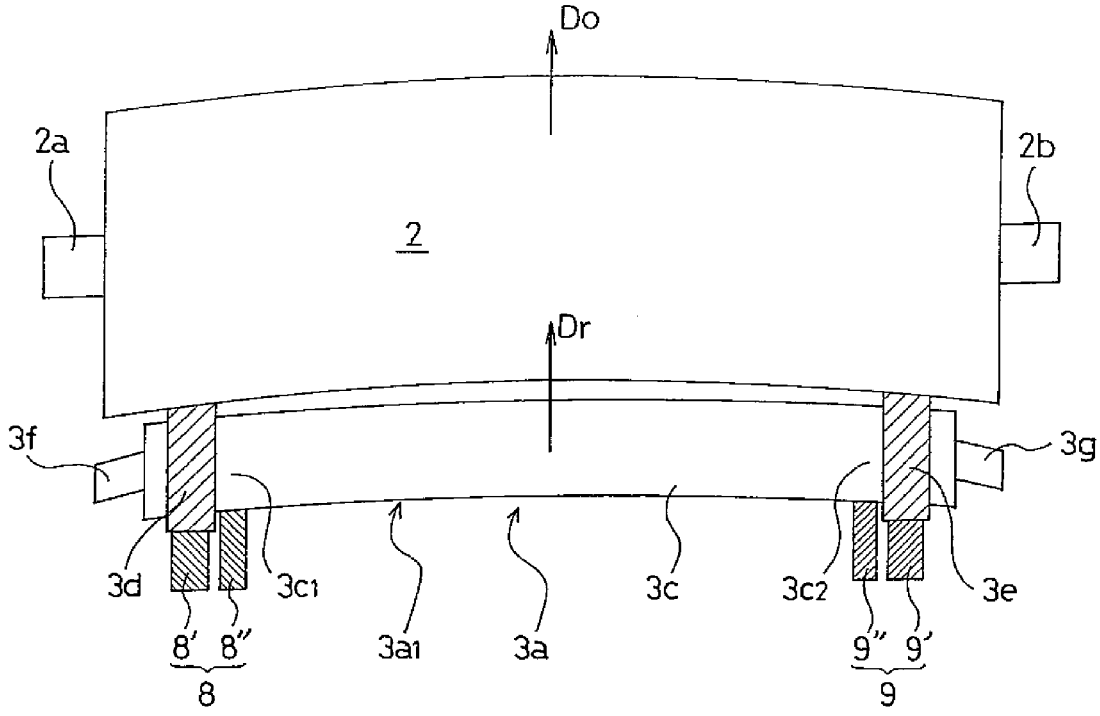
FIG. 8 is an illustration schematically showing a photoconductor and a charging roller in an image forming apparatus of a sixth embodiment according to the invention.

FIG. 8 is an illustration schematically showing a photoconductor and a charging roller in an image forming apparatus of a sixth embodiment according to the invention.

Though the pressing members 8, 9 are each of one-piece type in which the first pressing portion 8*a*, 9*a* for pressing the gap member 3*d*, 3*e* and the second pressing portion 8*b*, 9*b* for pressing the portion $3c_1$, $3c_2$ of the resistive layer 3*c* are integrally formed in the aforementioned image forming apparatus 1 of the fifth embodiment shown in FIG. 7, a pair of pressing members 8, 9 for pressing the end portions of the charging roller 3*a* are each of two-piece type in the image forming apparatus of the sixth embodiment as shown in FIG. 8.

That is, one pressing member 8 is composed of two pieces, that is, a first pressing member 8' for pressing the gap member 3*d* and a second pressing member 8", which is a separate member from the first pressing member 8, for pressing the portion $3c_1$, of the resistive layer 3*c* of the charging roller 3*a*'. Similarly, the other pressing member 9 is composed of two pieces, that is, a first pressing member 9' for pressing the gap member 3*e* and a second pressing member 9", which is a separate member from the first pressing member 9', for pressing the portion $3c_2$ of the resistive layer 3*c* of the charging roller 3*a*.

The pressing force of the second pressing member 8", 9" pressing the portion $3c_1$, $3c_2$ of the resistive layer 3*c* of the charging roller 3*a* is set to be larger than the pressing force of the first pressing member 8', 9' pressing the gap member 3*d*, 3*e*.

According to the image forming apparatus 1 of the sixth embodiment, the pressing force for pressing the gap member 3*d*, 3*e* and the pressing force for pressing the portion $3c_1$, $3c_2$ of the resistive layer 3*c* can be controlled separately. Accordingly, the deflection of the portion $3a_1$ of the charging roller 3*a* inside the pair of the gap members 3*d*, 3*e* can be controlled to further exactly follow the deflection Go of the photoconductor 2. Therefore, the charge gap G can be made constant in the axial direction with higher precision.

Further, by setting the pressing force of the second pressing members 8", 9" for pressing the non-charging areas inside the gap members 3*d*, 3*e* of the charging roller 3*a* to be larger than the pressing force of the first pressing members 8', 9' for pressing the gap members 3*d*, 3*e*, the portion $3a_1$ of the charging roller 3*a* inside the pair of the gap members 3*d*, 3*e* can be efficiently deflected to follow the deflection of the photoconductor 2. Therefore, the charge gap G can be further effectively made constant in the axial direction.

Other structure and other works and effects of the image forming apparatus 1 of the sixth embodiment are the same as those of the fifth embodiment shown in FIG. 7.

Figure 9:
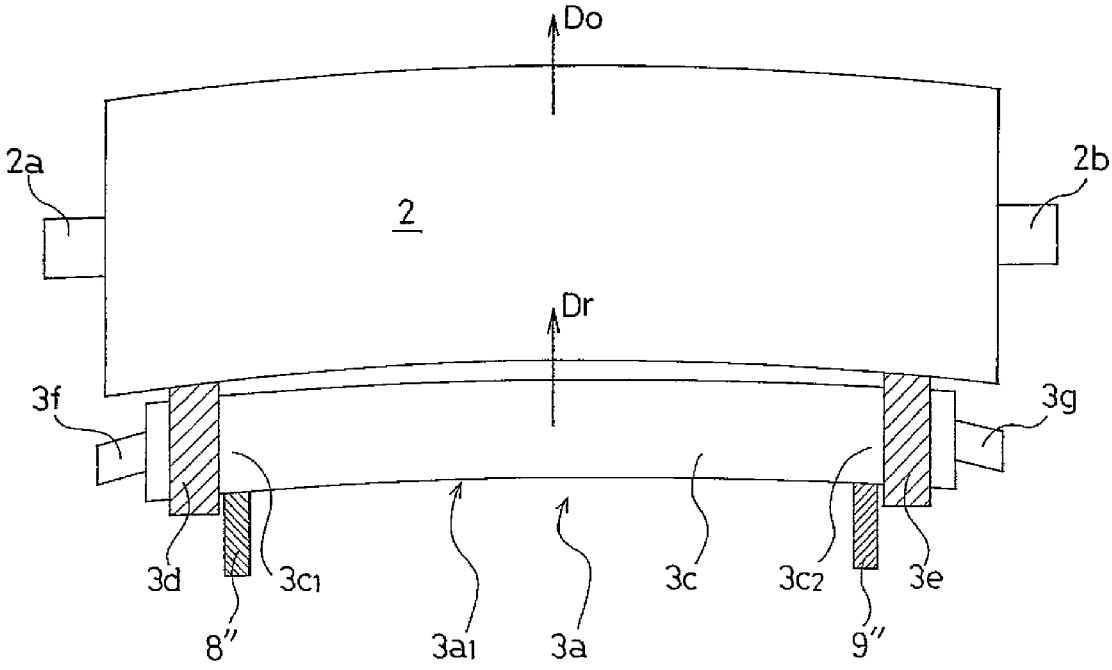
FIG. 9 is an illustration schematically showing a photoconductor and a charging roller in an image forming apparatus of a seventh embodiment according to the invention.

FIG. 9 is an illustration schematically showing a photoconductor and a charging roller in an image forming apparatus of a seventh embodiment according to the invention.

Though the pair of pressing members 8, 9 for pressing the end portions of the charging roller 3*a* are composed of the first pressing members 8', 9' for pressing the gap members 3*d*, 3*e* and the second pressing members 8", 9" for pressing the portions $3c_1$, $3c_2$ of the resistive layer 2*c*, respectively in the aforementioned image forming apparatus 1 of the sixth embodiment shown in FIG. 8, a pair of pressing members 8, 9 for pressing the end portions of the charging roller 3*a* are composed of only second pressing members 8", 9" for pressing the portions $3c_1$, $3c_2$ of the resistive layer 3*c* of the charging roller 3*a*, respectively in the image forming apparatus 1 of the seventh embodiment as shown in FIG. 9. That is, in the image forming apparatus 1 of this embodiment, the gap members 3*d*, 3*e* are not pressed by the pressing members 8, 9.

According to the image forming apparatus 1 of the seventh embodiment, only the portions $3c_1$, $3c_2$ of the resistive layer 3*c* are pressed by the pair of second pressing members 8", 9", thereby making the structure of the pressing members simple. In this case, since the gap members 3*d*, 3*e* are not pressed, the works and effects of the aforementioned embodiments with regard to pressing of the gap members 3*d*, 3*e* are not obtained.

Other structure and other works and effects of the image forming apparatus 1 of this embodiment are the same as those of the fifth embodiment shown in FIG. 7.

Hereinafter, tests which have been conducted for demonstrating the aforementioned works and effects of the image forming apparatus of the invention will be described with reference to examples belonging to the invention and comparative examples not belonging to the invention.

Conditions of photoconductors 2 and conditions of charging rollers 3*a* of image forming apparatuses of the examples and the comparative examples used in the tests, and results of the tests are shown in Table 3.

TABLE 3

| | Photoconductor | | Charging roller | | | |
|---|---|---|---|---|---|---|
| Test No. | Outer diameter (ϕ mm) | Tube thickness (mm) | Outer diameter (ϕ mm) | Pressing method | Result | Remarks |
| 21 | 40 | 1.5 | 12 | Gap members and portions inside thereof are pressed by rubber members<br>Total pressing force 500 gf | G | One-piece type |
| 22 | 40 | 1.5 | 8 | Gap members and portions inside thereof are pressed by rubber members<br>Total pressing force 200 gf | G | One-piece type |
| 23 | 40 | 1.5 | 10 | Gap members and portions inside thereof are pressed by rubber members<br>Total pressing force 800 gf | G | One-piece type |
| 24 | 40 | 1.0 | 10 | Only portions inside gap members are pressed<br>Total pressing force 800 gf | G | |
| 25 | 40 | 1.0 | 12 | Gap members and portions inside thereof are pressed by rubber members<br>Total pressing force 800 gf | G | Two-piece type<br>Pressing force ratio 2:1 |
| 26 | 40 | 1.0 | 8 | Gap members and portions inside thereof are pressed by rubber members<br>Total pressing force 200 gf | G | Two-piece type<br>Pressing force ratio 2:1 |
| 27 | 30 | 1.5 | 12 | Gap members and portions inside thereof are pressed by rubber members<br>Total pressing force 800 gf | G | One-piece type |
| 28 | 30 | 1.5 | 8 | Gap members and portions inside thereof are pressed by rubber members<br>Total pressing force 200 gf | G | One-piece type |
| 29 | 30 | 1.0 | 10 | Gap members and portions inside thereof are pressed by rubber members<br>Total pressing force 200 gf | G | Two-piece type<br>Pressing force ratio 2:1 |
| 30 | 30 | 1.0 | 8 | Bearings are pressed by springs<br>Total pressing force 800 gf | NG | |
| 31 | 30 | 0.75 | 12 | Bearings are pressed by springs<br>Total pressing force 500 gf | NG | |
| 32 | 30 | 0.75 | 8 | Bearings are pressed by springs<br>Total pressing force 200 gf | NG | |
| 33 | 24 | 1.5 | 12 | Gap members and portions inside thereof are pressed by rubber members<br>Total pressing force 800 gf | G | Two-piece type<br>Pressing force ratio 2:1 |
| 34 | 24 | 1.5 | 12 | Gap members and portions inside thereof are pressed by rubber members<br>Total pressing force 200 gf | G | Two-piece type<br>Pressing force ratio 2:1 |
| 35 | 24 | 1.0 | 10 | Gap members and portions inside thereof are pressed by rubber members<br>Total pressing force 800 gf | G | One-piece type |
| 36 | 24 | 1.0 | 8 | Gap members and portions inside thereof are pressed by rubber members<br>Total pressing force 200 gf | G | One-piece type |
| 37 | 24 | 0.75 | 10 | Gap members and portions inside thereof are pressed by rubber members<br>Total pressing force 800 gf | G | One-piece type |
| 38 | 24 | 0.75 | 8 | Gap members and portions inside thereof are pressed by rubber members<br>Total pressing force 200 gf | G | One-piece type |
| 39 | 24 | 0.75 | 10 | Bearings are pressed by springs<br>Total pressing force 500 gf | NG | |
| 40 | 24 | 0.75 | 8 | Bearings are pressed by springs<br>Total pressing force 200 gf | NG | |

In table 3, photoconductors 2 used in the tests No. 21 through No. 40 are the same photoconductors as those used in the tests No. 1 through No. 20, respectively. That is, the outer diameter of the photoconductors 2 used in the tests Nos. 21 through 26 is 40 mm. Among these, the thickness of the aluminum tubes of the photoconductors 2 used in the tests Nos. 21 through 23 is 1.5 mm and the thickness of the aluminum tubes of the photoconductors 2 used in the tests Nos. 24 through 26 is 1.0 mm. Further, the outer diameter of the photoconductors 2 used in the tests Nos. 27 through 32 is 30 mm. Among these, the thickness of the aluminum tubes of the photoconductors 2 used in the tests Nos. 27 and 28 is 1.5 mm, the thickness of the aluminum tubes of the photoconductors 2 used in the tests Nos. 29 and 30 is 1.0 mm, and the thickness of the aluminum tubes of the photoconductors 2 used in the tests Nos. 31 and 32 is 0.75 mm. Furthermore, the outer diameter of the photoconductors 2 used in the tests Nos. 33 through 40 is 24 mm. Among these, the thickness of the aluminum tubes of the photoconductors 2 used in the tests Nos. 33 and 34 is 1.5 mm, the thickness of the aluminum tubes of the photoconductors 2 used in the tests Nos. 35 and 36 is 1.0 mm, and the thickness of the aluminum tubes of the photoconductors 2 used in the tests Nos. 37 through 40 is 0.75 mm. Any of the photoconductors 2 was selected to have run-out accuracy of 0.01 or less.

The charging rollers 3*a* used in the tests No. 21 through No. 40 were charging rollers, similar to the aforementioned tests Nos. 1 through 20, each of which used a metal shaft comprising a SUM22 with Ni plating on the surface thereof as a metal core and was processed to have such a configuration to be installed to a remodeled machine of the aforementioned printer LP-9000C. The metal shafts were processed by centerless grinding to have run-out accuracy of 0.01 or less. As indicated in Table 3, the outer diameter of the metal shafts used in the tests Nos. 21, 25, 27, 31, 33, and 34 is 12 mm, the outer diameter of the metal shafts used in the tests Nos. 23, 24, 29, 35, 37, and 39 is 10 nm, and the outer diameter of the metal shafts used in the tests Nos. 22, 26, 28, 30, 32, 36, 38, and 40 is 8 mm.

Similarly to the aforementioned tests Nos. 1 through 20, coating liquid was prepared by mixing electro-conductive tin oxide ($SnO_2$) and polyurethane (PU) resin at a weight ratio (wt ratio) of 1:9 and dispersing the mixture into ion conductive material and water. The coating liquid was coated by spraying so as to form a resistive layer of 20 μm in thickness.

Similarly to the tests Nos. 1 through 20, the electro-conductive $SnO_2$ used in the examples and the comparative examples is Trade name "T-1" of Jemco Inc indicated in Table 2. The ion conductive material used in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

The gap members 3*d*, 3*e* were formed by sticking a tape made of polyimide (PI) resin having a film thickness of 20 μm and a width of 5 mm onto the peripheral surfaces of both end portions of the charging roller 3*a*.

The pressing members 8, 9; 8', 9'; 8", 9" are products having an Asker C hardness of 65° and are each formed by making a cylindrical urethane rubber having an outer diameter of 10 mm and an inner diameter of 5 mm and inserting a shaft having an outer diameter of 6 mm made of SUS into the bore of the cylindrical urethane rubber.

As indicated in Table 3, in the tests Nos. 21 through 23, 27, 28, through 38, the pressing members 8, 9 comprising the first and second pressing portions 8*a*, 8*b*; 9*a*, 9*b* which are integrally formed, respectively as shown in FIG. 7 are used to press the gap members 3*d*, 3*e* and the portions $3c_1$, $3c_2$ of the resistive layer 3*c*. The total pressing force was 500 gf in the test No. 21, 200 gf in the tests Nos. 22, 28, 36, and 38, and 800 gf in the tests Nos. 23, 27, 35, and 37. The pressing force was calculated and adjusted each time (the same adjustment is conducted for the other examples).

In the tests Nos. 25, 26, 29, 33, and 34, the pressing members 8, 9 comprise the first and second pressing members 8', 9'; 8", 9" which are separate from each other as shown in FIG. 8. The gap members 3*d*, 3*e* are pressed by the first pressing members 8', 9' and the portions $3c_1$, $3c_2$ of the resistive layer 3*c* are pressed by the second pressing members 8", 9". The total pressing force was 200 gf in the test Nos. 26, 29, and 34, and 800 gf in the tests Nos. 25 and 33. The total pressing force is actual pressing force for actually pressing the photoconductor 2. The pressing force ratio between the first pressing member 8', 9' and the second pressing member 8", 9" is 1:2 in any of the tests. The pressing force of the second pressing members 8", 9" for pressing the portions $3c_1$, $3c_2$ of the resistive layer 3*c* is set to be larger than the pressing force of the first pressing members 8', 9' for pressing the gap members 3*d*, 3*e*.

In the test No. 24, the pressing members 8, 9 were composed of only the second pressing members 8", 9", respectively as shown in FIG. 9 and only the portions $3c_1$, $3c_2$ of the resistive layer 3*c* were pressed by the second pressing members 8", 9". The total pressing force was 800 gf.

In the tests No. 30 through 32, 39, and 40, the charging roller 3*a* was pressed by applying load of springs onto bearings (at 10 mm distance from the gap members "d", "e") of the rotary shafts "g", "h" outside of the gap members "d", "e" as shown in FIG. 35. The total pressing force was 800 gf in the test No. 30, 500 gf in the tests Nos. 31 and 39, and 200 gf in the tests Nos. 32 and 40. In these tests, the pressing force is spring load.

As apparent from the above, the tests Nos. 21 through 29 and Nos. 33 through 38 are the examples of the invention, while the tests Nos. 30 through 32, 39, and 40 are the comparative examples of the invention.

As for image forming apparatus as the apparatus for the tests, the aforementioned printer LP-9000C which was partially remodeled for conducting the tests was employed. The printer LP-9000C uses a photoconductor having an outer diameter of 40 mm. For conducting tests using a photoconductor having an outer diameter of not 40 mm, an image forming apparatus of which structure was the same as that of the printer LP-9000C but the scale was different from that of the printer LP-9000C was manufactured and the tests of image formation were conducted with the same engine as that of the printer LP-9000C.

For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=1750V, f=1.3 kHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 50 sheets of A3 size plain paper each on which half tone monochrome toner image of 5% concentration was formed.

The tenth, twentieth, thirtieth, fortieth, and fiftieth sheets of paper were picked up and observed with human eyes. Only when none of the sheets had image spot, it was determined as good charge. In this case, "G" is indicated on Table 3, When any one of the sheets had image spot, it was determined as no-good charge. In this case, "NG" is indicated on Table 3.

With any of the image forming apparatuses of the examples in the tests Nos. 21 through 29 and Nos. 33 through 38, the result was good charge, i.e. "G". In any of the comparative examples in the tests Nos. 30 through 32, 39, and 40, the result was no-good charge, i.e. "NG".

The aforementioned tests demonstrated that, in non-contact charge on the photoconductor 2 by the charging roller 3*a*, the aforementioned works and effects of the invention can be obtained by pressing the portions $3c_1$, $3c_2$ of the resistive layer 3*c* in the charging roller 3*a*, which are inside of the gap members 3*d*, 3*e*, toward the photoconductor 2.

Figure 10:
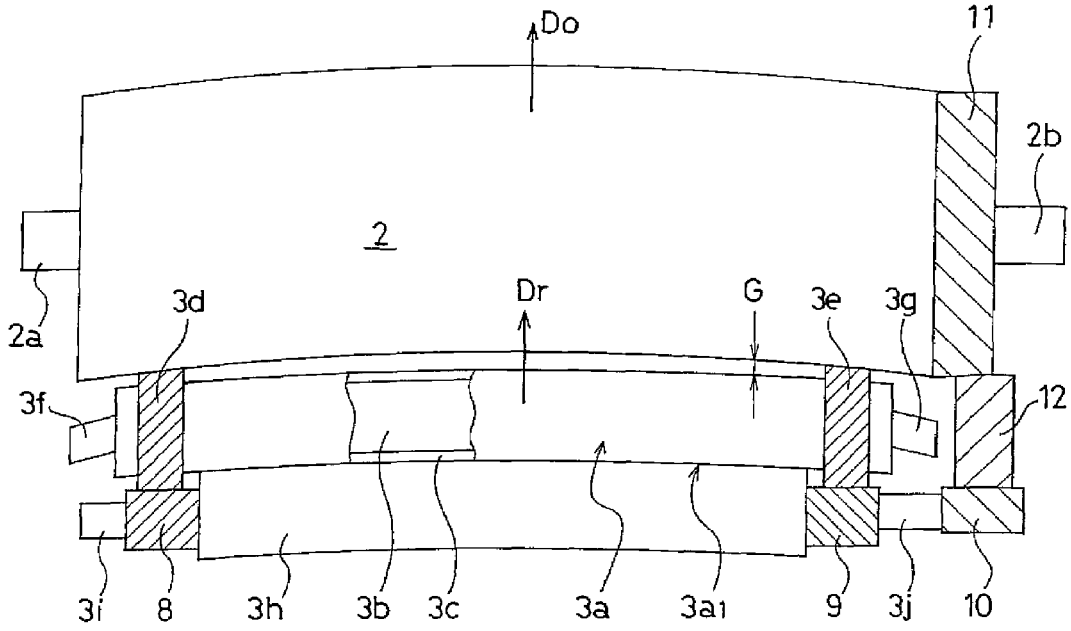
FIG. 10 is an illustration schematically showing a photoconductor and a charging roller in an image forming apparatus of an eighth embodiment according to the invention.

FIG. 10 is an illustration schematically showing a photoconductor and a charging roller in an image forming apparatus of an eighth embodiment according to the invention.

As shown in FIG. 10, a charging device 3 of the eighth embodiment has a cleaning member 3*h* composed of, for example, a roller for cleaning a charging roller 3*a* of non-contact charge type. The charging roller 3*a* uniformly charges the photoconductor 2 in non-contact manner, while the cleaning member 3*h* cleans the charging roller 3*a* to remove toner particles and dusts adhering to the charging roller 3*a*.

On the both ends of the cleaning member 3*h*, a pair of pressing members 8, 9 for pressing gap members 3*d*, 3*e* of the charging roller 3*a* are coaxially and integrally formed with the cleaning member 3*h*. The pressing members 8, 9 are each composed of elastic members such as rubber which is formed in a cylindrical shape of which outer diameter is constant in the axial direction. The pressing members 8, 9 are fixed to rotary shafts 3*i*, 3*j* of the cleaning member 3*h*.

The cleaning member 3*h* for cleaning the charging roller 3*a* is composed of a cylindrical sponge of which diameter is constant (straight) in the axial direction. The cleaning member 3*h* is pressed against the portion $3a_1$ of the charging roller 3*a* between the gap members 3*d*, 3*e* with a predetermined force.

The pressing members 8, 9 press the gap members 3*d*, 3*e* toward the photoconductor 2, whereby the gap members 3*d*, 3*e* are brought in contact with the peripheral surface of the photoconductor 2 with some pressure and the cleaning member 3*h* presses the charging portion $3a_1$ of the charging roller 3*a* toward the photoconductor 2.

Fixed to the rotary shafts 3*i*, 3*j* of the cleaning member 3*h* is a driving gear 10 for rotating the cleaning member 3*h* and the pressing members 8, 9. Fixed to one end (the right end, in the illustrated example) of the photoconductor 2 is a driving gear 11 for rotating the photoconductor 2. The driving gears 10, 11 are connected to each other via an intermediate gear 12. Driving force of a motor (not shown: corresponding to the power source of the invention) is transmitted to the driving gear 11 of the photoconductor 2 so as to rotate the photoconductor 2 and is further transmitted to the driving gear 10 of the cleaning member 3*h* via the intermediate gear 12 so as to rotate the cleaning member 3*h* and the pressing members 8, 9.

In the image forming apparatus 1 of the eighth embodiment having the aforementioned structure, the gap members 3*d*, 3*e* are pressed toward the photoconductor 2 by the pressing members 8, 9, respectively, so as to bring the gap members 3*d*, 3*e* in contact with the peripheral surface of the photoconductor 2 with some pressure and, in addition, the portion $3a_1$ of the charging roller 3*a* is pressed toward the photoconductor 2 by the cleaning member 3*h* so that the charging portion $3a_1$ of the charging roller 3*a* between the gap members 3*d*, 3*e* are deflected to have deflection (bending deformation) Dr in a direction toward the photoconductor 2 as shown in FIG. 10. Normally, the maximum of deflection Dr of the charging roller 3*a* is positioned at the middle point in the axial direction between the gap members 3*d*, 3*e* (the middle point between the gap members 3*d*, 3*e*).

Similarly to the aforementioned image forming apparatuses of the conventional example and the embodiments, the photoconductor 2 is deflected to have deflection (bending deformation) Do in the same direction as the deflection Dr of the charging roller 3*a*. The charge gap G between the charging roller 3*a* and the photoconductor 2 varies little in the axial direction and is substantially constant in the axial direction to be about 50 μm or less even with the deflection of the charging roller 3*a* and the deflection of the photoconductor 2.

The photoconductor 2 is rotated by the driving force of the motor so that the cleaning member 3*h* and the pressing members 8, 9 are rotated via the intermediate gear 12. As the photoconductor 2 and the pressing members 8, 9 are rotated, the charging roller 3*a* is rotated by friction between the gap members 3*d*, 3*e* and the photoconductor 2 and friction between the gap members 3*d*, 3*e* and the pressing members 8, 9. In this case, with the pressing force of the gap members 3*d*, 3*e* by the pressing members 8, 9, the friction between the gap members 3*d*, 3*e* and the photoconductor 2 and the friction between the gap members 3*d*, 3*e* and the pressing members 8, 9 are increased, thereby securely transferring the torque of the photoconductor 2 and the pressing members 8, 9 to the charging roller 3*a*. Therefore, the charging roller 3*a* is stably and securely rotated.

According to the image forming apparatus 1 of the eighth embodiment, the portion $3a_1$ of the charging roller 3*a* between the gap members 3*d*, 3*e* is pressed toward the photoconductor 2 by the cleaning member 3*h* so that the charging roller 3*a* and the photoconductor 2 can be forcedly deflected in the same direction. Accordingly, the charge gap G between the charging roller 3*a* and the photoconductor 2 can be formed to be a certain value (50 μm) or less and to be substantially constant in the axial direction. Therefore, the charge on the photoconductor 2 by the charging roller 3*a* can be made uniform in the axial direction, thereby providing stable charge over the long term. Especially, the deflection of the charging roller 3*a* and the deflection of the photoconductor 2 have respective maximums at the same position i.e. the middle point between the pair of gap members 3*d*, 3*e*, thereby making the charge gap G to be further precisely uniform in the axial direction and thus providing further stable charge relative to the photoconductor 2.

Since the gap members 3*d*, 3*e* are pressed toward the photoconductor 2 by the pressing members 8, 9, the contact of the gap members 3*d*, 3*e* with the photoconductor 2 can be further ensured, thereby further stably forming the charge gap G. As compared to the conventional manner in which the rotary shafts of the charging roller 3*a* outside of the gap members 3*d*, 3*e* are pressed, this arrangement in which the gap members 3*d*, 3*e* are pressed by the pressing members 8, 9 makes the charging roller 3*a* hard to deflect in a direction apart from the photoconductor 2. Therefore, the charge gap G which is further uniform in the axial direction can be formed.

Since the charge gap G can be formed to be constant in the axial direction even with the deflection of the charging roller 3*a* and the deflection of the photoconductor 2, the charging roller 3*a* can be designed to have reduced outer diameter and the photoconductor 2 can be designed to have reduced outer diameter and reduced thickness. Therefore, it can effectively meet the demands for size reduction and space saving of the image forming apparatus which are recently strongly desired as mentioned above.

Since the charging roller 3*a* is rotated by torque of the photoconductor 2 and the pressing members 8, 9 via the gap members 3*d*, 3*e*, that is, the charging roller 3*a* is not driven directly via gear train, the charging roller 3*a* can be prevented from being subjected to vibration due to the driving of the gear and can be prevented from being affected by pushing force from the gear arranged on one side of the charging roller 3*a*, thereby providing stable charge over the long term.

Since the charging roller 3*a* can be stably and securely rotated even though the charging roller 3*a* is not directly driven, vibration due to the contact between the charging roller 3*a* and the photoconductor 2 can be dampened, thereby effectively preventing the charge gap G from varying. In this case, since the charging roller 3*a* is composed of a non-elastic member, enough nip pressure can be obtained at the contact between the charging roller 3*a* and the photoconductor 2, thereby effectively dampening the vibration.

Since the pressure members 8, 9 and the cleaning member 3*h* are integrally formed, overall size reduction is achieved, thereby further effectively achieving space saving. Further, the charging roller 3*a* is pressed toward the photoconductor 2 by the cleaning member 3*h* so as to adjust the charge gap G and is also cleaned by the cleaning member 3*h*, thereby further ensuring stable charge over the long term.

Since the pressing members 8, 9 are composed of elastic members such as rubber, vibration caused on the charging roller 3*a* can be effectively dampened and the torque of the pressing member 8, 9 can be securely transmitted to the charging roller 3*a* via the gap members 3*d*, 3*e*. Therefore, the charging roller 3*a* can be further stably driven to rotate.

Other structure and other works and effects of the image forming apparatus 1 and the charging roller 3*a* of the eighth embodiment are the same as those of the first embodiment.

Figure 11:
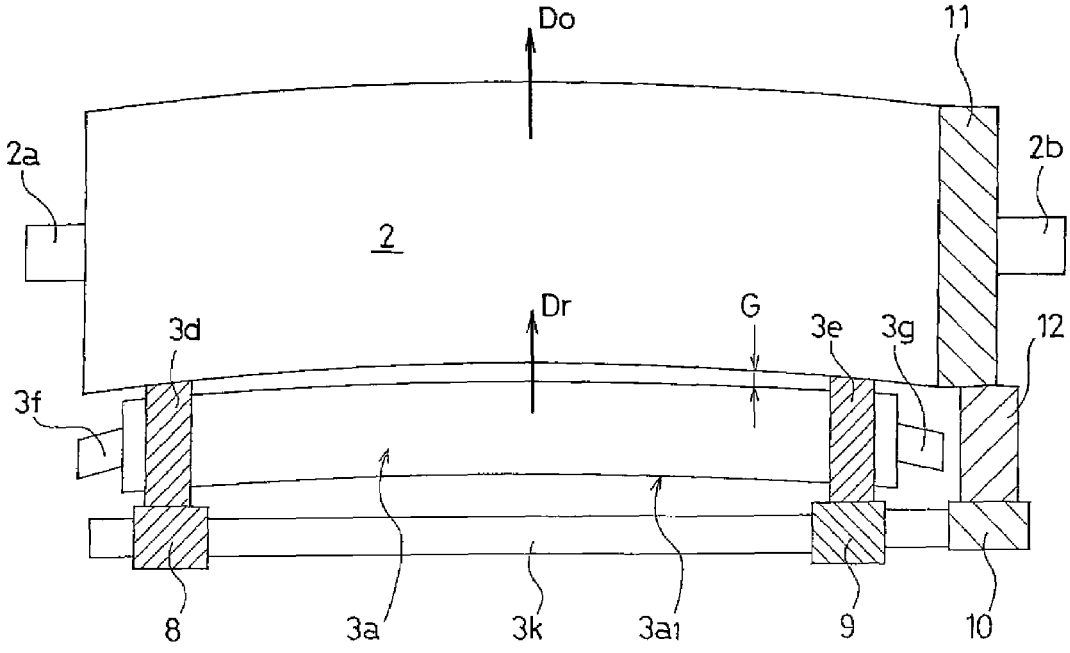
FIG. 11 is an illustration schematically showing a photoconductor and a charging roller in an image forming apparatus of a ninth embodiment according to the invention.

FIG. 11 is an illustration schematically showing a photoconductor and a charging roller in an image forming apparatus of a ninth embodiment according to the invention.

Though the cleaning member 3*h* for the charging roller 3*a* is provided so that the charging portion $3a_1$ of the charging roller 3*a* between the gap members 3*d*, 3*e* is pressed toward the photoconductor 2 by the cleaning member 3*h* in the image forming apparatus 1 of the eighth embodiment as shown in FIG. 10, no cleaning member 3*h* is provided so that the charging roller 3*a* is not pressed by the cleaning member 3*h* in the image forming apparatus 1 of the ninth embodiment as shown in FIG. 11. That is, in the image forming apparatus 1 of the ninth embodiment, pressing members 8, 9 are fixed to a rotary shaft 3*k* without the cleaning member 3*h* so that only the gap members 3*d*, 3*e* are pressed by the pressing member 8, 9. Fixed on one end of the rotary shaft 3*k* is a driving gear 10.

In the image forming apparatus 1 of the ninth embodiment, the works and effects based on pressing of the charging roller 3*a* by the cleaning member 3*h* are not obtained.

Other structure and other works and effects of the image forming apparatus 1 of the ninth embodiment are the same as those of the aforementioned eighth embodiment.

Figure 12:
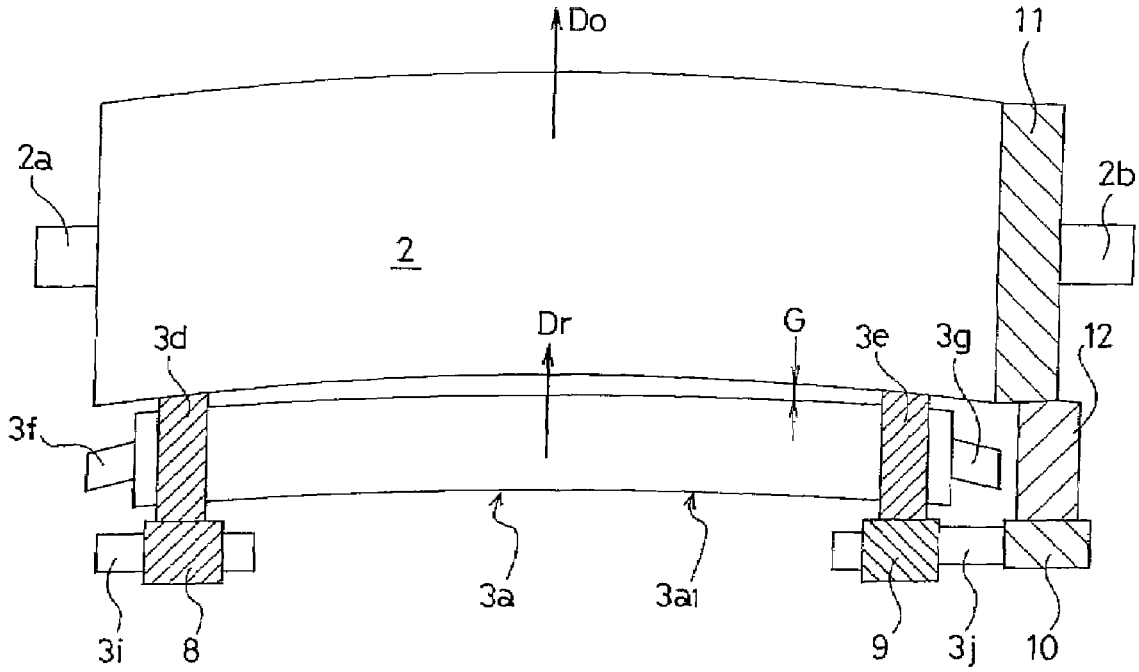
FIG. 12 is an illustration schematically showing a photoconductor and a charging roller in an image forming apparatus of a tenth embodiment according to the invention.

FIG. 12 is an illustration schematically showing a photoconductor and a charging roller in an image forming apparatus of a tenth embodiment according to the invention.

Though the pressing members 8, 9 are both fixed to the rotary shaft 3*k* in the aforementioned image forming apparatus 1 of the ninth embodiment shown in FIG. 11, fixed to a rotary shaft 3*j* is only one pressing member 9 in the image forming apparatus 1 of the tenth embodiment as shown in FIG. 12. In this case, the other pressing member 8 is adapted to idle and to press the gap member 3*d* toward the photoconductor 2 similarly to the aforementioned embodiments.

Other structure and other works and effects of the image forming apparatus 1 of the tenth embodiment are the same as those of the aforementioned ninth embodiment shown in FIG. 11.

Figure 13:
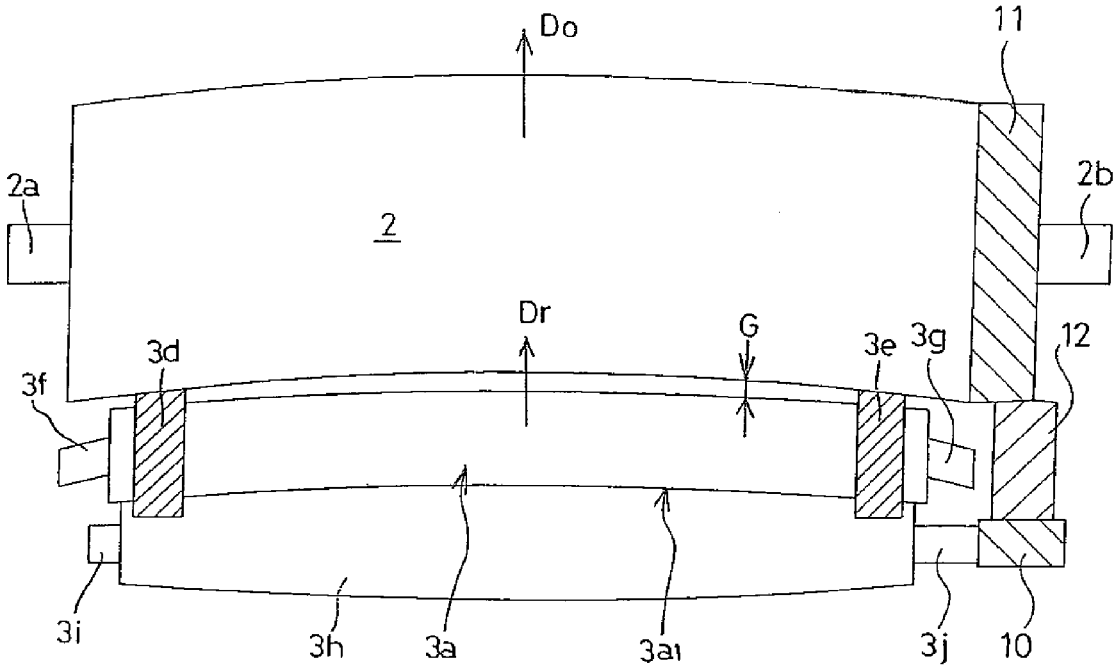
FIG. 13 is an illustration schematically showing a photoconductor and a charging roller in an image forming apparatus of an eleventh embodiment according to the invention.

FIG. 13 is an illustration schematically showing a photoconductor and a charging roller in an image forming apparatus of an eleventh embodiment according to the invention.

Though the cleaning member 3*h* and the pressing members 8, 9 are formed separately from different materials and the cleaning member 3*h* is formed into a straight cylindrical shape having a constant diameter in the aforementioned image forming apparatus 1 of the eighth embodiment shown in FIG. 10, pressing members are integrated into a cleaning member 3*h* and the cleaning member 3*h* is formed into a barrel shape having the maximum diameter at the middle thereof in the image forming apparatus 1 of the eleventh embodiment as shown in FIG. 13. In this case, the cleaning member 3*h* is made of sponge similarly to the cleaning member 3*h* of the eighth embodiment shown in FIG. 10.

Other structure and other works and effects of the image forming apparatus 1 of the eleventh embodiment are the same as those of the aforementioned eighth embodiment shown in FIG. 10.

Hereinafter, tests which have been conducted for demonstrating the aforementioned works and effects of the image forming apparatus of the invention will be described with reference to examples belonging to the invention and comparative examples not belonging to the invention.

Conditions of photoconductors 2 and conditions of charging rollers 3*a* of image forming apparatuses of the examples and the comparative examples used in the tests, and results of the tests are shown in Table 4.

TABLE 4

| | Photoconductor | | Charging roller | | | |
|---|---|---|---|---|---|---|
| Test No. | Outer diameter (ϕ mm) | Tube thickness (mm) | Outer diameter (ϕ mm) | Pressing method | Result | Remarks |
| 41 | 40 | 1.5 | 12 | Photoconductor-Charging roller are directly driven<br>Spring load 500 gf | NG | Image spots |
| 42 | 40 | 1.5 | 8 | Charging roller is driven by Photoconductor-Pressing members<br>Coaxial rubber member, Load 500 gf | G | Without sponge |

TABLE 4-continued

| Test No. | Photoconductor Outer diameter (ϕ mm) | Photoconductor Tube thickness (mm) | Charging roller Outer diameter (ϕ mm) | Pressing method | Result | Remarks |
|---|---|---|---|---|---|---|
| 43 | 40 | 1.0 | 10 | Charging roller is driven by Photoconductor-Pressing members Coaxial rubber member (sponge on middle portion in the axial direction) Load 800 gf | G | With sponge |
| 44 | 40 | 1.0 | 12 | Charging roller is driven by Photoconductor-Pressing members Coaxial sponge member (sponge over the axial length) Load 400 gf | G | With sponge |
| 45 | 40 | 1.0 | 8 | Photoconductor-Charging roller are directly driven Spring Load 500 gf | NG | Image spots |
| 46 | 30 | 1.5 | 12 | Photoconductor-Charging roller are driven One-side rubber member, Load 500 gf | G | Without sponge |
| 47 | 30 | 1.5 | 8 | Charging roller is driven by Photoconductor-Pressing members Coaxial sponge member (sponge over the axial length) Load 200 gf | G | With sponge |
| 48 | 30 | 1.0 | 10 | Charging roller is driven by Photoconductor-Pressing members Coaxial sponge member (sponge over the axial length) Load 800 gf | G | With sponge |
| 49 | 30 | 0.75 | 8 | Charging roller is driven by Photoconductor-Pressing members One-side rubber member, Load 500 gf | G | Without sponge |
| 50 | 30 | 0.75 | 12 | Charging roller is driven by Photoconductor-Pressing members Coaxial sponge member (sponge over the axial length) Load 800 gf | G | With sponge |
| 51 | 24 | 1.0 | 8 | Photoconductor-Charging roller are directly driven Spring load 200 gf | NG | Image spots |
| 52 | 24 | 1.0 | 12 | Photoconductor-Charging roller are directly driven Spring load 500 gf | NG | Image spots |
| 53 | 24 | 0.75 | 8 | Charging roller is driven by Photoconductor-Pressing members Coaxial rubber member (sponge on middle portion in the axial direction) Load 800 gf | G | With sponge |
| 54 | 24 | 0.75 | 8 | Photoconductor-Charging roller are directly driven Spring load 500 gf | NG | Image spots |

In table 4, photoconductors 2 used in the tests No. 41 through No. 54 are photoconductors, similar to those used in the aforementioned tests, each of which comprises an aluminum tube and a photoconductive layer of 25 μm thickness formed to cover the peripheral surface of the aluminum tube. In this case, the outer diameter of the photoconductors 2 used in the tests Nos. 41 through 45 is 40 mm. Among these, the thickness of the aluminum tubes of the photoconductors 2 used in the tests Nos. 41 and 42 is 1.5 mm and the thickness of the aluminum tubes of the photoconductors 2 used in the tests Nos. 43 through 45 is 1.0 mm. Further, the outer diameter of the photoconductors 2 used in the tests Nos. 46 through 50 is 30 mm. Among these, the thickness of the aluminum tubes of the photoconductors 2 used in the tests Nos. 46 and 47 is 1.5 mm, the thickness of the aluminum tube of the photoconductor 2 used in the test No. 48 is 1.0 mm, and the thickness of the aluminum tubes of the photoconductors 2 used in the tests Nos. 49 and 50 is 0.75 mm. Furthermore, the outer diameter of the photoconductors 2 used in the tests Nos. 51 through 54 is 24 mm. Among these, the thickness of the aluminum tubes of the photoconductors 2 used in the tests Nos. 51 and 52 is 1.0 mm, and the thickness of the aluminum tubes of the photoconductors 2 used in the tests Nos. 53 and 54 is 0.75 mm. Any of the photoconductors 2 was selected to have run-out accuracy of 0.01 or less.

The charging rollers 3*a* used in the tests No. 41 through No. 54 were charging rollers, similar to the aforementioned tests, each of which used a metal shaft comprising a SUM22 with Ni plating on the surface thereof as a metal core and was processed to have such a configuration to be installed to a remodeled machine of the aforementioned printer LP-9000C. The metal shafts were processed by centerless grinding to have run-out accuracy of 0.01 or less. As indicated in Table 4, the outer diameter of the metal shafts used in the tests Nos. 41, 44, 46, 50, and 52 is 12 mm, the outer diameter of the metal shaft used in the test No. 43 is 10 nm, and the outer diameter of the metal shafts used in the tests Nos. 42, 45, 47, 49, 51, 53, and 54 is 8 mm.

Similarly to the aforementioned tests, coating liquid was prepared by mixing electro-conductive tin oxide ($SnO_2$) and polyurethane (PU) resin at a weight ratio (wt ratio) of 1:9 and dispersing the mixture into ion conductive material and water. The coating liquid was coated by spraying so as to form a resistive layer of 20 μm in thickness.

The electro-conductive $SnO_2$ used in the examples and the comparative examples is Trade name "T-1" of Jemco Inc indicated in Table 2. The "T-1" is tin-antimony oxides. The ion conductive material used in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

The gap members 3*d*, 3*e* were formed by sticking a tape made of polyimide (PI) resin having a film thickness of 20 μm and a width of 5 mm onto the peripheral surfaces of both end portions of the charging roller 3*a*.

The pressing members 8, 9 are products having an Asker C hardness of 65° and are each formed by making a cylindrical urethane rubber having an outer diameter of 10 mm and an inner diameter of 5 mm and inserting a shaft having an outer diameter of 6 mm made of SUS into the bore of the cylindrical urethane rubber.

The cleaning member 3*h* was a cylindrical urethane sponge (Trade name "EPT-51" available from Bridgestone Kaseihin Tokyo Co., Ltd.). The urethane sponge had an outer diameter of 10 mm and an inner diameter 5 mm and was set to have a contact depth of 0.3 mm relative to the charging roller 3*a* and to have a run-out tolerance ±0.1.

Figure 34A:
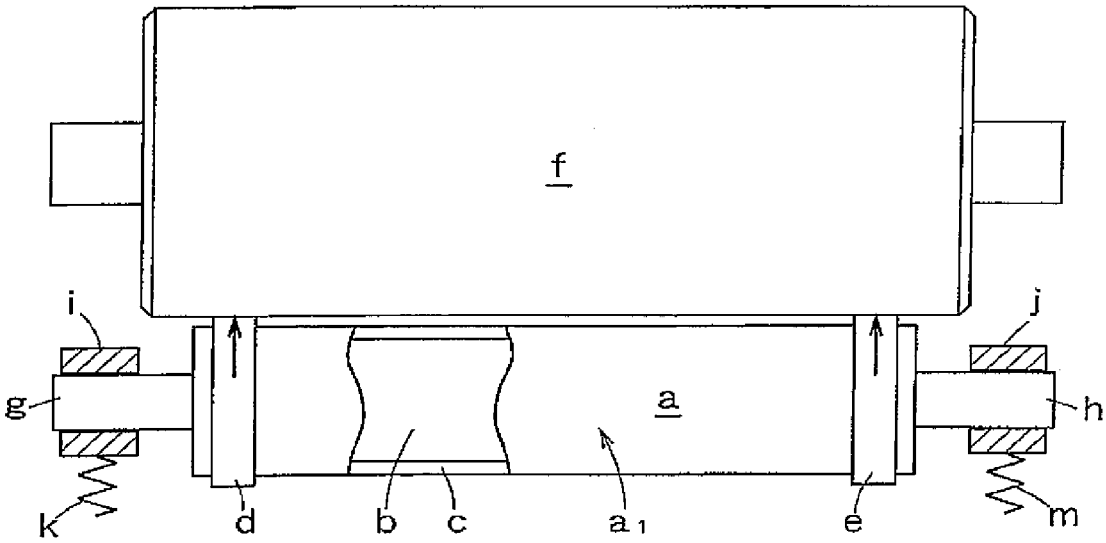
FIG. 34A PRIOR ART
FIG. 34A is an illustration schematically showing a photoconductor and a charging roller in a conventional image forming apparatus.
Figure 34C:
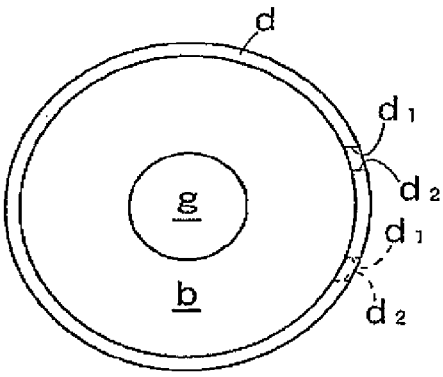
FIG. 34C is a left side view of the gap member shown in FIG. 34B.

As indicated in Table 4, in the tests Nos. 41, 45, 51, 52, and 54, the charging roller 3*a* was pressed by applying load of springs onto bearings (at 10 mm distance from the gap members 3*d*, 3*e*) of the rotary shafts 3*f*, 3*g* as shown in FIG. 34A. The spring load was 500 gf in the tests Nos. 41, 45, 52, and 54, and 200 gf in the test No. 51.

In the test No. 42, the gap members 3*d*, 3*e* were pressed by the pressing members 8, 9 both fixed to the rotary shaft 3*k* as shown in FIG. 11. In this case, the pressing load on the gap members was 500 gf. In the tests No. 43 and 53, the gap members 3*d*, 3*e* were pressed by the pressing members 8, 9 and the charging portion $3a_1$ of the charging roller 3*a* was pressed by the sponge of the cleaning member 3*h* as shown in FIG. 10. In this case, the pressing load on the gap members was 800 gf in the test No. 43 and 200 gf in the test No. 53. In the tests Nos. 44, 47, 48, and 50, the gap members 3*d*, 3*e* and the charging portion $3a_1$ of the charging roller 3*a* are pressed by the cleaning member 3*h* which is integrated with the pressing members and is made of sponge to be formed into a barrel shape as shown in FIG. 13. In this case, the pressing load on the gap members is 400 gf in the test No. 44, 200 gf in the test No. 47, and 800 gf in the tests Nos. 48 and 50. In the tests Nos. 46 and 49, the gap members 3*d*, 3*e* were pressed by the pressing members 8, 9 which were attached to different rotary shafts 3*i*, 3*j*, respectively, as shown in FIG. 12. In this case, the pressing load on the gap members was 500 gf in both the tests Nos. 46 and 49. The pressing force of the charging roller 3*a* was calculated and adjusted each time.

In the tests Nos. 41, 45, 51, 52 and 54, the photoconductor 2 and the charging roller 3*a* were directly driven to rotate via gear train. In the tests Nos. 42 through 44, 46, 47 through 50, and 53, the charging roller 3*a* was not directly driven to rotate by the photoconductor 2 via gear train and was driven to rotate in the following manner. That is, the pressing members 8, 9 and/or the cleaning member 3*h* were adapted to press the gap members 3*d*, 3*e* and/or the portions $3a_1$ of the charging roller 3*a*, whereby the charging roller 3*a* was driven to rotate by the driving torque of the photoconductor 2 and the driving torque of the pressing members 8, 9 and/or the cleaning member 3*h* via the gap members 3*d*, 3*e* and/or the portions $3a_1$ of the charging roller 3*a* as shown in FIG. 10 through FIG. 13.

As apparent from the above, the tests Nos. 42 through 44, 46 through 50, and 53 are the examples of the invention, while the tests Nos. 41, 45, 51, 52, and 54 are the comparative examples.

As for image forming apparatus as the apparatus for the tests, the aforementioned printer LP-9000C which was partially remodeled for conducting the tests was employed. The printer LP-9000C uses a photoconductor having an outer diameter of 40 mm. For conducting tests using a photoconductor having an outer diameter of not 40 mm, an image forming apparatus of which structure was the same as that of the printer LP-9000C but the scale was different from that of the printer LP-9000C was manufactured and the tests of image formation were conducted with the same engine as that of the printer LP-9000C.

For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=1750V f=1.3 kHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 500 sheets of A3 size plain paper each on which half tone monochrome toner image of 5% concentration was formed.

The 100th, 200th, 300th, 400th, and 500th sheets of paper were picked up and observed with human eyes. Only when none of the sheets had image spot, it was determined as good charge. In this case, "G" is indicated on Table 4. When any one of the sheets had image spot, it was determined as no-good charge. In this case, "NG" is indicated on Table 4.

With any of the image forming apparatuses of the examples in the tests Nos. 42 through 44, Nos. 46 through 50, and 53, the result was good charge, i.e. "G". In any of the comparative examples in the tests Nos. 41, 45, 51, 52, and 54, the result was no-good charge, i.e. "NG".

The aforementioned tests demonstrated that, in non-contact charge on the photoconductor 2 by the charging roller 3*a*, the aforementioned works and effects of the invention can be obtained by pressing the charging roller 3*a* toward the photoconductor 2 by the pressing members 8, 9 which are directly driven to rotate by the driving force of the motor via gear train and driving the charging roller 3*a* with the torque of the photoconductor and the torque of the pressing members 8, 9 via the gap members 3*d*, 3*e*.

Figure 14:
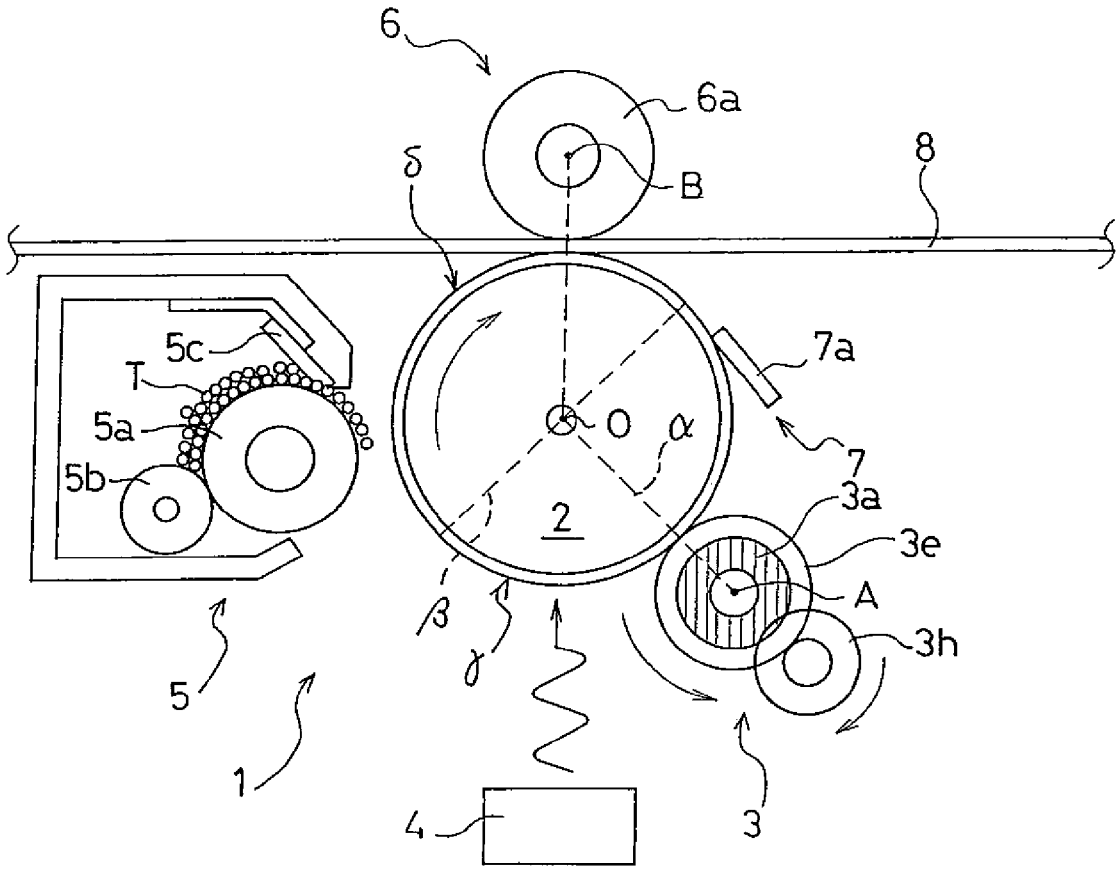
FIG. 14 is an illustration schematically showing an image forming apparatus of a twelfth embodiment according to the invention.
Figure 15:
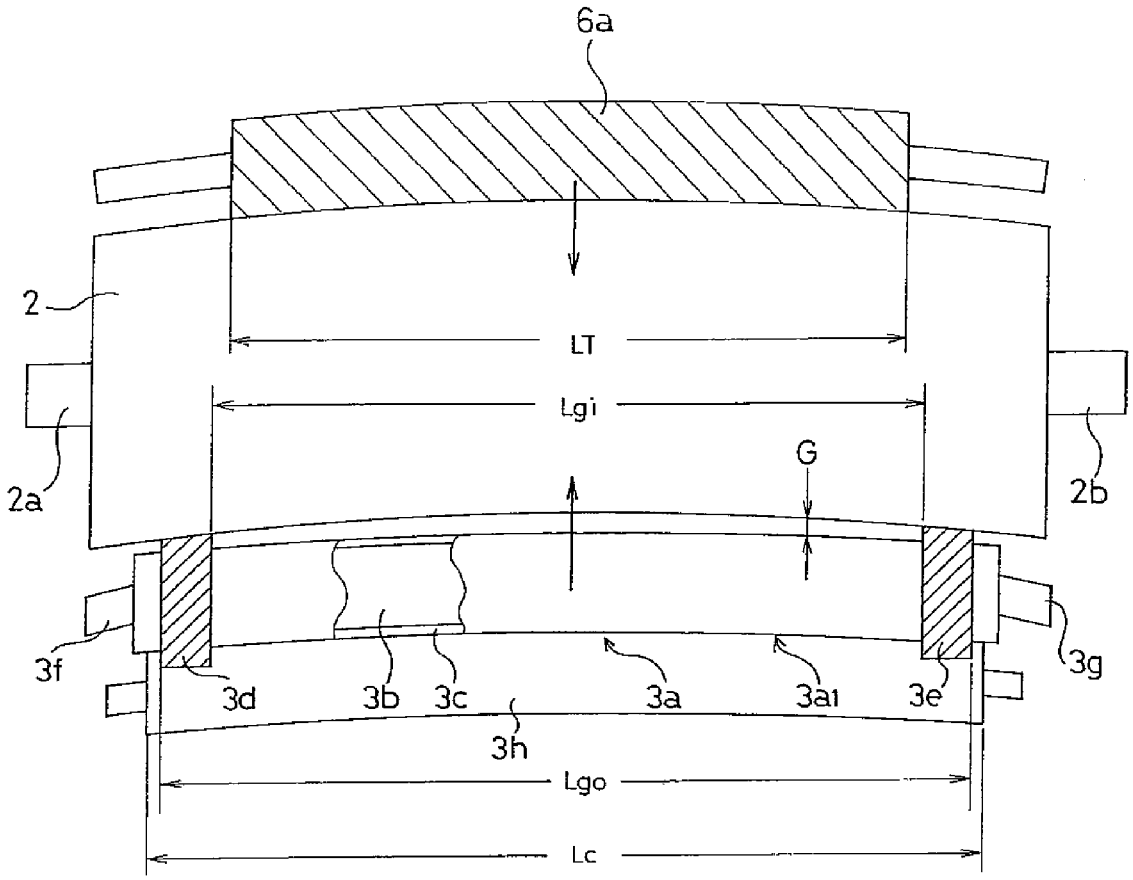
FIG. 15 is an illustration schematically showing a photoconductor and a charging roller in the twelfth embodiment shown in FIG. 14.

FIG. 14 is an illustration schematically and partially showing an image forming apparatus of a twelfth embodiment according to the invention and FIG. 15 is an illustration schematically showing a photoconductor and a charging roller in the twelfth embodiment.

As shown in FIG. 14 and FIG. 15, in the image forming apparatus 1 of twelfth embodiment, a cleaning member 3*h* for cleaning the charging roller 3*a* is formed similarly to the cleaning member 3*h* of the eighth embodiment shown in FIG. 10. In the twelfth embodiment, the width (length in the axial direction) Lc of the sponge of the cleaning member 3*h* is set to be larger than the distance (distance in the axial direction) Lgo between the outer edges of a pair of gap members 3*d*, 3*e*, that is, Lc>Lgo. The sponge of the cleaning member 3*h* is brought in contact with the gap members 3*d*, 3*e* and the charging portion $3a_1$ of the charging roller 3*a* between the gap members 3*d*, 3*e* and presses the gap members 3*d*, 3*e* and the charging portion $3a_1$ toward the photoconductor 2 with predetermined pressing force.

A transfer device 6 has a transfer roller 6*a* pressing the photoconductor 2 with predetermined pressing force. The width (length in the axial direction) $L_T$ of the transfer roller 6*a* is set to be smaller than the distance (distance in the axial direction) Lgi between the inner edges of the gap members 3*d*, 3*e*, that is, $L_T$<Lgi. In the twelfth embodiment, the transfer roller 6*a* for conducting transfer action, i.e. image forming action, composes the image forming component member of the invention and the pressing member of the invention.

As shown in FIG. 14, the position for pressing the photoconductor 2 by the transfer roller 6*a*, i.e. the position of the transfer roller 6*a* relative to the photoconductor 2 is set in an area δ. The area δ is on the opposite side of an area γ, where the charging roller 3*a* is positioned, relative to a line β passing through the center O of the photoconductor 2 and perpendicular to a line α connecting the center O of the photoconductor 2 and the center A of the charging roller 3*a*. The area δ is an area allowing the transfer of toner image on the photoconductor 2 developed by the developing device 5. In this case, by suitably setting the positions of the charging roller 3*a*, the developing device 5, and the transfer roller 6*a*, the area δ can occupy a wide area on the opposite side of the charging roller 3*a* relative to the line β.

By the transfer roller 6*a*, toner image on the photoconductor 2 is transferred to a transfer medium 8 such as a transfer paper or an intermediate transfer medium. When the toner image is transferred to the transfer paper as the transfer medium 8, the toner image on the transfer paper is fixed by a fuser (not shown) so as to form an image on the transfer paper. On the other hand, when the toner image is transferred to the intermediate transfer medium as the transfer medium 8, the toner image on the intermediate transfer medium is further transferred to a transfer paper and, after that, the toner image on the transfer paper is fixed by a fuser (not shown) so as to form an image on the transfer paper.

It should be noted that illustration of the transfer medium 8 which should lie between the photoconductor 2 and the transfer roller 6*a* is omitted in FIG. 15.

In the image forming apparatus 1 of the twelfth embodiment having the aforementioned structure, the transfer roller 6*a* is arranged in the aforementioned area δ, whereby the force pressing the photoconductor 2 by the transfer roller 6*a* produces force against the force pressing the photoconductor 2 by the charging roller 3*a* so that, because of this force, the photoconductor 2 is deflected toward the charging roller 3*a*. That is when the charging roller 3*a* presses the photoconductor 2 with the biasing force of springs applied on the rotary shafts 3*f*, 3*g* of the charging roller 3*a*, the photoconductor 2 is deflected to have deflection Do as shown in FIG. 4. However, the photoconductor 2 is deflected toward the charging roller 3*a* by the aforementioned force based on the pressing force of the transfer roller 6*a* relative to the photoconductor 2, thereby reducing the deflection Do of the photoconductor 2.

Especially, since the width $L_T$ of the transfer roller 6*a* is set to be smaller than the distance Lgi between the inner edges of the gap members 3*d*, 3*e*, that is, $L_T$<Lgi, the portion of the photoconductor 2 corresponding to the charging portion $3a_1$ of the charging roller 3*a* between the gap members 3*d*, 3*e* is effectively pressed by the transfer roller 6*a*. Accordingly, the deflection Do of the photoconductor 2 of which maximum is positioned at the center of the photoconductor 2 can be further securely reduced.

The charge gap G between the charging roller 3*a* and the photoconductor 2 varies little in the axial direction and is substantially constant in the axial direction to be about 50 μm or less.

Since the gap members 3*d*, 3*e* and the charging portion $3a_1$ of the charging roller 3*a* between the gap members 3*d*, 3*e* are pressed by the cleaning member 3*h* toward the photoconductor 2, the portion $3a_1$ of the charging roller 3*a* between the gap members 3*d*, 3*e* is deflected toward the photoconductor 2 as shown in FIG. 15 to have deflection Dr in the same direction as that of the deflection Do of the photoconductor 2, similarly to the eighth embodiment shown in FIG. 10.

When the charging roller 3*a* and the photoconductor 2 are deflected in the same direction as mentioned above, the charge gap G between the charging roller 3*a* and the photoconductor 2 varies little in the axial direction even with the deflection of the charging roller 3*a* and the deflection of the photoconductor 2 and becomes substantially constant in the axial direction with higher precision because of the works and effects of the pressing of the transfer roller 6*a* relative to the photoconductor 2 so that the charge gap G should be securely set to be 50 μm or less. Accordingly, the charge on the photoconductor 2 by the charging roller 3*a* should be further uniform in the axial direction, thereby providing further stable charge over the long term. Especially, since the deflection of the charging roller 3*a* and the deflection of the photoconductor 2 both have their maximum at the same position, i.e. the middle point between the gap members 3*d*, 3*e* and are thus substantially parallel to each other, the charge gap G becomes constant in the axial direction with higher precision, thereby providing further stable charge.

According to the image forming apparatus 1 of the twelfth embodiment, the photoconductor 2 is pressed by the transfer roller 6*a* arranged in the aforementioned area δ, whereby even when the photoconductor 2 is deflected by the pressing of the charging roller 3*a* relative to the photoconductor 2 to have deflection Do, the deflection Do of the photoconductor 2 can be reduced. Accordingly, the charge gap G between the charging roller 3*a* and the photoconductor 2 can be set to a certain value (50 μm) or less and to be substantially constant in the axial direction. Therefore, the charge on the photoconductor 2 by the charging roller 3*a* can be made uniform in the axial direction, thereby providing stable charge over the long term.

Especially, since the width $L_T$ of the transfer roller 6*a* is set to be smaller than the distance Lgi between the inner edges of the gap members 3*d*, 3*e*, that is, $L_T$<Lgi, the deflection Do of the portion of the photoconductor 2 corresponding to the charging portion $3a_1$ of the charging roller 3*a* between the gap members 3*d*, 3*e*, i.e. the deflection Do of the charging area of the photoconductor 2 containing the image formation area can be further securely reduced. Therefore, the charge gap G can be set to be substantially constant in the axial direction and to a certain value (50 μm) or less.

Furthermore, since the transfer roller 6*a* is adapted to press the photoconductor 2 against the pressing direction of the charging roller 3*a* pressing the photoconductor 2, the need of special pressing member for pressing the photoconductor 2 can be eliminated. Therefore, the increase in number of parts can be prevented while making the charge gap G constant in the axial direction, thereby flexibly meeting the demands for size reduction and space saving of the image forming apparatus 1.

Since the width (length in the axial direction) Lc of the sponge of the cleaning member 3*h* is set to be larger than the distance (distance in the axial direction) Lgo between the outer edges of a pair of gap members 3*d*, 3*e*, that is, Lc>Lgo and the gap members 3*d*, 3*e* are pressed toward the photoconductor 2 by the cleaning member 3*h*, foreign matter such as toner particles adhering to the surfaces of the gap members 3*d*, 3*e* can be removed by the cleaning member 3*h*. Accordingly, the charge gap G can be maintained to be constant in the axial direction and to a certain value (50 μm) or less.

Other structure and other works and effects of the image forming apparatus 1 and charging roller 3*a* of the twelfth embodiment are the same as those of the aforementioned eighth embodiment shown in FIG. 10.

Hereinafter, tests which have been conducted for demonstrating the aforementioned works and effects of the image forming apparatus of the invention will be described with reference to examples belonging to the invention and comparative examples not belonging to the invention.

Conditions of photoconductors 2 and conditions of charging rollers 3*a* of image forming apparatuses of the examples and the comparative examples used in the tests, and results of the tests are shown in Table 5.

Further, the outer diameter of the photoconductors 2 used in the tests Nos. 60 through 64 and 74 through 78 is 30 mm. Among these, the thickness of the aluminum tubes of the photoconductors 2 used in the tests Nos. 60, 61, 74, and 75 is 1.5 mm, the thickness of the aluminum tube of the photoconductor 2 used in the tests Nos. 62 and 76 is 1.0 mm, and the thickness of the aluminum tubes of the photoconductors 2 used in the tests Nos. 63, 64, 77, and 78 is 0.75 mm. Furthermore, the outer diameter of the photoconductors 2 used in the tests Nos. 65 through 68 and 79 through 82 is 24 mm. Among these, the thickness of the aluminum tubes of the photoconductors 2 used in the tests Nos. 65, 66, 79, and 80 is 1.0 mm, and the thickness of the aluminum tubes of the photoconductors 2 used in the tests Nos. 67, 68, 81, and 82 is 0.75 mm. Any of the photoconductors 2 was selected to have run-out accuracy of 0.01 or less.

The charging rollers 3*a* used in the tests No. 55 through No. 82 were charging rollers, similar to the aforementioned tests, each of which used a metal shaft comprising a SUM22 with Ni plating on the surface thereof as a metal core and was processed to have such a configuration to be installed to a remodeled machine of the aforementioned printer LP-9000C.

TABLE 5

| | Photoconductor | | Charging roller | | | | | |
|---|---|---|---|---|---|---|---|---|
| | Outer | Tube | Outer | Spring | Transfer Condition | | | |
| Test No. | diameter (ϕ mm) | thickness (mm) | diameter (ϕ mm) | Load (gf) | ∠AOB (°) | Pressure (gf) | Transfer width | Result |
| 55 | 40 | 1.5 | 12 | 200 | 160 | 500 | Small | G |
| 56 | 40 | 1.5 | 8 | 200 | 180 | 800 | Small | G |
| 57 | 40 | 1.0 | 10 | 500 | 240 | 800 | Small | G |
| 58 | 40 | 1.0 | 12 | 800 | 270 | 500 | Small | NG |
| 59 | 40 | 1.0 | 8 | 200 | 280 | 500 | Small | NG |
| 60 | 30 | 1.5 | 12 | 500 | 240 | 800 | Small | G |
| 61 | 30 | 1.5 | 8 | 500 | 180 | 1000 | Small | G |
| 62 | 30 | 1.0 | 10 | 200 | 160 | 800 | Small | G |
| 63 | 30 | 0.75 | 8 | 800 | 240 | 500 | Small | G |
| 64 | 30 | 0.75 | 12 | 200 | 270 | 800 | Small | NG |
| 65 | 24 | 1.0 | 8 | 500 | 280 | 500 | Small | NG |
| 66 | 24 | 1.0 | 12 | 800 | 160 | 800 | Small | G |
| 67 | 24 | 0.75 | 8 | 200 | 180 | 500 | Small | G |
| 68 | 24 | 0.75 | 8 | 800 | 280 | 500 | Small | NG |
| 69 | 40 | 1.5 | 12 | 200 | 160 | 500 | Large | NG |
| 70 | 40 | 1.5 | 8 | 200 | 180 | 800 | Large | NG |
| 71 | 40 | 1.0 | 10 | 500 | 240 | 800 | Large | NG |
| 72 | 40 | 1.0 | 12 | 800 | 270 | 500 | Large | NG |
| 73 | 40 | 1.0 | 8 | 200 | 280 | 500 | Large | NG |
| 74 | 30 | 1.5 | 12 | 500 | 240 | 800 | Large | NG |
| 75 | 30 | 1.5 | 8 | 500 | 180 | 1000 | Large | NG |
| 76 | 30 | 1.0 | 10 | 200 | 160 | 800 | Large | NG |
| 77 | 30 | 0.75 | 8 | 800 | 240 | 500 | Large | NG |
| 78 | 30 | 0.75 | 12 | 200 | 270 | 800 | Large | NG |
| 79 | 24 | 1.0 | 8 | 500 | 280 | 500 | Large | NG |
| 80 | 24 | 1.0 | 12 | 800 | 160 | 800 | Large | NG |
| 81 | 24 | 0.75 | 8 | 200 | 180 | 500 | Large | NG |
| 82 | 24 | 0.75 | 8 | 800 | 280 | 500 | Large | NG |

In table 5, photoconductors 2 used in the tests No. 55 through No. 82 are photoconductors, similar to those used in the aforementioned tests, each of which comprises an aluminum tube and a photoconductive layer of 25 μm thickness formed to cover the peripheral surface of the aluminum tube. In this case, the outer diameter of the photoconductors 2 used in the tests Nos. 55 through 59 and 69 through 73 is 40 mm. Among these, the thickness of the aluminum tubes of the photoconductors 2 used in the tests Nos. 55, 56, 69, and 70 is 1.5 mm and the thickness of the aluminum tubes of the photoconductors 2 used in the tests Nos. 57 through 59 and 71 through 73 is 1.0 mm.

The metal shafts were processed by centerless grinding to have run-out accuracy of 0.01 or less. As indicated in Table 5, the outer diameter of the metal shafts used in the tests Nos. 55, 58, 60, 64, 66, 69, 72, 74, 78, and 80 is 12 mm, the outer diameter of the metal shaft used in the tests Nos. 57, 62, 71, and 76 is 10 nm, and the outer diameter of the metal shafts used in the tests Nos. 56, 59, 61, 63, 65, 67, 68, 70, 73, 75, 77, 79, 81, and 82 is 8 mm.

In the same manner as the aforementioned tests, a resistive layer of 20 μm in film thickness was formed on the peripheral surface of the metal shaft. The electro-conductive $SnO_2$ used in the examples and the comparative examples is Trade name "T-1" of Jemco Inc indicated in Table 2. The "T-1" is tin-antimony oxides. The ion conductive material used in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

The gap members 3*d*, 3*e* were formed by sticking a tape made of polyimide (PI) resin having a film thickness of 20 μm and a width of 5 mm onto the peripheral surfaces of both end portions of the charging roller 3*a*.

As the pressing method, the charging roller 3*a* was pressed by applying load of springs onto bearings (at 10 mm distance from outer edges of the gap members 3*d*, 3*e*) of the rotary shafts 3*f*, 3*g*. The spring load was 200 gf in the tests Nos. 55, 56, 59, 62, 64, 67, 69, 70, 73, 76, 78, and 81, 500 gf in the tests Nos. 57, 60, 61, 65, 71, 74, 75, and 79, and 800 gf in the tests Nos. 58, 63, 66, 68, 72, 77, 80, and 82.

The apparatuses for the tests for the image forming apparatus were the same as the apparatuses used in the aforementioned tests.

Figure 16:
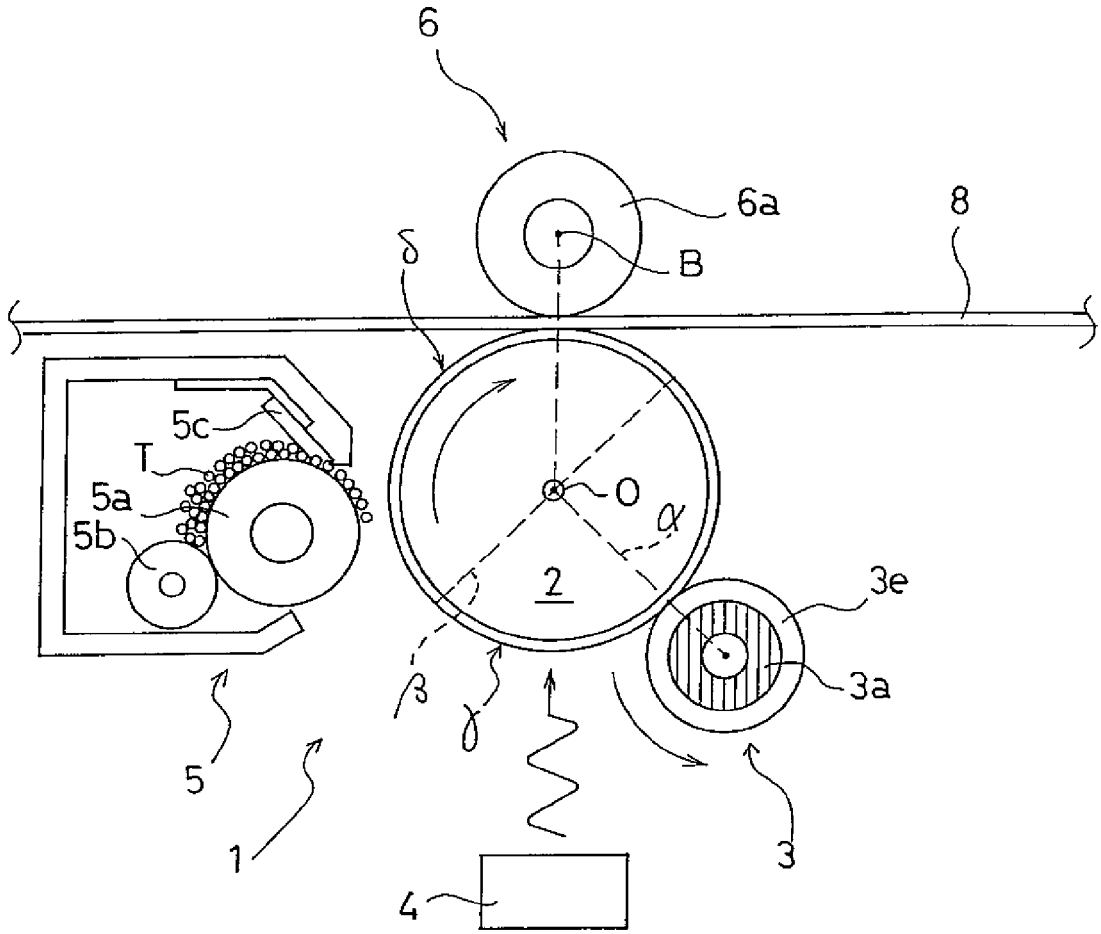
FIG. 16 is an illustration schematically showing an image forming apparatus as an experimental apparatus.

In the apparatus for the tests as shown in FIG. 16, for convenience of tests, the cleaning device 7 for the photoconductor 2 and the cleaning member 3*h* for the charging roller 3*a* as shown in FIG. 14 are omitted. The omission of the cleaning device 7 for the photoconductor 2 allows flexible variation in the position for pressing the photoconductor 2, that is, the position of the transfer roller 6*a*. The relative position among the center O of the photoconductor 2, the center A of the charging roller 3*a*, and the center B of the transfer roller 6*a*, that is, the position of the transfer roller 6*a* is indicated by an angle ∠AOB which is formed by a line connecting the center O and the center B relative to the line a in the rotational direction of the photoconductor 2 (the clockwise direction in the illustrated example). The tests were conducted with various positions of the transfer roller 6*a*, i.e. various angles ∠AOB. The position of the charging roller 3*a* was fixed and the position of the developing device 5 was changed according to the position of the transfer roller 6*a*.

Omission of the cleaning device 7 and the cleaning member 3*h* should not affect the invention with regard to the pressing of the photoconductor 2 toward the charging roller 3*a* by the transfer roller 6*a*.

The transfer conditions are as follows. That is, as shown in Table 5, the angle ∠AOB representing the position of the transfer roller 6*a* is 160° in the tests Nos. 55, 62, 66, 69, 76, and 80, 180° in the tests Nos. 56, 61, 67, 70, 75, and 81, 240° in the tests Nos. 57, 60, 63, 71, 74, and 77, 270° in the tests Nos. 58, 64, 72, and 78, and 280° in the tests Nos. 59, 65, 68, 73, 79, and 82. The pressing force on the photoconductor 2 by the transfer roller 6*a* was 500 gf in the tests Nos. 55, 58, 59, 63, 65, 67, 68, 69, 72, 73, 77, 79, 81, and 82, 800 gf in the tests Nos. 56, 57, 60, 62, 64, 66, 70, 71, 74, 76, 78, and 80, and 1000 gf in the tests Nos. 61 and 75.

The width (transfer width) of the transfer roller 6*a* is smaller than the distance between the inner edges of the gap members 3*d*, 3*e* in the tests Nos. 55 through 68 and larger than the distance between the inner edges of the gap members 3*d*, 3*e* in the tests Nos. 69 through 72.

As apparent from the above, the tests Nos. 55 through 57, 60 through 63, 66 and 67 are the examples of the invention, while the tests Nos. 58, 59, 64, 65, 68, and 69 through 82 are the comparative examples.

For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=1750V, f=1.3 kHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 500 sheets of A3 size plain paper each on which half tone monochrome toner image of 5% concentration was formed.

The 100th, 200th, 300th, 400th, and 500th sheets of paper were picked up and observed with human eyes. Only when none of the sheets had image spot, it was determined as extremely good charge. In this case, "G" is indicated on Table 5. Even when none of sheets up to $300^{th}$ sheet had image spot, that is, good charge was provided, but a kind of image spot was slightly discernible on sheets from $400^{th}$ sheet to $500^{th}$ sheet while the sheets were practically workable, it was determined as no-good charge in the invention so that "NG" is indicated on Table 5. When any one of the sheets had image spot, it was determined as no-good charge so that "NG" is indicated on Table 5.

With any of the image forming apparatuses of the examples in the tests Nos. 55 through 57, 60 through 63, 66, and 67, the result was good charge, i.e. "G". In any of the comparative examples in the tests Nos. 69 through 71, 74 through 77, 80, and 81, a kind of image spot was discernible so that the result was no-good charge in the invention, but practically workable charge was provided. In any of the comparative examples in the tests Nos. 58, 59, 64, 65, 68, 72, 73, 78, 79, and 82, image spot was discernible so that the result was no-good charge, i.e. "NG".

The aforementioned tests demonstrated that, in non-contact charge on the photoconductor 2 by the charging roller 3*a*, the aforementioned works and effects of the invention can be obtained by pressing the photoconductor 2 by the transfer roller 6 arranged in the area δ. That is, it was demonstrated that excellent charge can be provided by setting the width of the transfer roller 6*a* to be smaller than the distance between the inner edges of the gap members 3*d*, 3*e* in addition to arranging the transfer roller in the area δ.

Figure 17:
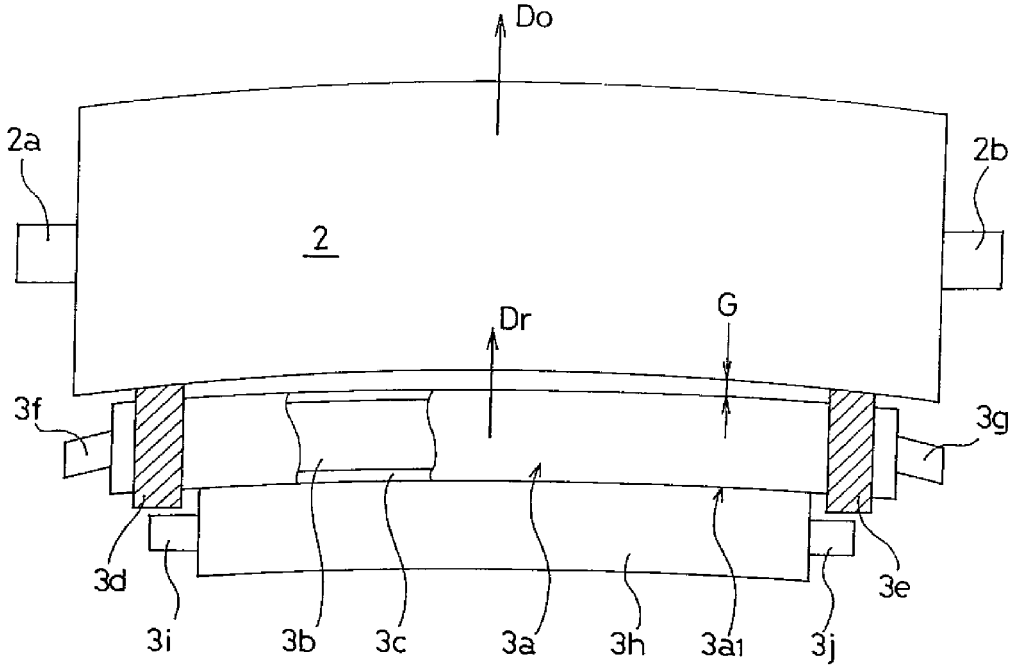
FIG. 17 is an illustration schematically showing a photoconductor and a charging roller used in an image forming apparatus of a thirteenth embodiment according to the invention.

FIG. 17 is an illustration schematically showing a photoconductor and a charging roller used in an image forming apparatus of a thirteenth embodiment according to the invention.

Though the pair of pressing members 8, 9 are arranged on the both ends of the cleaning member 3*h* so that the pair of gap members 3*d*, 3*e* are pressed toward the photoconductor 2 by the pressing members 8, 9 and the charging portion $3a_1$ of the charging roller 3*a* between the gap members 3*d*, 3*e* is pressed toward the photoconductor 2 by the cleaning member 3*h* in the image forming apparatus 1 of the eighth embodiment shown in FIG. 10, the pair of pressing members 8, 9 are not provided so that only the charging portion $3a_1$ of the charging roller 3*a* is pressed toward the photoconductor 2 by the cleaning member 3*h* in the image forming apparatus of the thirteenth embodiment as shown in FIG. 17.

In the image forming apparatus 1 of the thirteenth embodiment having the aforementioned structure, the charging portion $3a_1$ of the charging roller 3*a* between the gap members 3*d*, 3*e* is pressed toward the photoconductor 2 by the cleaning member 3*h*, whereby even though the charging roller 3*a* is pressed toward the photoconductor 2 by biasing force of springs applied to the rotary shafts 3*f*, 3*g* of the charging roller 3*a*, the charging portion $3a_1$ of the charging roller 3*a* between the gap members 3*d*, 3*e* are deflected to have deflection (bending deformation) Dr in a direction toward the photoconductor 2 as shown in FIG. 17. Normally, the maximum of deflection Dr of the charging roller 3*a* is positioned at the middle point in the axial direction between the gap members 3*d*, 3*e* (the middle point between the gap members 3*d*, 3*e*).

Similarly to the aforementioned image forming apparatuses of the conventional example, the photoconductor 2 is pressed by the pair of gap members 3*d*, 3*e* and is thus deflected to have deflection (bending deformation) Do in the same direction as the deflection Dr of the charging roller 3*a*. Normally, the maximum of deflection Do of the photoconductor 2 is positioned at the middle point in the axial direction between the gap members 3*d*, 3*e* (the middle point between the gap members 3*d*, 3*e*).

When the charging roller 3*a* and the photoconductor 2 are deflected in the same direction as mentioned above, the charge gap G between the charging roller 3*a* and the photoconductor 2 varies little in the axial direction and is substantially constant in the axial direction to be about 50 μm or less even with the deflection of the charging roller 3*a* and the deflection of the photoconductor 2.

According to the image forming apparatus 1 of this embodiment, the charging portion $3a_1$ of the charging roller 3*a* between the gap members 3*d*, 3*e* is pressed toward the photoconductor 2 by the cleaning member 3*h*, thereby forcedly deflecting the charging roller 3*a* and the photoconductor 2 in the same direction. Accordingly, the charge gap G between the charging roller 3*a* and the photoconductor 2 can be formed to be a certain value (50 μm) or less and to be substantially constant in the axial direction. Therefore, the charge on the photoconductor 2 by the charging roller 3*a* can be uniform in the axial direction, thereby providing stable charge over the long term. Especially, the deflection of the charging roller 3*a* and the deflection of the photoconductor 2 have respective maximums at the same position i.e. the middle point between the pair of gap members 3*d*, 3*e*, thereby making the charge gap G to be further precisely constant in the axial direction and thus providing further stable charge relative to the photoconductor 2.

Since the charge gap G can be formed to be constant in the axial direction even with the deflection of the charging roller 3*a* and the deflection of the photoconductor 2, the charging roller 3*a* can be designed to have reduced outer diameter and the photoconductor 2 can be designed to have reduced outer diameter and reduced thickness. Therefore, it can effectively meet the demands for size reduction and space saving of the image forming apparatus which are recently strongly desired as mentioned above.

Other structure and other works and effects of the image forming apparatus of the thirteenth embodiment are the same as those of the aforementioned eighth embodiment shown in FIG. 10.

Figure 18:
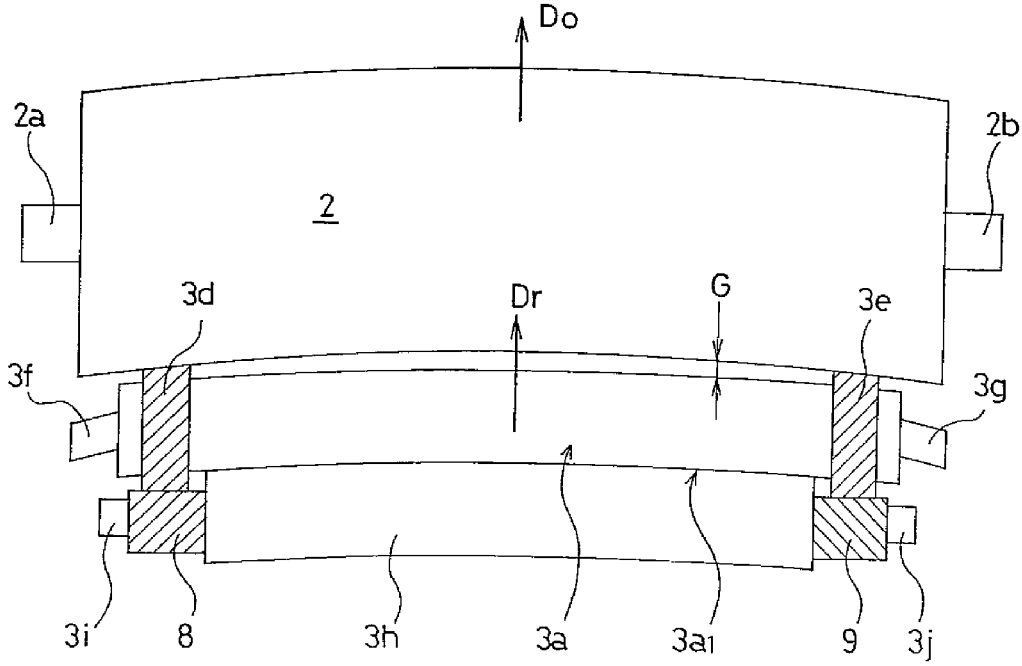
FIG. 18 is an illustration schematically showing a photoconductor and a charging roller in an image forming apparatus of a fourteenth embodiment according to the invention.

FIG. 18 is an illustration schematically showing a photoconductor and a charging roller in an image forming apparatus of a fourteenth embodiment according to the invention.

Though the charging roller 3*a* is pressed toward the photoconductor 2 by biasing force of the springs applied to the rotary shafts 3*f*, 3*g* of the charging roller 3*a* similarly to the conventional image forming apparatus in the aforementioned image forming apparatus 1 of the thirteenth embodiment as shown in FIG. 17, the charging roller 3*a* is not pressed by biasing force of springs applied to the rotary shafts 3*f*, 3*g* and the gap members 3*d*, 3*e* are pressed toward the photoconductor 2 only by the pressing members 8, 9, respectively in the image forming apparatus 1 of the fourteenth embodiment as shown in FIG. 18.

That is, in the image forming apparatus 1 of the fourteenth embodiment, a pair of pressing members 8, 9 for pressing the gap members 3*d*, 3*e* of the charging roller 3*a* are arranged on the both ends of the cleaning member 3*h* and coaxially with the cleaning member 3*h*. The pressing members 8, 9 are made of, for example, rubber and are each formed in a cylindrical shape of which outer diameter is constant in the axial direction and are fixed to the rotary shafts 3*i*, 3*j* of the cleaning member 3*h*.

The pressing members 8, 9 press the gap members 3*d*, 3*e* toward the photoconductor 2, whereby the gap members 3*d*, 3*e* are brought in contact with the peripheral surface of the photoconductor 2 with some pressure and the cleaning member 3*h* presses the charging portion $3a_1$ of the charging roller 3*a* toward the photoconductor 2.

According to the image forming apparatus 1 of the fourteenth embodiment, the gap members 3*d*, 3*e* are pressed toward the photoconductor 2 by the pressing members 8, 9, respectively, thereby further securely bringing the gap members 3*d*, 3*e* in contact with the photoconductor 2 with some pressure. Therefore, the charge gap G is further stably formed. As compared to the conventional manner in which the rotary shafts of the charging roller 3*a* outside of the gap members 3*d*, 3*e* are pressed, this arrangement in which the gap members 3*d*, 3*e* are pressed by the pressing members 8, 9, respectively makes the charging roller 3*a* hard to deflect in a direction apart from the photoconductor 2. Therefore, the charge gap G can be further securely set to be a certain value (50 μm) or less, thereby providing further stable charge over the long term.

Other structure and other works and effects of the image forming apparatus 1 of the fourteenth embodiment are the same as those of the aforementioned thirteenth embodiment shown in FIG. 17.

Figure 19:
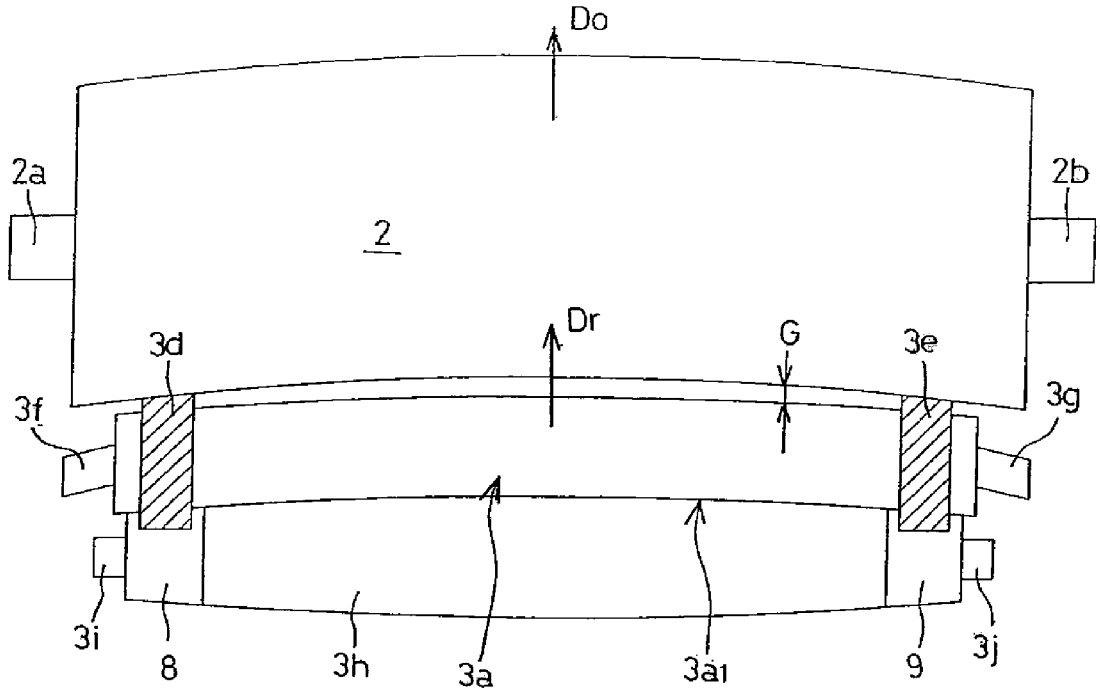
FIG. 19 is an illustration schematically showing a photoconductor and a charging roller in an image forming apparatus of a fifteenth embodiment according to the invention.

FIG. 19 is an illustration schematically showing a photoconductor and a charging roller in an image forming apparatus of a fifteenth embodiment according to the invention.

Though the cleaning member 3*h* and the pressing members 8, 9 are formed to have constant diameters in the aforementioned image forming apparatus 1 of the fourteenth embodiment shown in FIG. 18, pressing members 8, 9 and a cleaning member 3*h* are made of the same materials as those of the aforementioned embodiment, respectively and are united to be formed into a barrel shape of which the outer diameter at the middle is larger than the outer diameter at the both ends in the image forming apparatus 1 of the fifteenth embodiment as shown in FIG. 19.

Since the cleaning member 3*h* and the pressing members 8, 9 are formed into a single barrel shape, the charging roller 3*a* can be deflected to have the maximum point of deflection at the middle point of the charging roller 3*a*, where corresponds to the maximum point of deflection of the photoconductor 2 when pressed by the gap members 3*d*, 3*e*, according to the profile of the barrel shape. Accordingly, the charge gap G is effectively set to be a certain value (50 μm) or less and set to be further uniform in the axial direction.

The pressing members 8, 9 and the cleaning member 3*h* are united, thereby reducing the entire size of the apparatus and effectively promoting the space saving.

Other structure and other works and effects of the image forming apparatus 1 of the fifteenth embodiment are the same as those of the aforementioned fourteenth embodiment shown in FIG. 18.

Figure 20:
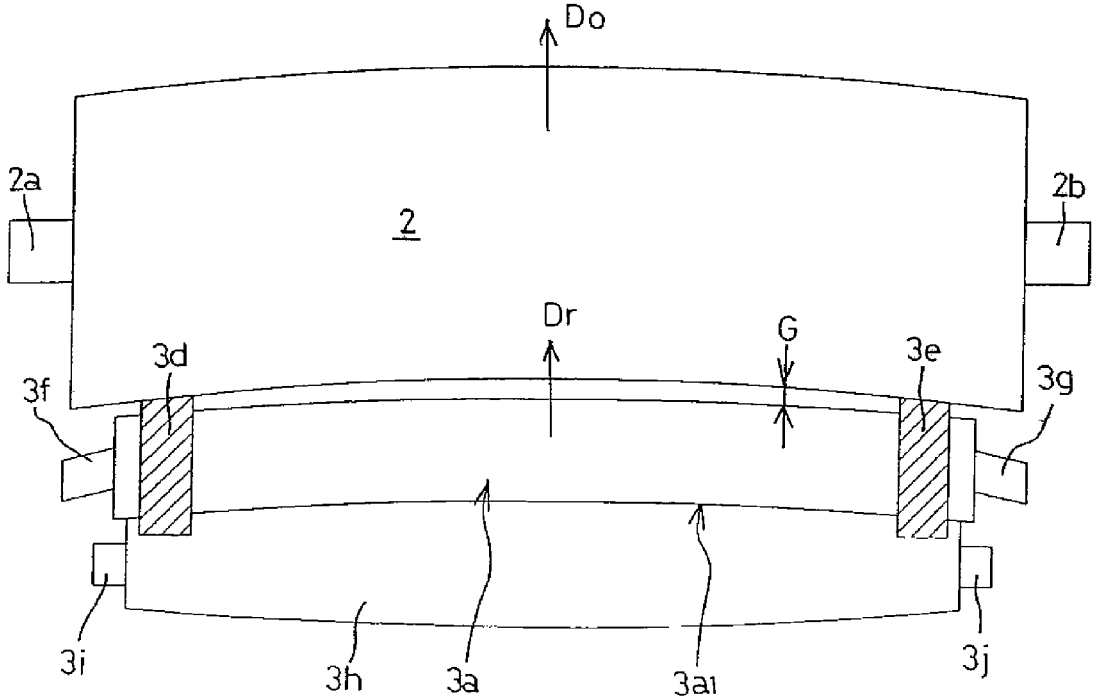
FIG. 20 is an illustration schematically showing a photoconductor and a charging roller in an image forming apparatus of a sixteenth embodiment according to the invention.

FIG. 20 is an illustration schematically showing a photoconductor and a charging roller in an image forming apparatus of a sixteenth embodiment according to the invention.

Though the cleaning member 3*h* and the pressing members 8, 9 are made of different materials in the image forming apparatus 1 of the fifteenth embodiment shown in FIG. 19, the pressing members 8, 9 are formed as portions of the cleaning member 3*h* and the cleaning member 3*h* is entirely formed in a barrel shape in the image forming apparatus of the sixteenth embodiment as shown in FIG. 20. The cleaning member 3*h* of this case is also made of sponge similarly to the aforementioned embodiments.

Other structure and other works and effects of the image forming apparatus 1 of the sixteenth embodiment are the same as those of the aforementioned fifteenth embodiment shown in FIG. 19.

Figure 21:
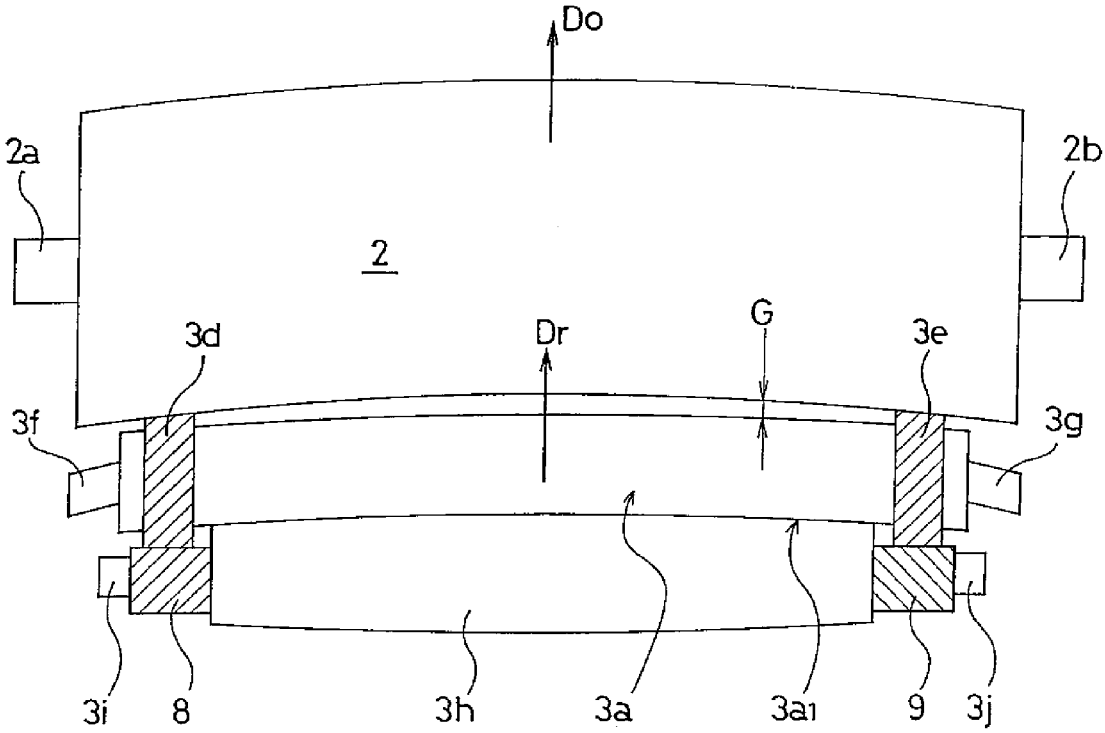
FIG. 21 is an illustration schematically showing a photoconductor and a charging roller in an image forming apparatus of a seventeenth embodiment according to the invention.

FIG. 21 is an illustration schematically showing a photoconductor and a charging roller in an image forming apparatus of a seventeenth embodiment according to the invention.

Though the cleaning member 3*h* is formed to have a diameter which is constant in the axial direction in the image forming apparatus of the fourteenth embodiment shown in FIG. 18, the cleaning member 3*h* is formed into a barrel shape of which diameter at the middle thereof is larger in the image forming apparatus 1 of the seventeenth embodiment as shown in FIG. 21.

Since the cleaning member 3*h* is formed into a barrel shape, the charging roller 3*a* can be deflected to have the maximum point of deflection at the middle point of the charging roller 3*a* according to the profile of the barrel shape of the cleaning member 3*h*, wherein the maximum point of deflection of the charging roller 3*a* corresponds to the maximum point of deflection of the photoconductor 2 when pressed by the gap members 3*d*, 3*e*. Accordingly, the charge gap G is effectively set to be a certain value (50 μm) or less and set to be further uniform in the axial direction.

Other structure and other works and effects of the image forming apparatus 1 of the seventeenth embodiment are the same as those of the aforementioned fourteenth embodiment shown in FIG. 18.

Hereinafter, tests which have been conducted for demonstrating the aforementioned works and effects of the image forming apparatus of the invention will be described with reference to examples belonging to the invention and comparative examples not belonging to the invention.

Conditions of photoconductors 2 and conditions of charging rollers 3*a* of image forming apparatuses of the examples and the comparative examples used in the tests, and results of the tests are shown in Table 6.

TABLE 6

| | Photoconductor | | Charging roller | | | | |
|---|---|---|---|---|---|---|---|
| Test No. | Outer diameter (ϕ mm) | Tube thickness (mm) | Outer diameter (ϕ mm) | Pressing method | Embodiment | Result | Remarks |
| 83 | 40 | 1.5 | 12 | Spring load on bearings 500 gf<br>Contact portions are sponge | FIG. 17 | G | |
| 84 | 40 | 1.5 | 8 | Spring load on bearings 500 gf<br>Contact portions are sponge | FIG. 20 | G | |
| 85 | 40 | 1.0 | 10 | Pressing load on gap members 500 gf<br>Contact portions are sponge | FIG. 19 | G | |
| 86 | 40 | 1.0 | 12 | Pressing load on gap members 500 gf<br>Contact portions are sponge | FIG. 17 | G | |
| 87 | 40 | 1.0 | 8 | Pressing load on gap members 500 gf<br>Contact portions are sponge<br>(Gap members are coaxial) | FIG. 21 | G | |
| 88 | 30 | 1.5 | 12 | Pressing load on gap members 500 gf<br>Contact portions are sponge<br>(Gap members are coaxial) | FIG. 18 | G | |
| 89 | 30 | 1.5 | 8 | Pressing load on gap members 500 gf<br>Contact portions are sponge | FIG. 17 | G | |
| 90 | 30 | 1.0 | 10 | Pressing load on gap members 500 gf<br>Contact portions are sponge<br>(Gap members are coaxial) | FIG. 18 | G | |
| 91 | 30 | 0.75 | 8 | Pressing load on gap members 500 gf<br>Contact portions are sponge<br>(Gap members are coaxial) | FIG. 21 | G | |
| 92 | 30 | 0.75 | 12 | Spring load on bearings 500 gf<br>Without sponge | FIG. 35 | NG | Discharge failure at middle |
| 93 | 24 | 1.0 | 8 | Spring load on bearings 500 gf<br>Without sponge | FIG. 35 | NG | Discharge failure at middle |
| 94 | 24 | 1.0 | 12 | Spring load on bearings 500 gf<br>Without sponge | FIG. 35 | NG | Discharge failure at middle |
| 95 | 24 | 0.75 | 8 | Spring load on bearings 500 gf<br>Contact portions are sponge | FIG. 17 | G | |
| 96 | 24 | 0.75 | 8 | Pressing load on gap members 500 gf<br>Contact portions are sponge<br>(Gap members are coaxial) | FIG. 18 | G | |

In table 6, photoconductors 2 used in the tests No. 83 through No. 96 are photoconductors, similar to those used in the aforementioned tests, each of which comprises an aluminum tube and a photoconductive layer of 25 μm thickness formed to cover the peripheral surface of the aluminum tube. In this case, the outer diameter of the photoconductors 2 used in the tests Nos. 83 through 87 is 40 mm. Among these, the thickness of the aluminum tubes of the photoconductors 2 used in the tests Nos. 83 and 84 is 1.5 mm and the thickness of the aluminum tubes of the photoconductors 2 used in the tests Nos. 85 through 87 is 1.0 mm. Further, the outer diameter of the photoconductors 2 used in the tests Nos. 88 through 92 is 30 mm. Among these, the thickness of the aluminum tubes of the photoconductors 2 used in the tests Nos. 88 and 89 is 1.5 mm, the thickness of the aluminum tube of the photoconductor 2 used in the test No. 90 is 1.0 mm, and the thickness of the aluminum tubes of the photoconductors 2 used in the tests Nos. 91 and 92 is 0.75 mm. Furthermore, the outer diameter of the photoconductors 2 used in the tests Nos. 93 through 96 is 24 mm. Among these, the thickness of the aluminum tubes of the photoconductors 2 used in the tests Nos. 93 and 94 is 1.0 mm and the thickness of the aluminum tubes of the photoconductors 2 used in the tests Nos. 95 and 96 is 0.75 mm. Any of the photoconductors 2 was selected to have run-out accuracy of 0.01 or less.

The charging rollers 3*a* used in the tests No. 83 through No. 96 are metal shafts similar to the charging rollers 3*a* used in the aforementioned tests. As indicated in Table 6, the outer diameter of the metal shafts used in the tests Nos. 83, 86, 88, 92, and 94 is 12 mm, the outer diameter of the metal shafts used in the tests Nos. 85 and 90 is 10 mm, and the outer diameter of the metal shafts used in the tests Nos. 84, 87, 89, 91, 93, 95, and 96 is 8 mm.

In the same manner as the aforementioned tests, a resistive layer of 20 μm in film thickness was formed on the peripheral surface of the metal shaft. The electro-conductive $SnO_2$ used in the examples and the comparative examples is Trade name "T-1" of Jemco Inc indicated in Table 2. The "T-1" is tin-antimony oxides. The ion conductive material used in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

The gap members 3*d*, 3*e* were formed by sticking a tape made of polyimide (PI) resin having a film thickness of 20 μm and a width of 5 mm onto the peripheral surfaces of both end portions of the charging roller 3*a*.

The pressing members 8, 9 are products having an Asker C hardness of 650 and are each formed by making a cylindrical urethane rubber having an outer diameter of 10 mm and an inner diameter of 5 mm and inserting a shaft having an outer diameter of 6 mm made of SUS into the bore of the cylindrical urethane rubber.

The cleaning member 3*h* was a cylindrical urethane sponge (Trade name "EPT-51" available from Bridgestone Kaseihin Tokyo Co., Ltd.). The urethane sponge had an outer diameter of 10 mm and an inner diameter 5 mm and was set to have a contact depth of 0.3 mm relative to the charging roller 3*a* and to have a run-out tolerance ±0.1.

As the pressing method, as shown in Table 6, the charging roller was pressed by applying load of springs onto bearings "g", "h" (at 10 mm distance from the gap members 3*d*, 3*e*) of the rotary shafts 3*f*, 3*g* in the tests Nos. 83, 84, 92 through 94. Among these, in the test No. 83, the sponge of the cleaning member 3*h* also presses the charging portion $3a_1$ of the charging roller 3*a* as shown in FIG. 17. In the test No. 84, the sponge of the cleaning member 3*h* presses the gap members 3*d*, 3*e* as well as the charging portion $3a_1$ of the charging roller 3*a* as shown in FIG. 20. In the tests Nos. 92 through 94, the cleaning member 3*h* was not provided so that the charging roller 3*a* was not pressed by the sponge of the cleaning member 3*h*, and the charging roller 3*a* was pressed by applying biasing force of springs onto the bearings of the rotary shafts of the charging roller 3*a* so that the photoconductor 2 is pressed via the gap members 3*d*, 3*e* as shown in FIG. 35.

In the tests Nos. 85 through 91, 95, and 96, the charging roller 3*a* was not pressed by springs and was pressed by the cleaning member 3*h* or a combination of the cleaning member 3*h* and the pressing members 8, 9. In the test No. 85, the pressing members 8, 9, which were united with the cleaning member 3*h* and are formed in a barrel shape together with the cleaning member 3*h*, directly pressed the gap members 3*d*, 3*e* and the cleaning member 3*h* presses the charging portion $3a_1$ of the charging roller 3*a* as shown in FIG. 19. In the tests Nos. 86, 89, and 95, the sponge of the cleaning member 3*h* pressed the charging portion $3a_1$ of the charging roller 3*a* as shown in FIG. 17. In the tests Nos. 87 and 91, the pressing members 8, 9 which were formed to have different shape from the cleaning member 3*h* directly pressed the gap members 3*d*, 3*e* and the sponge of the cleaning member 3*h* which was formed in a barrel shape pressed the charging portion $3a_1$ of the charging roller 3*a* as shown in FIG. 21. In the tests Nos. 88, 90, and 96, the pressing members 8, 9 which were formed to have different shape from the cleaning member 3*h* directly pressed the gap members 3*d*, 3*e* and the sponge of the cleaning member 3*h* which was formed in a straight cylindrical shape pressed the charging portion $3a_1$ of the charging roller 3*a* as shown in FIG. 18.

In all of the tests, the total pressing force was 500 gf. The pressing force of the charging roller 3*a* was calculated and adjusted each time.

As apparent from the above, the tests Nos. 83 through 91, 95, and 96 are the examples of the invention, while the tests Nos. 92 through 94 are the comparative examples of the invention.

As for image forming apparatus as the apparatus for the tests, the aforementioned printer LP-9000C which was partially remodeled for conducting the tests was employed similarly to the aforementioned tests. For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=1750V, f=1.3 kHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 500 sheets of A3 size plain paper each on which half tone monochrome toner image of 5% concentration was formed.

The 100th, 200th, 300th, 400th, and 500th sheets of paper were picked up and observed with human eyes. Only when none of the sheets had image spot, it was determined as good charge. In this case, "G" is indicated on Table 6. When any one of the sheets had image spot, it was determined as no-good charge. In this case, "NG" is indicated on Table 6.

With any of the image forming apparatuses of the examples in the tests Nos. 83 through 91, 95, and 96, the result was good charge, i.e. "G". In any of the comparative examples in the tests Nos. 92 through 94, discharge failure occurred at the middle portion of the charging roller 3*a* and image spot was found so that the result was no-good charge, i.e. "NG".

The aforementioned tests demonstrated that, in non-contact charge on the photoconductor 2 by the charging roller 3*a*, the aforementioned works and effects of the invention can be obtained by bringing the cleaning member 3*h* for the charging roller 3*a* into contact with the charging roller 3*a* to press the charging roller 3*a* toward the photoconductor 2 with the cleaning member 3*h*.

Figure 22:
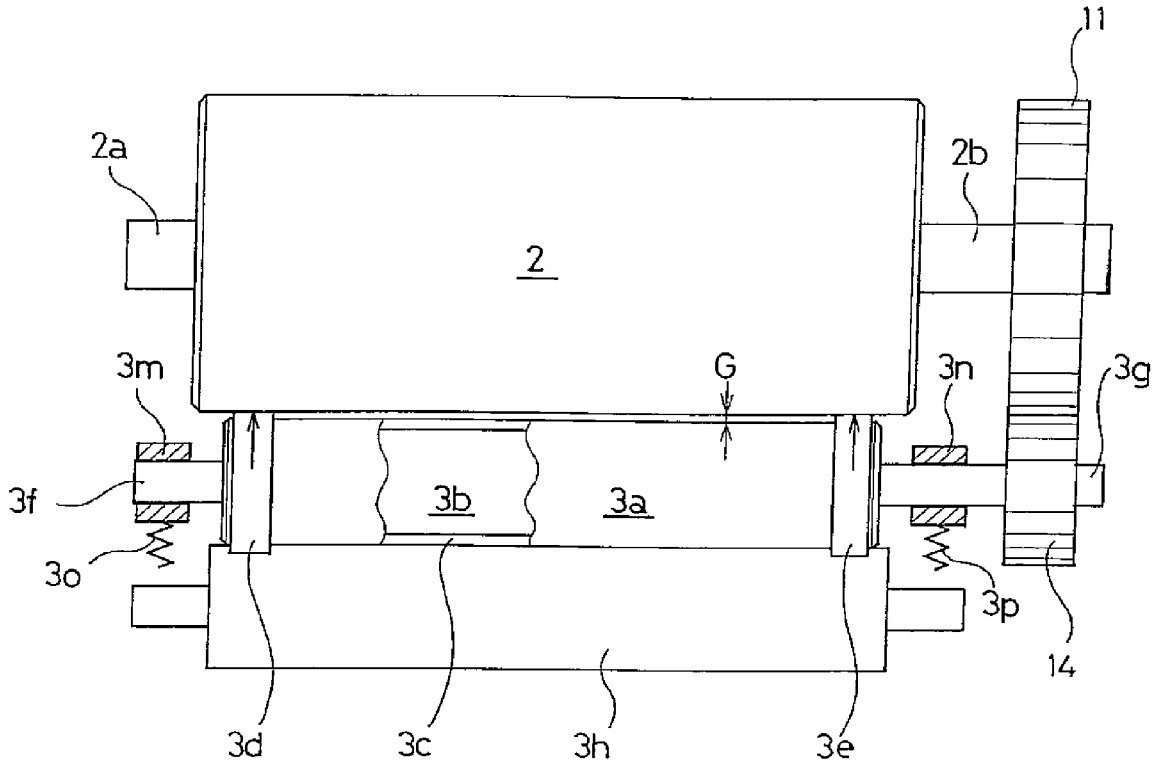
FIG. 22 is an illustration schematically showing a photoconductor and a charging device in an image forming apparatus of an eighteenth embodiment according to the invention.

FIG. 22 is an illustration schematically showing a photoconductor and a charging device in an image forming apparatus of an eighteenth embodiment according to the invention.

As shown in FIG. 22, a charging device 3 of the image forming apparatus 1 of the eighteenth embodiment comprises a charging roller 3*a* for conducting charge relative to the photoconductor 2 in the non-contact charging manner. The charging roller 3*a* has a structure similar to the charging rollers 3*a* of the aforementioned embodiments. First and second gap members 3*d*, 3*e* are fixed by wrapping film members such as adhesive tapes, which have a predetermined width and are constant in thickness, into ring-like shape around the peripheral surfaces of end portions of the resistive layer 3*c* the charging roller 3*a*.

Figure 23A:
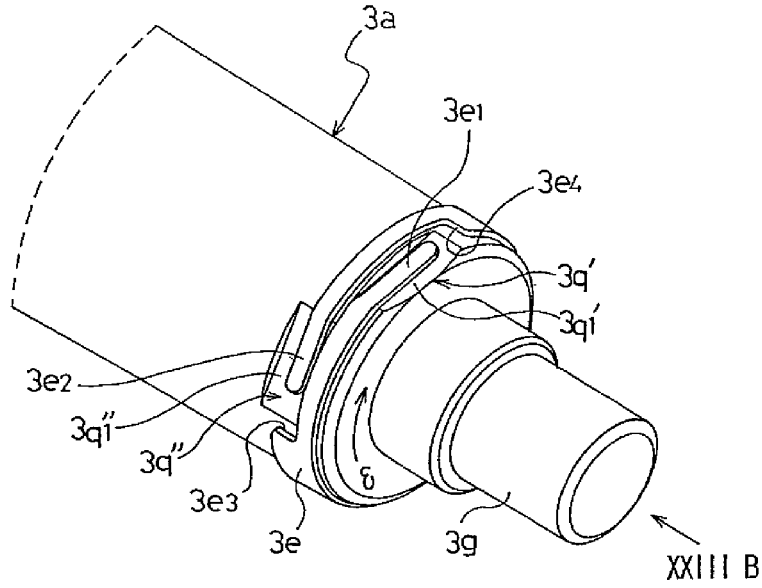
FIG. 23A is a perspective view schematically and partially showing a charging roller in the eighteenth embodiment shown in FIG. 22.
Figure 23B:
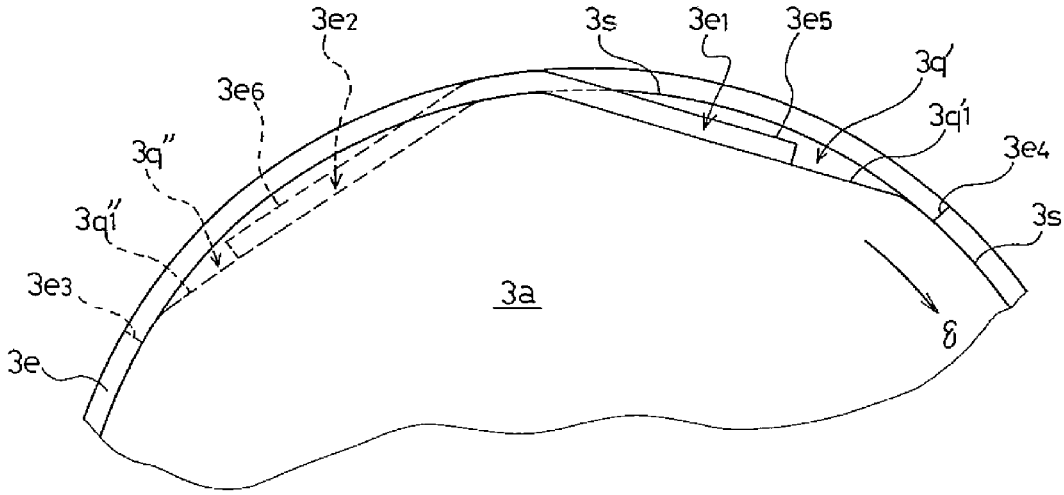
FIG. 23B is a view taken along a direction XXIIIB in FIG. 23A.

As shown in FIG. 23A and FIG. 23B, at the position of the peripheral surface of the end portion of the charging roller 3*a* where the second gap member 3*e* is fixed, the peripheral surface of the metal core 3*b* is partially cut away into a flat chord-like shape so that the resistive layer 3*c* is exposed on the surface of the cutaway portion. Accordingly, a second entrance side concavity 3*q*' is formed in the peripheral surface of the charging roller 3*a*. Further, in the same manner, a second exit side concavity 3*q*' is formed on the peripheral surface of the charging roller 3*a* at a position different from the position of the second entrance side concavity 3*q*' in the circumferential direction. Here, the "entrance side" means a side on which the second gap member 3*e* enters into a contact portion (nip portion) relative to the photoconductor 2 and the "exit side" means a side on which the second gap member 3*e* exits from the contact portion (nip portion) relative to the photoconductor 2. Each of the second entrance side concavity 3*q*' and the second exit side concavity 3*q*" is a D-like cut portion having a D-like shape as seen in the axial direction of the charging roller 3*a*. The second entrance side concavity 3*q*' and the second exit side concavity 3*q*" correspond to the second gap member entrance side contact-preventing means and the second gap member exit side contact-preventing means of the invention, respectively.

The both end portions $3e_1$, $3e_2$ of the second gap member 3*e* are each formed to have a constant width which is smaller than the half of the width of the other portion of the adhesive tape and cooperate with the other portion of the second gap member 3*e* to form steps $3e_3$, $3e_4$ extending in the axial direction of the charging roller 3*a*. The one end portion $3e_1$ of the second gap member 3*e* is partially fixed to a flat chord-like surface $3q_1$' of the second entrance side concavity 3*q*' in the sticking manner. A portion continued from the one end portion $3e_1$ is wrapped around the peripheral surface 3*s* having a circular cross section of the charging roller 3*a* in a direction opposite to the rotational direction ϵ of the charging roller 3*a* shown by an arrow nearly a circuit without shifting in the axial direction. The other end portion $3e_2$ passes the second entrance side concavity 3*q*' and is partially fixed to a flat chord-like surface $3q_1$" of the second exit side concavity 3*q*" in the sticking manner.

In this case, the other end portion $3e_2$ of the second gap member 3*e* is not positioned on the second entrance side concavity 3*q*' and the one end portion $3e_1$ of the second gap member 3*e* is not positioned on the second exit side concavity 3*q* ". In other words, the size of the second entrance side concavity 3*q*' in the axial direction is set not to extend to a position where the other end portion $3e_2$ of the second gap member 3*e* is fixed and the size of the second exit side concavity 3*q*" in the axial direction is set to not to extend to a position where the one end portion $3e_1$ of the second gap member 3*e* is fixed. Therefore, the one end portion $3e_1$ of the second gap member 3*e* extends to put its tip in the rotational direction ϵ of the charging roller 3*a*, while the other end portion $3e_2$ of the second gap member 3*e* extends to put its tip in the direction opposite to the rotational direction a of the charging roller 3*a*.

In this manner, most of the one end portion $3e_1$ and most of the other end portion $3e_2$ of the second gap member 3*e* are overlapped each other in the axial direction of the charging roller 3*a*. Thus, the second gap member 3*e* exists all positions in the axial direction of the charging roller 3*a* all around the charging roller 3*a* in the circumferential direction.

In a state that the second gap member 3*e* is fixed around the peripheral surface of the charging roller 3*a*, the step $3e_3$ on the side of the one end portion $3e_1$ of the second gap member 3*e* is fixed to the peripheral surface of the charging roller 3*a* at a position out of the second exit side concavity 3*q*" and the step $3e_4$ on the side of the other end portion $3e_2$ of the second gap member 3*e* is fixed to the peripheral surface of the charging roller 3*a* at a position out of the second entrance side concavity 3*q*'.

Most of the upper surface $3e_5$ extending a predetermined length from the end of the one end portion $3e_1$ which is positioned on the second entrance side concavity 3*q*' on the side of the one end portion $3e_1$ of the second gap member 3*e* is lowered from the peripheral surface 3*s* of the charging roller 3*a* so as not to project from the peripheral surface 3*s*. In the same manner, most of the upper surface $3e_6$ extending a predetermined length from the end of the other end portion $3e_2$ which is positioned on the second exit side concavity 3*q*" on the side of the other end portion $3e_2$ of the second gap member 3*e* is lowered from the peripheral surface 3*s* of the charging roller 3*a* so as not to project from the peripheral surface 3*s*. The upper surface $3e_5$ of the one end portion $3e_1$ and the upper surface $3e_6$ of the other end portion $3e_2$ of the second gap member 3*e* are not limited thereto and may project from the peripheral surface 3*s* but at least do not project from the peripheral surface of the second gap member 3*e* not to come in contact with the photoconductor 2. However, it is preferable that the upper surface $3e_5$ of the one end portion $3e_1$ and the upper surface $3e_6$ of the other end portion $3e_2$ of the second gap member 3*e* are made not to project from the peripheral surface 3*s* of the charging roller 3*a* because the contact relative to the photoconductor 2 can be securely prevented.

The first gap member 3*d*, the first entrance side concavity, and the first exit side concavity are formed symmetrically with and to be exactly identical with the second gap member 3*e*, the second entrance side concavity 3*q*' and the second exit side concavity 3*q*", respectively, but not shown. Therefore, the first entrance side concavity to which one end portion of the first gap member 3*d*, corresponding to the one end portion $3e_1$, is fixed in the sticking manner is formed at the same position (in the same phase) in the circumferential direction as the second entrance side concavity 3*q*' of the one end portion $3e_1$. In addition, the first exit side concavity to which the other end portion of the first gap member 3*d*, corresponding to the other end portion $3e_2$, is fixed in the sticking manner is formed at the same position (in the same phase) in the circumferential direction as the second exit side concavity 3*q*' of the other end portion $3e_2$. (That is, the respective one end portions of the first and second gap members 3*d*, 3*e* are overlapped in the axial direction of the charging roller 3*a* and the respective other end portions of the first and second gap members 3*d*, 3*e* are overlapped in the axial direction of the charging roller 3*a*.) Each of the first entrance side concavity and the first exit side concavity is a D-like cut portion having a D-like shape as seen in the axial direction of the charging roller 3*a*. The first entrance side concavity and the first exit side concavity correspond to the first gap member entrance side contact-preventing means and the first gap member exit side contact-preventing means of the invention, respectively.

On the right side of the photoconductor 2 in FIG. 22, a photoconductor driving gear 11 for rotating the photoconductor 2 is fixed to the rotary shaft 2*b* of the photoconductor 2. Fixed to the rotary shaft 3*g* of the right side of the charging roller 3*a* is a charging roller driving gear 14 for rotating the charging roller 3*a*. Driving force of a motor (not shown) is transmitted to the photoconductor driving gear 11 for the photoconductor 2 so as to rotate the photoconductor 2. Further, the driving force of the motor is transmitted to the charging roller driving gear 14 so as to rotate the charging roller 3*a*.

In the image forming apparatus 1 of the eighteenth embodiment having the aforementioned structure, as the photoconductor 2 is rotated in the clockwise direction in FIG. 1, the charging roller 3*a* is rotated in the counterclockwise direction as a direction opposite from the photoconductor 2. Accordingly, the second gap member 3*e* enters into the nip portion (contact portion) between the photoconductor 2 and the second gap member 3*e* from the tip of the one end portion $3e_1$ thereof. During this, since most of the upper surface $3e_5$ extending a predetermined length from the end of the one end portion $3e_1$ which is positioned on the second entrance side concavity 3*q*' on the side of the one end portion $3e_1$ of the second gap member 3*e* does not project from the peripheral surface 3*s* of the charging roller 3*a*, the portion not projecting from the peripheral surface including the tip of the one end portion $3e_1$ never comes in contact with the photoconductor 2 even when the second gap member 3*e* enters into the nip portion between the photoconductor 2 and the second gap member 3*e*. Therefore, this portion of the second gap member 3*e* is not subject to pressing force from the photoconductor 2. The portion of the second gap member 3*e* projecting from the peripheral surface 3*s* of the charging roller 3*a* receives pressing force from the photoconductor 2. However, even though the second gap member 3*e* receives pressing force from the photoconductor 2, the second gap member 3*e* never unstuck from the charging roller 3*a* because the one end portion $3e_1$ after passing the nip portion is fixed to the surface $3q_1$' of the second entrance side concavity 3*q*'. Therefore, even when the image forming action (printing) is conducted by the image forming apparatus 1 for a prolonged period, the unsticking of the second gap member 3*e* from the charging roller 3*a* is prevented from starting at the one end portion $3e_1$. The same is true for the first gap member 3*d*.

On the other hand, the second gap member 3*e* is rotated nearly a circuit, the other end portion $3e_2$ comes off, i.e. exits from the nip portion (contact portion) between the photoconductor 2 and the second gap member 3*e*. During this, since most of the upper surface $3e_6$ extending a predetermined length from the end of the other end portion $3e_2$ which is positioned on the second exit side concavity 3*q*" on the side of the other end portion 302 of the second gap member 3*e* does not project from the peripheral surface 3*s*, the portion not projecting from the peripheral surface including the tip of the other end portion $3e_2$ never comes in contact with the photoconductor 2. Therefore, since this portion of the second gap member 3*e* is not subject to pressing force from the photoconductor 2, the second gap member 3*e* never unstuck from the charging roller 3*a* even when the photoconductor 2 and the charging roller 3*a* are stopped from rotating when this portion of the second gap member 3*e* is positioned at the nip portion between the photoconductor 2 and the second gap member 3*e*. The same is true for the first gap member 3*d*.

In this manner, the one end portions and the other end portions of the first and second gap members 3*d* 3*e* are securely fixed and thus prevented from unsticking. In addition, the first and second gap members 3*d*, 3*e* are present all around the charging roller 3*a* in the circumferential direction to be constant in thickness. Therefore, uniform stable charge gap G can be maintained over the long term so as to provide stable charge on the photoconductor 2, thereby providing high-quality images.

According to the image forming apparatus 1 of the eighteenth embodiment, the first and second gap members 3*d*, 3*e* composed of film members are present all around the charging roller 3*a* in the circumferential direction and the one end portions and the other end portions of the first and second gap members 3*d*, 3*e* are designed not to be in contact with the photoconductor 2 even when the first and second gap members 3*d*, 3*e* enter into their nip portions relative to the photoconductor 2, whereby the first and second gap members are securely prevented from unsticking from the charging roller 3*a* even when image forming action (printing action) is conducted for a prolonged period and even when the photoconductor 2 and the charging roller 3*a* are stopped from rotating when the other end portions of the first and second gap members 3*d* 3*e* are positioned at the nip portions relative to the photoconductor 2. Especially when the charging roller 3*a* is composed of a non-elastic member which increases the frequency of the unsticking of the gap members 3*d*, 3*e*, the unsticking of the first and second gap members 3*d*, 3*e* is effectively prevented. Therefore, uniform and stable charge gap G can be maintained over the long term so as to provide stable charge on the photoconductor 2, thereby providing high-quality images over the long term.

Other structure and other works and effects of the image forming apparatus 1 of the eighteenth embodiment are the same as those of the aforementioned first embodiment shown in FIG. 1.

Figure 24A:
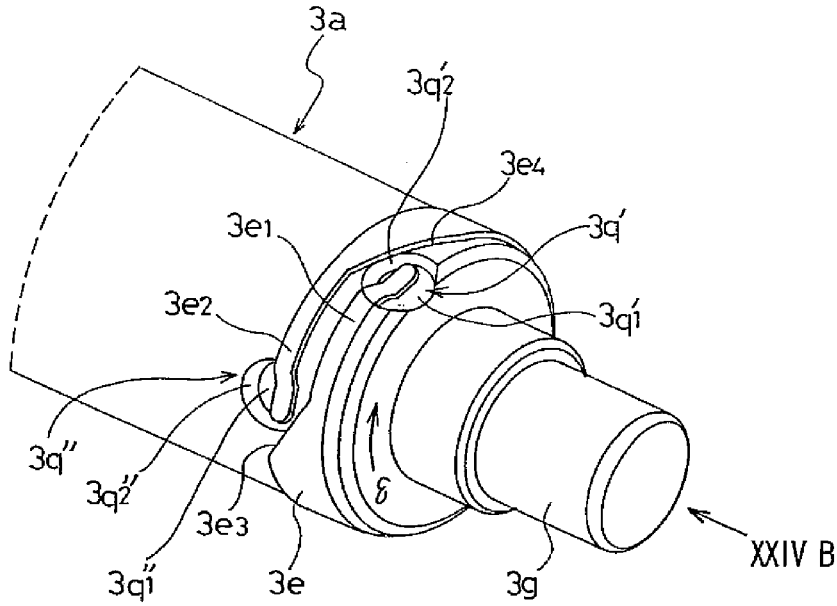
FIG. 24A is a perspective view schematically and partially showing a charging roller in an image forming apparatus of a nineteenth embodiment according to the invention.
Figure 24B:
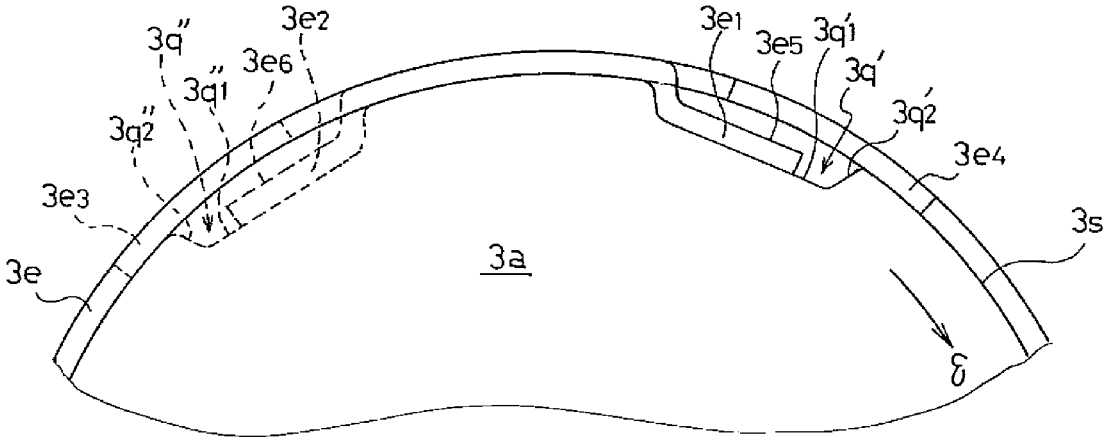
FIG. 24B is a view taken along a direction XXIVB in FIG. 24A.

FIG. 24A is a perspective view, similar to FIG. 23A, but schematically and partially showing a charging roller in an image forming apparatus of a nineteenth embodiment according to the invention and FIG. 24B is a view taken along a direction XXIVB in FIG. 24A.

Though the first and second entrance side concavities and the first and second exit side concavities are each formed by cutting the peripheral surface of the charging roller 3*a* into a flat chord-like shape in the charging roller 3*a* of the eighteenth embodiment shown in FIGS. 23A and 23B, first and second entrance side concavities and first and second exit side concavities are each formed into an inverted truncated cone shape in the charging roller 3*a* of the nineteenth embodiment as shown in FIGS. 24A and 24B. A portion of one end portion $3e_1$ of a second gap member 3*e* is fixed to a flat surface $3q_1$' as the bottom surface of the second entrance side concavity 3*q*' and a slope $3q_2$' of the inverted truncated cone shape in the sticking manner. In addition, a portion of the other end portion $3e_2$ of a second gap member 3*e* is fixed to a flat surface $3q_1$" as the bottom surface of the second exit side concavity 3*q*" and a slope $3q_2$" of the inverted truncated cone shape in the sticking manner. In the charging roller 3*a* of this embodiment, a step $3e_3$ of the second gap member 3*e* is formed into an inclined surface inclined from the root of the one end portion $3e_1$ toward the other end portion $3e_2$, while the other step $3e_4$ of the second gap member 3*e* is formed into an inclined surface inclined in the same direction as the step $3e_3$. The first gap member 3*d* is formed symmetrically with and to be exactly identical with the second gap member 3*e*.

Other structure and other works and effects of the image forming apparatus 1 of the nineteenth embodiment are the same as those of the aforementioned eighteenth embodiment shown in FIGS. 23A and 23B.

Figure 25:
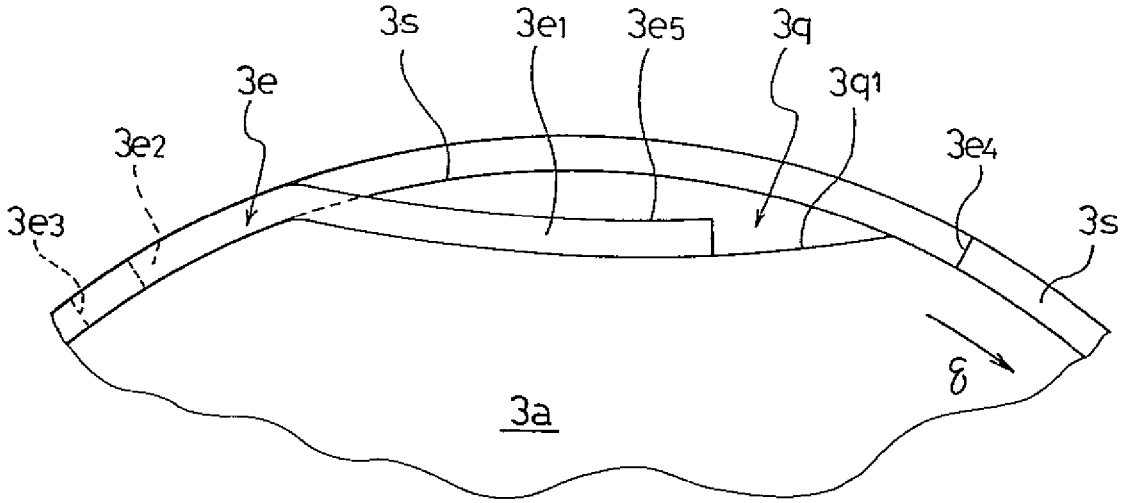
FIG. 25 is an illustration similar to FIG. 23B and FIG. 24B, but schematically and partially showing a variation of the charging roller of the eighteenth and nineteenth embodiments.

Though the first and second entrance side concavities and the first and second exit side concavities of the charging roller 3*a* are formed to have flat surfaces to which the one end portions and the other end portions of the first and second gap members are fixed in the aforementioned eighteenth embodiment shown in FIGS. 23A and 23B, the invention is not limited thereto. For example, as shown in FIG. 25, the surface $3q_1'$ of the first entrance side concavity 3*q*' may be formed into an arc shape to have a deep middle portion. The same is true for the other first entrance side concavity and the first and second exit side concavities. Similarly, the bottom surfaces of the concavities of the inverted truncated cone shape in the charging roller 3*a* of the embodiment shown in FIGS. 24A and 24B may be each formed into an arc shape.

Figure 26:
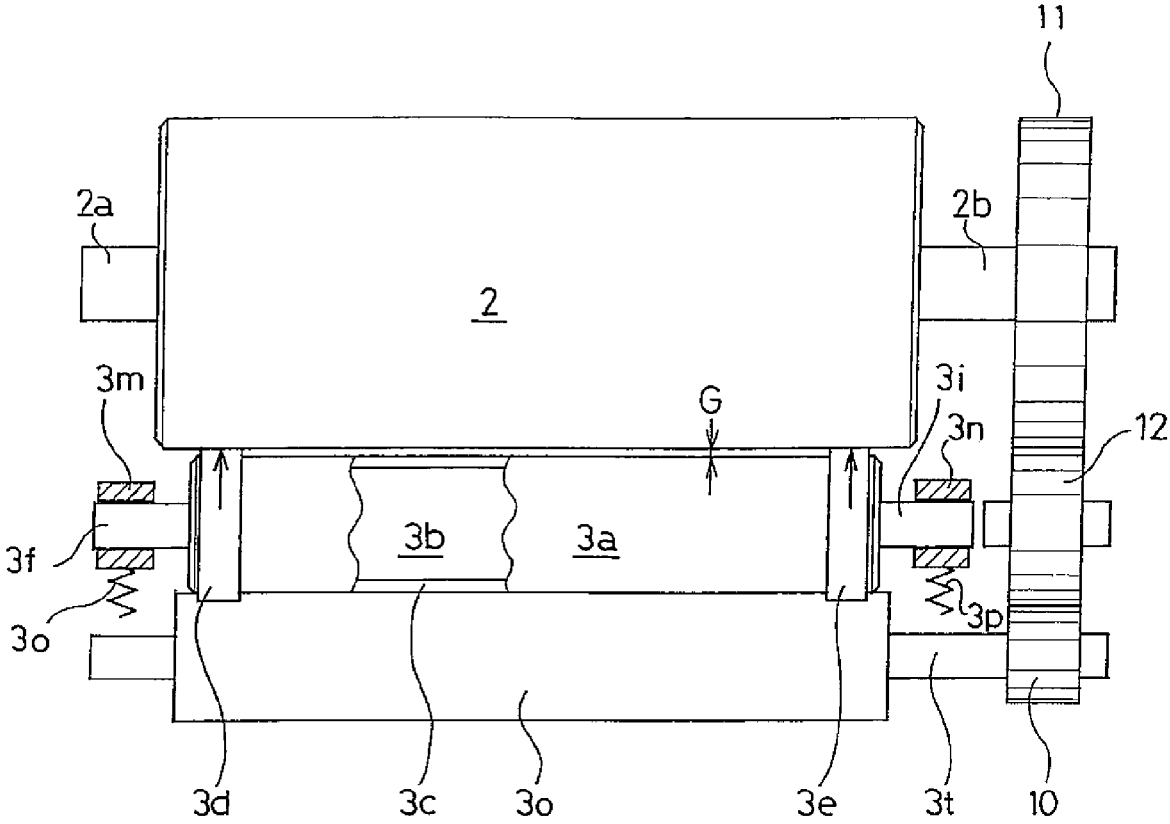
FIG. 26 is an illustration similar to FIG. 22, but schematically showing variations of the photoconductor and the charging roller of the eighteenth embodiment.

Though the charging roller 3*a* is directly driven by the photoconductor driving gear 11 for the photoconductor 2 via the charging roller driving gear 14 as shown in FIG. 22 in any of the image forming apparatuses 1 of the eighteenth and nineteenth embodiments, the invention is not limited thereto and the charging roller 3*a* may be rotated by friction relative to the photoconductor 2 and the cleaning member 3*h*. That is, as shown in FIG. 26, a cleaning member driving gear 10 for rotating the cleaning member 3*h* is fixed to a rotary shaft 3*t* on the right end of the cleaning member 3*h*. The photoconductor driving gear 11 and the cleaning member driving gear 10 are connected to each other via an intermediate gear 12 which is rotatably supported on the apparatus body. As driving force of the motor is transmitted to the photoconductor driving gear 11, the photoconductor 2 is rotated as mentioned above. As driving force of the motor is further transmitted to the cleaning member driving gear 10 via the intermediate gear 12, the cleaning member 3*h* is rotated. Since the charging roller 3*a* is pressed between the photoconductor 2 and the cleaning member 3*h*, the charging roller 3*a* is rotated by friction relative to the photoconductor 2 and the cleaning member 3*h* according to the rotation of the photoconductor 2 and the cleaning member 3*h*.

Figure 27A:
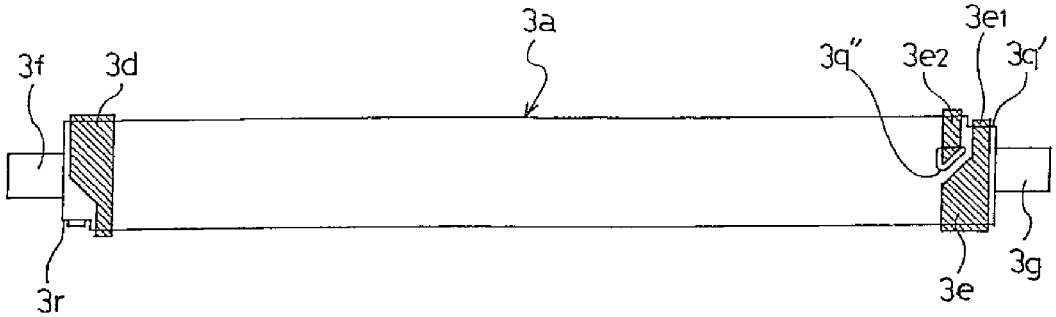
FIG. 27A is an illustration schematically showing a variation of the charging roller of the eighteenth and nineteenth embodiments.
Figure 27B:
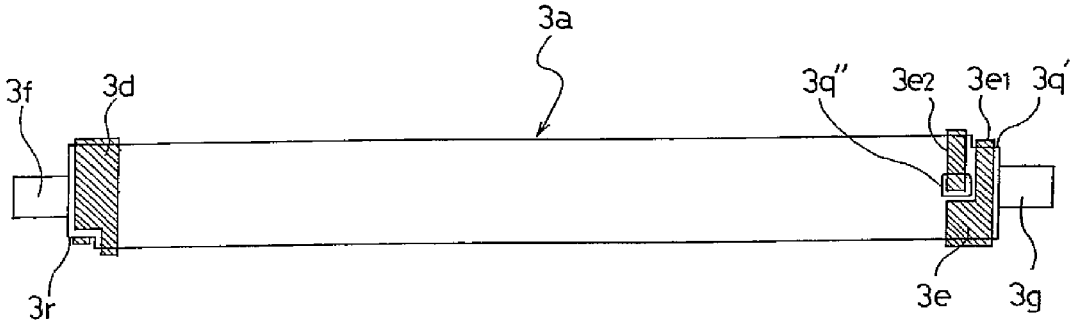
FIG. 27B is an illustration schematically showing another variation of the charging roller of the eighteenth and nineteenth embodiments.
Figure 27C:
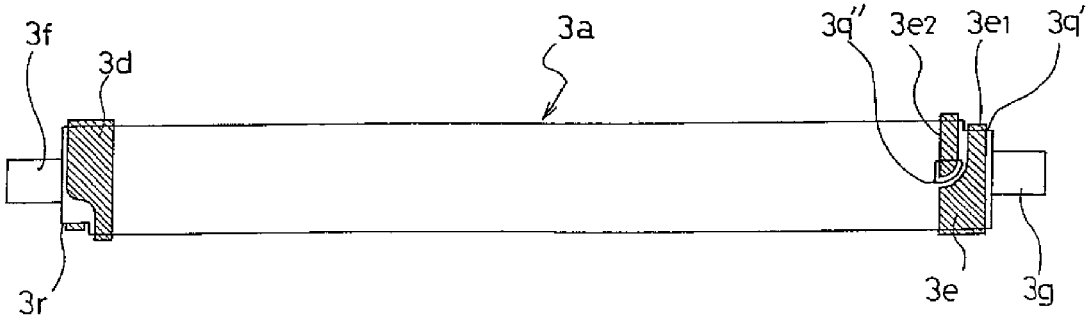
FIG. 27C is an illustration schematically showing still another variation of the charging roller of the eighteenth and nineteenth embodiments.

Though the first entrance side concavity of the first gap member 3*d* and the second entrance side concavity of the second gap member 3*e* are formed at the same position (in the same phase) in the circumferential direction of the charging roller 3*a* and the first exit side concavity of the first gap member 3*d* and the second exit side concavity of the second gap member 3*e* are formed at the same position in the circumferential direction of the charging roller 3*a* in any of the image forming apparatuses of the aforementioned embodiments, the invention is not limited thereto and the respective concavities of the first and second gap members 3*d*, 3*e* may be formed at different positions (in different phases) shifting in the circumferential direction of the charging roller 3*a*. For example, as shown in FIGS. 27A through 27C, the first entrance side concavity 3*q*' of the first gap member 3*d* and the second entrance side concavity 3*q*' of the second gap member 3*e* are formed in phases shifting by 180° in the circumferential direction from each other and the first exit side concavity (not shown) of the first gap member 3*d* and the second exit side concavity 3*q*" of the second gap member 3*w* are formed in phases shifting by 180° in the circumferential direction from each other.

The respective concavities of the first and second gap members 3*d*, 3*e* are formed in different phases shifting in the circumferential direction of the charging roller 3*a*, thereby further preventing adverse effect of joint portions of the first and second gap members $3d_1$ 3*e* and thus setting the charge gap G to be further uniform and stable in the axial direction of the charging roller 3*a*.

Hereinafter, tests which have been conducted for demonstrating the aforementioned works and effects of the charging roller 3*a* and the image forming apparatus 1 of the invention will be described with reference to examples belonging to the invention and comparative examples not belonging to the invention.

Conditions of charging rollers of image forming apparatuses of the examples and the comparative examples used in the tests, and results of the tests are shown in Table 7.

TABLE 7

| Test No. | Charging roller | G configuration | Spring pressure (gf) | Depth of sponge (mm) | Number of sheets before defect | Result | Remarks |
|---|---|---|---|---|---|---|---|
| 97 | Coated with conductive coating material | No. 1 | 200 | 0.2 | No defect in 20,000 sheets | G | |
| 98 | Coated with conductive coating material | No. 1 | 500 | 0.2 | No defect in 20,000 sheets | G | |
| 99 | Coated with conductive coating material | No. 1 | 800 | 0.5 | No defect in 20,000 sheets | G | |
| 100 | Coated with conductive coating material | No. 1 | 500 | 0.5 | No defect in 20,000 sheets | G | |
| 101 | Coated with conductive coating material | No. 2 | 200 | 0.5 | No defect in 20,000 sheets | G | |
| 102 | Coated with conductive coating material | No. 2 | 800 | 0.7 | No defect in 20,000 sheets | G | |
| 103 | Coated with conductive coating material | No. 2 | 200 | 0.7 | No defect in 20,000 sheets | G | |
| 104 | Coated with conductive coating material | No. 2 | 500 | 0.3 | No defect in 20,000 sheets | G | |
| 105 | Coated with conductive coating material | No. 3 | 500 | 0.5 | 144 | NG | Unsticking of gap tape |
| 106 | Coated with conductive coating material | No. 3 | 500 | 0.2 | 145 | NG | Unsticking of gap tape |
| 107 | Covered by heat shrinkable tube | No. 1 | 200 | 0.2 | No defect in 20,000 sheets | G | |
| 108 | Covered by heat shrinkable tube | No. 1 | 500 | 0.2 | No defect in 20,000 sheets | G | |
| 109 | Covered by heat shrinkable tube | No. 1 | 800 | 0.5 | No defect in 20,000 sheets | G | |

TABLE 7-continued

| Test No. | Charging roller | G configuration | Spring pressure (gf) | Depth of sponge (mm) | Number of sheets before defect | Result | Remarks |
|---|---|---|---|---|---|---|---|
| 110 | Covered by heat shrinkable tube | No. 1 | 500 | 0.5 | No defect in 20,000 sheets | G | |
| 111 | Covered by heat shrinkable tube | No. 2 | 200 | 0.5 | No defect in 20,000 sheets | G | |
| 112 | Covered by heat shrinkable tube | No. 2 | 800 | 0.7 | No defect in 20,000 sheets | G | |
| 113 | Covered by heat shrinkable tube | No. 2 | 200 | 0.7 | No defect in 20,000 sheets | G | |
| 114 | Covered by heat shrinkable tube | No. 2 | 500 | 0.3 | No defect in 20,000 sheets | G | |
| 115 | Covered by heat shrinkable tube | No. 3 | 500 | 0.5 | 157 | NG | Unsticking of gap tape |
| 116 | Covered by heat shrinkable tube | No. 3 | 500 | 0.2 | 336 | NG | Unsticking of gap tape |

In table 7, each of photoconductors 2 used in the tests No. 97 through No. 116 is a photoconductor of a printer LP-9000C manufactured by Seiko Epson Corporation, without being remodeled. The photoconductor is a photoconductor comprising an aluminum tube and a photoconductive layer which is formed by coating an organic photoreceptor on the peripheral surface. Any of the photoconductors 2 was selected to have run-out accuracy of 0.01 or less.

As the charging device 3, a scorotron charging device which was remodeled to fit up a charging roller 3*a* having a diameter of 11 mm was used instead of the charging device of the aforementioned printer LP-9000C.

Each of charging rollers 3*a* used in the tests Nos. 97 through 116 is a roller comprising a metal core coated with conductive coating material. The charging roller 3*a* uses a metal shaft of 11 mm in diameter comprising a SUM22 with Ni plating on the surface thereof as the metal core and is processed to have such a configuration to be installed to a remodeled machine of the aforementioned printer LP-9000C. In the tests Nos. 97 through 104, the metal shaft is provided with concavities which are formed at predetermined positions of the end portions of the metal shaft. In the tests Nos. 105 and 106, the metal shaft is provided with no concavities similarly to the conventional example. The metal shafts were processed by centerless grinding to have run-out accuracy of 0.01 or less.

In the same manner as the aforementioned tests, a resistive layer of 20 μm in film thickness was formed on the peripheral surface, containing the concavities, of the metal shaft. The electro-conductive $SnO_2$ used in the examples and the comparative examples is Trade name "T-1" of Jemco Inc indicated in Table 2. The "T-1" is tin-antimony oxides. The ion conductive material used in the examples and comparative examples is "YYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

Each of charging rollers 3*a* used in the tests Nos. 107 through 116 is a roller comprising a metal core covered by a heat shrinkable tube. The metal core of the charging roller 3*a* is the same metal shaft as the metal shaft of the aforementioned roller coated with conductive material. In the tests Nos. 107 through 114, the metal shaft is provided with concavities which are formed at predetermined positions of the end portions of the metal shaft. In the tests Nos. 115 and 116, the metal shaft is provided with no concavities similarly to the conventional example.

The peripheral surface, containing the concavities, of the metal shaft was covered by a commercially available heat shrinkable tube (Super Tere tube; available from Teijin Chemicals Ltd.) and, after that, was heated to shrink the tube, thereby manufacturing an electro-conductive roller. The Super Tere tube contains conductive carbon black as conducting material and polyester resin as binder. The mixing ratio of the conductive carbon black relative to the polyester resin is 1:8. The conductive heat shrinkable tube of 20 μm in thickness used in the tests was cut through and opened on an aluminum plate so as to prepare a test piece. The volume resistivity of the test piece was measured and the result was $(1.0–7.0)\times10^{10}$ Ωcm.

The gap members 3*d*, 3*e* were formed by sticking a tape (Tape No. 610K; available from Teraoka Seisakusho Co., Ltd.) made of polyester resin having a film thickness of 20 μm and a width of 5 mm onto the peripheral surfaces of both end portions of the charging roller 3*a*.

Figure 34B:
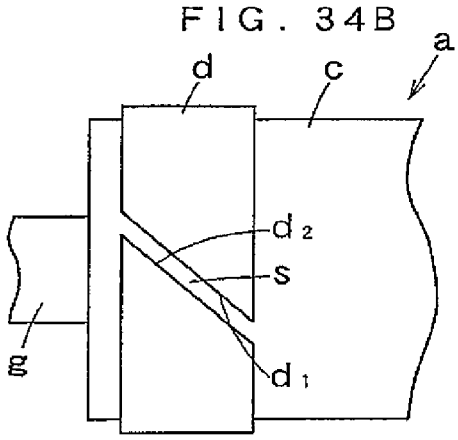
PRIOR ART FIG. 34B
FIG. 34B is a partial enlarged view of an example of a gap member of the conventional image forming apparatus shown in FIG. 34A.
Figure 34E:
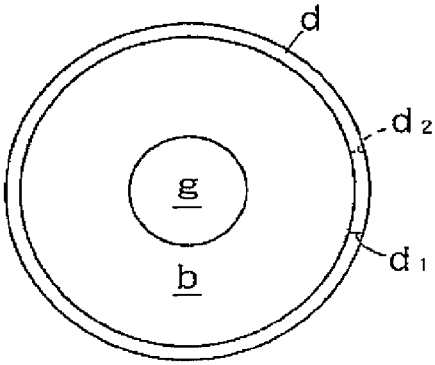
PRIOR ART FIG. 34E
FIG. 34E is a left side view of the gap member shown in FIG. 34D.
Figure 34D:
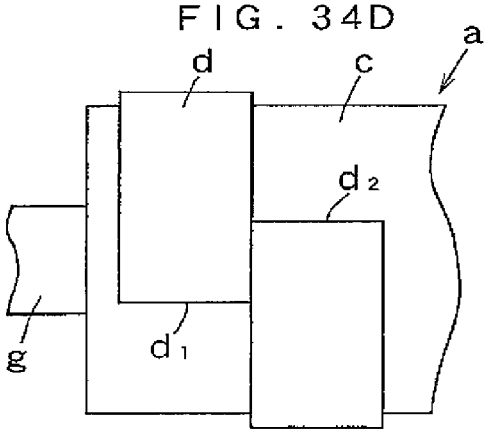
PRIOR ART FIG. 34D
FIG. 34D is a partial enlarged view of another example of the gap member of the conventional image forming apparatus shown in FIG. 34A.

As for the configuration of the gap members 3*d*, 3*e* and the configuration of the concavities, the configuration shown in FIGS. 23A, 23B (G configuration No. 1) was employed in the tests Nos. 97 through 100 and 107 through 110, the configuration shown in FIGS. 24A, 24B (G configuration No. 2) was employed in the tests Nos. 101 through 104 and 111 through 114, and the configuration of the gap members 3*d*, 3*e* shown in FIG. 34B without concavities (G configuration No. 3) was employed in the tests Nos. 105, 106, 115, and 116.

In the G configuration No. 1, four concavities are each formed into a D-like cut shape of which maximum depth is 0.5 mm and each end of the polyester resin tape to be fixed to each concavity is set to have a width of 2 mm and a length of 4 mm. In the G configuration No. 2, four concavities are each formed into an inverted truncated cone shape of which maximum depth is 0.5 mm, upper circle is 4.5 mm in diameter, and lower circle is 3.0 mm in diameter such that the centers of these circles are positioned at 2.5 mm from the end of the charging roller 3*a*. Each end of the polyester resin tape to be fixed to each concavity is set to have a width of 2 mm and a length of 2.5 mm. In the G configuration No. 3, each end of the polyester resin tape is cut to be inclined at 45° relative to the longitudinal direction of the polyester resin tape.

One end portion of each gap member 3*d*, 3*e* (on a side entering into the contact portion between the photoconductor and the gap member) was partially fixed to the entrance side concavity such that the one end portion extends to put its tip in the rotational direction ϵ of the charging roller and, after that, the gap member 3*d*, 3*e* was wrapped nearly a circuit around and fixed to the peripheral surface of the charging roller, and further, the other end portion of the gap member 3*d*, 3*e* (on a side exiting from the contact portion between the photoconductor and the gap member) is partially fixed to the exit side concavity.

As the pressing method, the charging roller 3*a* was pressed by applying load (spring pressure) of compression springs 3*o*, 3*p* onto bearings 3*m*, 3*n* (at 10 mm distance from the outer edges of the gap members 3*d*, 3*e*) of the rotary shafts 3*f*, 3*g*.

The load (spring pressure) of the compression springs 3*o*, 3*p* was 200 gf in the tests Nos. 97, 101, 103, 107, 111, and 113, 500 gf in the tests Nos. 98, 100, 104 through 106, 108, 110, and 114 through 116, and 800 gf in the tests Nos. 99, 102, 109, and 112.

The charging roller 3*a* was pressed by sponge of the cleaning member 3*h* as shown in FIG. 22. In this case, the pressing force of the sponge was extremely small as compared to the pressing force of the compression springs 3*o*, 3*p*. The cleaning member 3*h* employed a cylindrical urethane sponge (Trade name "EPT-51" available from Bridgestone Kaseihin Tokyo Co., Ltd.). The urethane sponge had an outer diameter of 10 mm and an inner diameter 5 mm and was set to have a contact depth within a range from 0.2 mm to 0.7 mm relative to the charging roller 3*a* and to have a run-out tolerance ±0.1.

The contact depth of the sponge was 0.2 mm in the tests Nos. 97, 98, 106 through 108, and 116, 0.5 mm in the tests Nos. 99 through 101, 105, 109 through 111, and 115, 0.7 mm in the tests Nos. 102, 103, 112, and 113, and 0.3 mm in the tests Nos. 104 and 114.

The driving method for the photoconductor 2, the charging roller 3*a*, and the cleaning member 3*h* was the method of directly driving the charging roller 3*a* as shown in FIG. 22 in the odd-numbered tests and the method of indirectly driving the charging roller 3*a* as shown in FIG. 26 in the even-numbered tests.

As apparent from the above, the tests Nos. 97 through 104 and 107 through 114 are the examples of the invention, while the tests Nos. 105, 106, 115, and 116 are the comparative examples of the invention.

Other components (developing device, transfer device, and the like) of the apparatuses for the tests for the image forming apparatus were components of the aforementioned printer LP-9000C.

For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=800-1000V, f=1.0-1.3 nHz, $V_{AC}$ is sin wave), that is, a voltage composed of components $V_{DC}$(V) of direct current voltage DC and components $V_{AC}$(V) of alternative current voltage AC which are superimposed on the components $V_{DC}$. The tests were carried out under indoor condition with temperature of 23° C. and humidity of 50% by printing continuous 20,000 sheets of A4 size plain paper each on which half tone monochrome toner image of 25% concentration was formed.

The $50^{th}$, $100^{th}$, $500^{th}$, $1,000^{th}$, $5,000^{th}$, $10,000^{th}$, and $20,000^{th}$ printed sheets of paper were picked up and observed with human eyes. When no defect was found in 20,000 printed sheets, it was determined as good charge. In this case, "G" is indicated on Table 7. When defect was found in printed sheets before 20,000 sheets, it was determined as no-good charge. In this case, "G" is indicated on Table 7.

With any of the image forming apparatuses of the examples in the tests Nos. 97 through 104 and 107 through 114, it was determined that good charge was obtained, i.e. "G". In the comparative example in the test No. 105, defect was found in the $144^{th}$ printed sheet. In the comparative example in the test No. 106, defect was found in the $145^{th}$ printed sheet. In the comparative example in the test No. 115, defect was found in the $157^{th}$ printed sheet. In the comparative example in the test No. 116, defect was found in the $336^{th}$ printed sheet. The respective results were "NG". As the gap members of the charging rollers of these tests were looked carefully, it was found that tips of the tapes of the gap members unstuck and rode up. Foreign matters such as toner particles adhered to each rode-up portion of the gap member so as to make the charge gap G at the rode-up portion to have 40 μm (20×2 μn) at a maximum. Accordingly, the charge gap G could not be maintained a certain value or less so as to cause discharge failure.

The aforementioned tests demonstrated that, in non-contact charge on the photoconductor 2 by the charging roller 3*a*, the aforementioned works and effects of the invention can be obtained by preventing the one end portions of the gap members 3*d*, 3*e* on the side entering into the contact portion between the photoconductor 2 and the charging roller 3*a* and the other end portions of the gap members 3*d*, 3*e* on the side exiting from the contact portion between the photoconductor 2 and the charging roller 3*a* from having contact with the photoconductor 2.

Figure 28A:
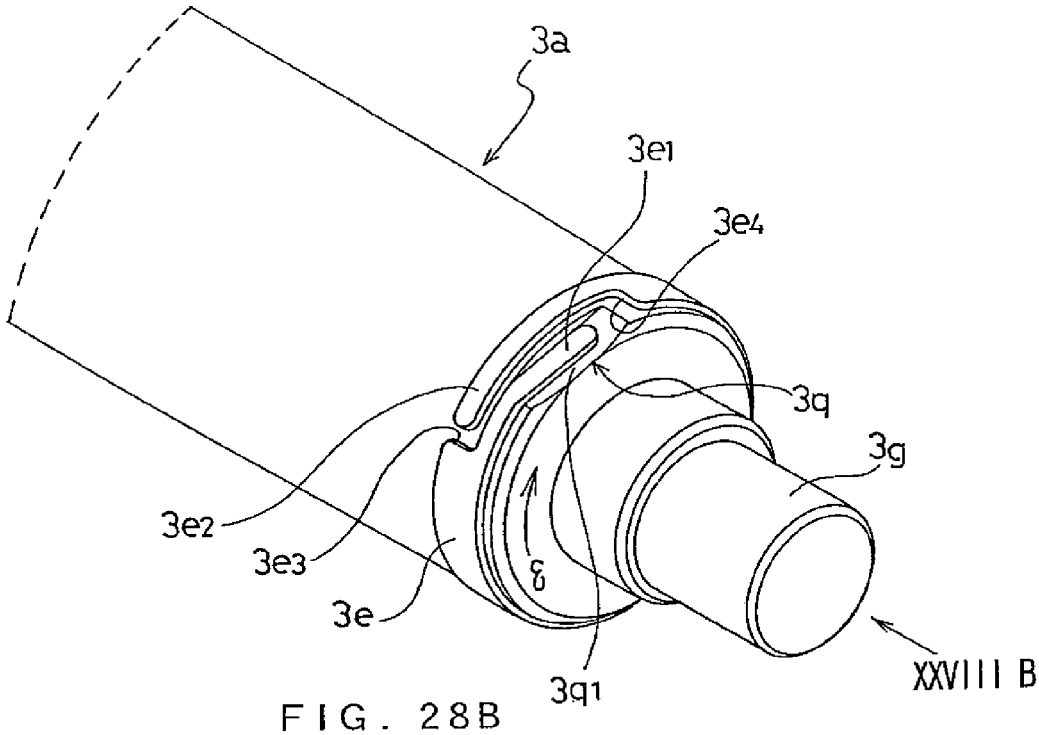
FIG. 28A is a perspective view schematically and partially showing an image forming apparatus of a twentieth embodiment according to the invention.
Figure 28B:
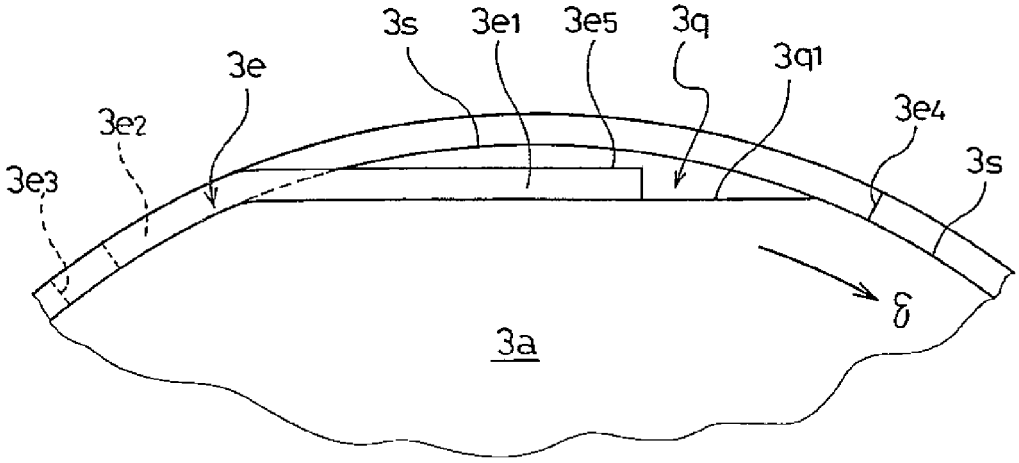
FIG. 28B is a view taken along a direction XXVIIIB in FIG. 28A.

FIG. 28A is a perspective view schematically and partially showing an image forming apparatus of a twentieth embodiment according to the invention and FIG. 28B is a view taken along a direction XXVIIIB in FIG. 28A.

Though the charging roller 3*a* is provided with the second entrance side concavity 3*q*' and the second exit side concavity 3*q*" in the aforementioned eighteenth embodiment shown in FIGS. 23A and 23B, a charging roller 3*a* is provided only with a concavity 3*q* corresponding to the second entrance side concavity 3*q*' of the eighteenth embodiment and not provided with the second exit side concavity 3*q*" in the image forming apparatus of the twentieth embodiment as shown in FIGS. 28A and 28B.

That is, at the position of the peripheral surface of the end portion of the charging roller 3*a* where the gap member 3*e* is fixed, the peripheral surface of the metal core 3*b* is partially cut away into a flat chord-like shape so that the resistive layer 3*c* is exposed on the surface of the cutaway portion, thereby forming a concavity 3*q* in the peripheral surface of the charging roller 3*a*. The concavity 3*q* is a D-like cut portion having a D-like shape as seen in the axial direction of the charging roller 3*a* and corresponds to the gap member end portion contact-preventing means of the invention.

The other gap member 3*d* is formed symmetrically with and to be exactly identical with the gap member 3*e*, but not shown. Therefore, the concavity to which the one end portion of the first gap member 3*d*, corresponding to the one end portion $3e_1$, is fixed in the sticking manner is formed at the same position (in the same phase) in the circumferential direction as the concavity 3*q*' of the one end portion $3e_1$. (That is, the respective one end portions of the first and second gap members 3*d*, 3*e* are overlapped in the axial direction of the charging roller 3*a*.)

Other structure and other works and effects of the image forming apparatus 1 and the charging roller 3*a* of the twentieth embodiment are the same as those of the aforementioned eighteenth embodiment shown in FIGS. 23A and 23B.

Figure 29A:
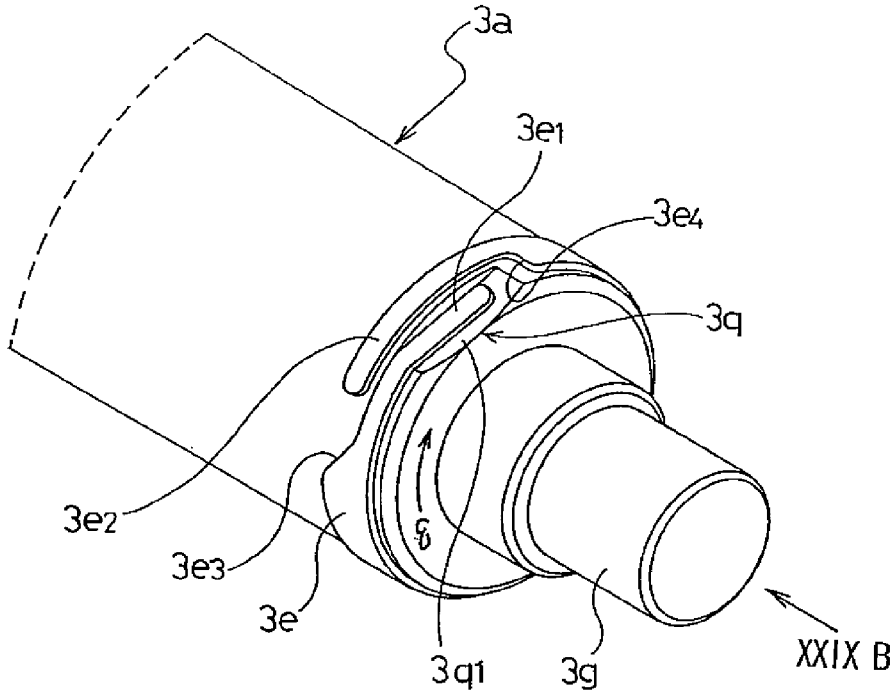
FIG. 29A is a perspective view schematically and partially showing a charging roller of an image forming apparatus of a twenty-first embodiment according to the invention.
Figure 29B:
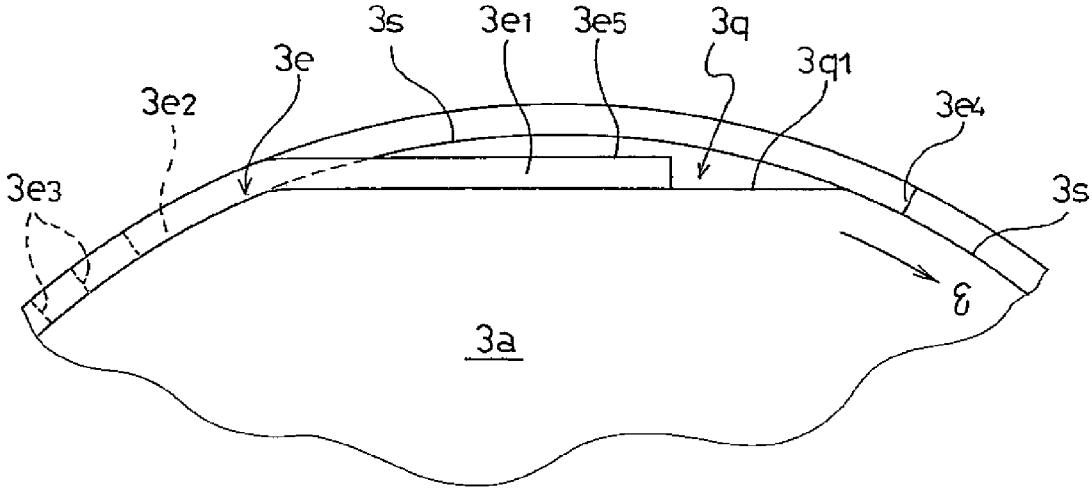
FIG. 29B is a view taken along a direction XXIXB in FIG. 29A.

FIG. 29A is a perspective view similar to FIG. 28A but schematically and partially showing a charging roller of an image forming apparatus of a twenty-first embodiment according to the invention and FIG. 29B is a view taken along a direction XXIXB in FIG. 29A.

Though the step $3e_3$ on the side of the one end portion $3e_1$ of the gap member 3*e* extends in the axial direction of the charging roller 3*a* in the aforementioned twentieth embodiment shown in FIGS. 28A and 28B, a step $3e_3$ on the side of one end portion $3e_1$ of a gap member is inclined from the root of the step $3e_3$ toward the other end portion $3e_2$ relative to the axial direction of the charging roller 3*a* in the twenty-first embodiment as shown in FIGS. 29A and 29B. By making the step $3e_3$ on the side of the one end portion to be inclined from the root of the step $3e_3$ toward the other end portion $3e_2$, the step $3e_3$ is further prevented from unsticking over the long term even when the step $3e_3$ enters into the nip portion relative to the photoconductor 2. The other gap member 3*d* is formed symmetrically with and to be exactly identical with the gap member 3*e*.

Other structure and other works and effects of the image forming apparatus 1 in the twenty-first embodiment are the same as those of the aforementioned twentieth embodiment shown in FIGS. 28A and 28B.

Figure 30A:
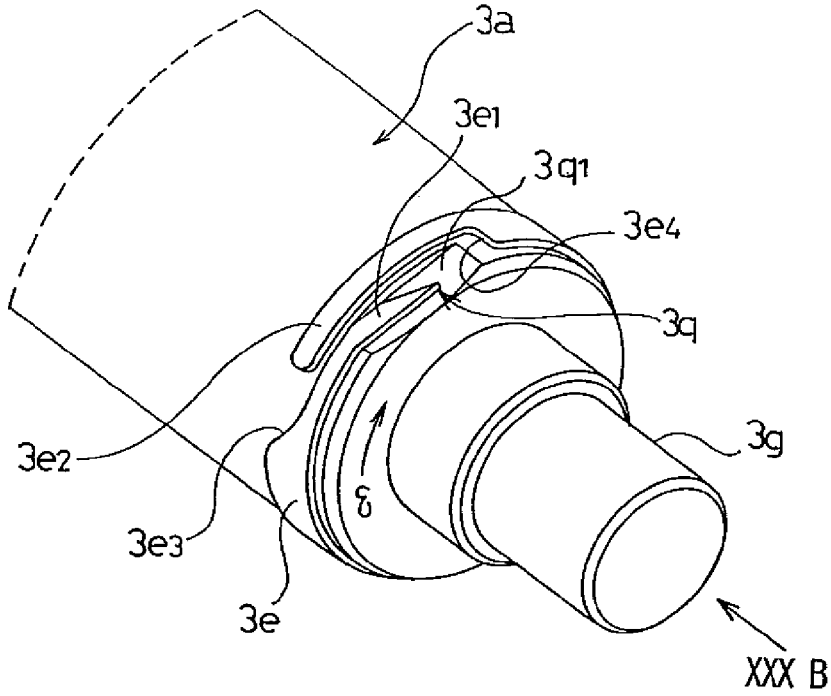
FIG. 30A is a perspective view schematically and partially showing a charging roller of an image forming apparatus of a twenty-second embodiment according to the invention.
Figure 30B:
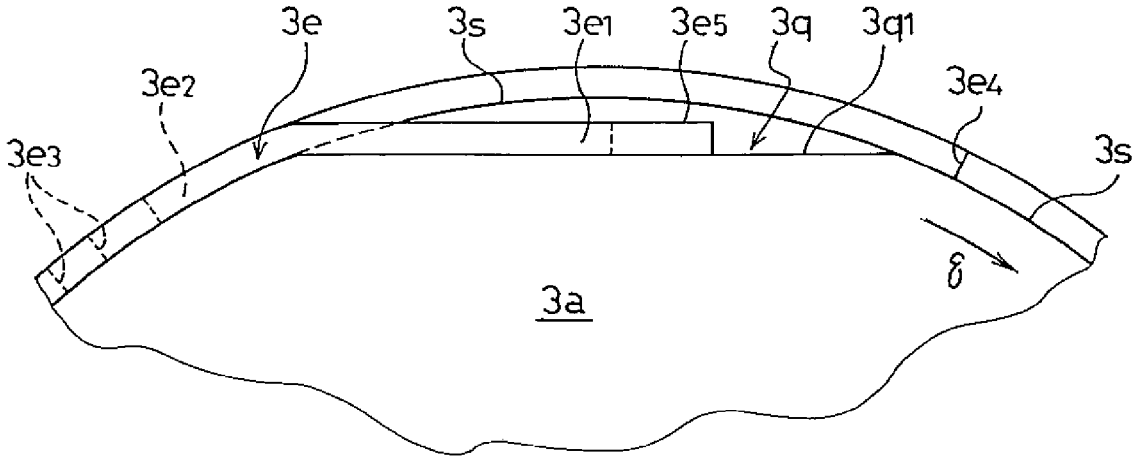
FIG. 30B is a view taken along a direction XXXB in FIG. 30A.

FIG. 30A is a perspective view similar to FIG. 28A but schematically and partially showing a charging roller of an image forming apparatus of a twenty-second embodiment according to the invention and FIG. 30B is a view taken along a direction XXXB in FIG. 30A.

Though the end of the one end portion $3e_1$ of the gap member 3*e* is cut in the axial direction of the charging roller 3*a* in the aforementioned twenty-first embodiment shown in FIGS. 29A and 29B, the end of one end portion $3e_1$ of a gap member 3*e* is cut to be inclined relative to the axial direction of the charging roller 3*a* within a range of the concavity 3*q* in the twenty-second embodiment as shown in FIGS. 30A and 30B. In this case, the end of the one end portion $3e_1$ is inclined toward the other end portion $3e_2$ in a direction from the right edge to the left edge of the one end portion $3e_1$ in the illustrated example. However, the invention is not limited thereto and the inclination direction may be a direction opposite to the aforementioned direction. The other gap member 3*d* is formed symmetrically with and to be exactly identical with the gap member 3*e*.

Other structure and other works and effects of the image forming apparatus 1 of the twenty-second embodiment are the same as those of the aforementioned twenty-first embodiment shown in FIGS. 29A and 29B.

Figure 31A:
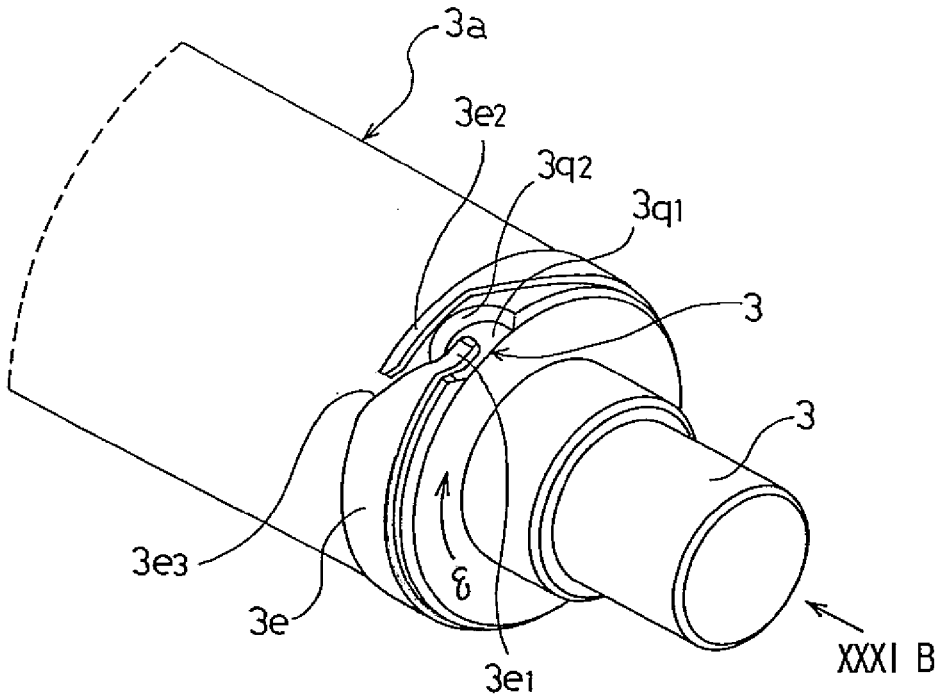
FIG. 31A is a perspective view schematically and partially showing a charging roller of an image forming apparatus of a twenty-third embodiment according to the invention.
Figure 31B:
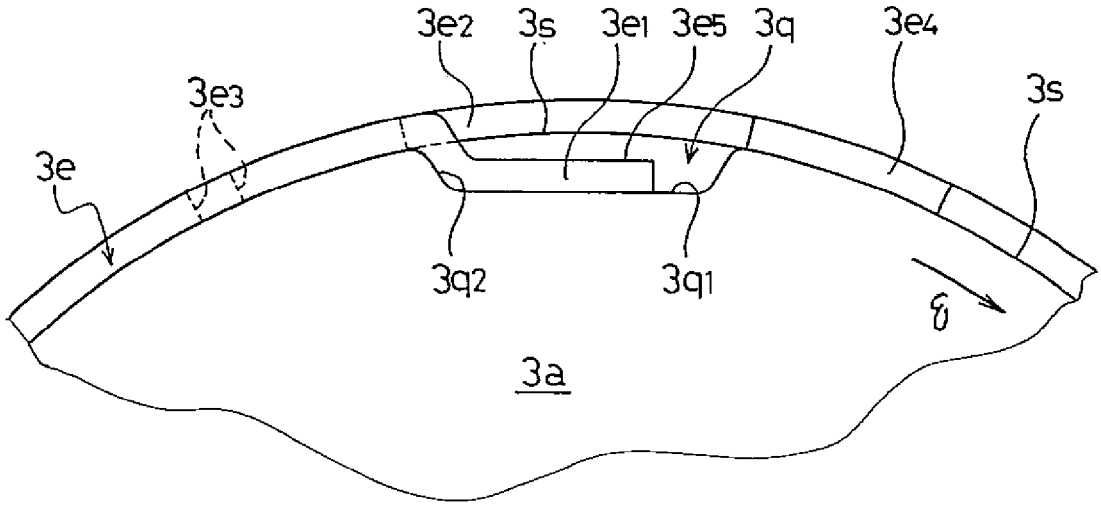
FIG. 31B is a view taken along a direction XXXIB in FIG. 31A.

FIG. 31A is a perspective view similar to FIG. 28A but schematically and partially showing a charging roller of an image forming apparatus of a twenty-third embodiment according to the invention and FIG. 31B is a view taken along a direction XXXIB in FIG. 31A.

Though the concavity 3*q* is formed by cutting the peripheral surface of the charging roller 3*a* into a flat chord-like shape in the aforementioned twenty-first embodiment shown in FIGS. 29A and 298, a concavity 3*q* is formed into an inverted truncated cone shape in the charging roller 3*a* of the twenty-third embodiment as shown in FIGS. 31A and 31B. A portion of one end portion $3e_1$ is fixed to a flat surface $3q_1$ as the bottom surface of the concavity 3*q* and a slope $3q_2$ of the inverted truncated cone shape in the sticking manner. In addition, the end of the other end portion $3e_2$ and a step $3e_4$ on the side of the other end portion $3e_2$ are formed to extend in parallel with or substantially parallel with the step $3e_3$. The other gap member 3*d* is formed symmetrically with and to be exactly identical with the gap member 3*e*.

Other structure and other works and effects of the image forming apparatus 1 of the twenty-third embodiment are the same as those of the aforementioned twenty-first embodiment shown in FIGS. 29A and 29B.

Figure 32A:
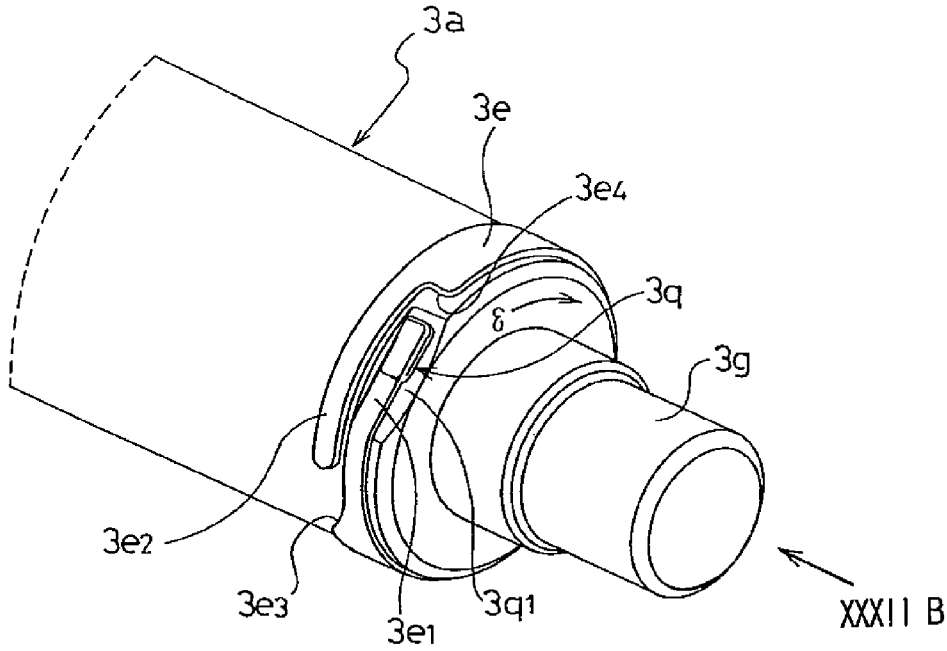
FIG. 32A is a perspective view schematically and partially showing a charging roller of an image forming apparatus of a twenty-fourth embodiment according to the invention.
Figure 32B:
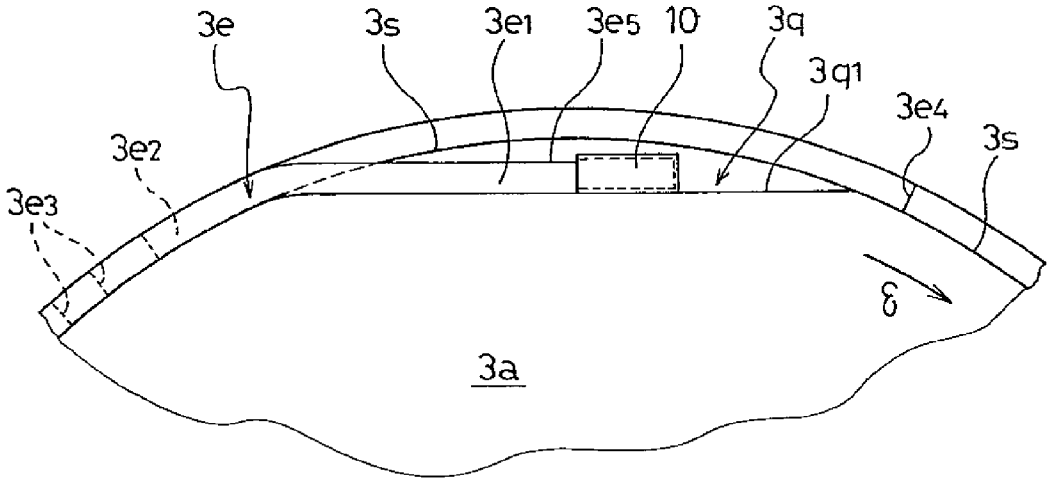
FIG. 32B is a view taken along a direction XXIB in FIG. 32A.

FIG. 32A is a perspective view similar to FIG. 28A but schematically and partially showing a charging roller of an image forming apparatus of a twenty-fourth embodiment according to the invention and FIG. 32B is a view taken along a direction XXXIIB in FIG. 32A.

Though the end of the one end portion $3e_1$ of the gap member 3*e* is fixed to the surface $3q_1$ of the concavity 3*q* of the charging roller 3*a* in the sticking manner in the aforementioned twenty-first embodiment shown in FIGS. 29A and 29B, an end of one end portion $3e_1$ of a gap member 3*e* is fixed to a surface $3q_1$ of a concavity 3*q* of the charging roller 3*a* with adhesive 10 in the twenty-fourth embodiment as shown in FIGS. 32A and 32B. The other portion of the gap member 3*e* is fixed to the charging roller 3*a* in the sticking manner similarly to the aforementioned embodiments. The other gap member 3*d* is formed symmetrically with and to be exactly identical with the gap member 3*e*. By fixing the end of the one end portion $3e_1$ is fixed to the surface $3q_1$ of the concavity 3*q* with adhesive 10, the one end portion $3e_1$ is further firmly fixed to the charging roller 3*a* and is thus prevented from being unsticking.

Other structure and other works and effects of the image forming apparatus 1 of the twenty-fourth embodiment are the same as those of the aforementioned twenty-first embodiment shown in FIGS. 29A and 29B.

Though the concavity 3*q* of the charging roller 3*a* is formed to have a flat surface $3q_1$ to which the one end portion $3e_1$ is fixed in any of the aforementioned embodiments shown in FIGS. 28A through 30B and FIGS. 32A and 32B, the invention is not limited thereto. For example, as shown in FIG. 25, the surface $3q_1$ to which the one end portion $3e_1$ is fixed may be formed into an arc shape to have a deep middle portion. Similarly, the bottom surface $3q_1$ of the concavity 3*q* of the inverted truncated cone shape in the charging roller 3*a* of the embodiment shown in FIGS. 31A and 31B may be formed into an arc shape.

Though the charging roller 3*a* is directly rotated by the photoconductor driving gear 11 for the photoconductor 2 via the charging roller driving gear 14 as shown in FIG. 22 in any of the image forming apparatuses 1 of the aforementioned embodiments, the invention is not limited thereto and the charging roller 3*a* may be rotated by friction relative to the photoconductor 2 and the cleaning member 3*h* according to the rotation of the photoconductor 2 and the cleaning member 3*h* as shown in FIG. 26.

Figure 33A:
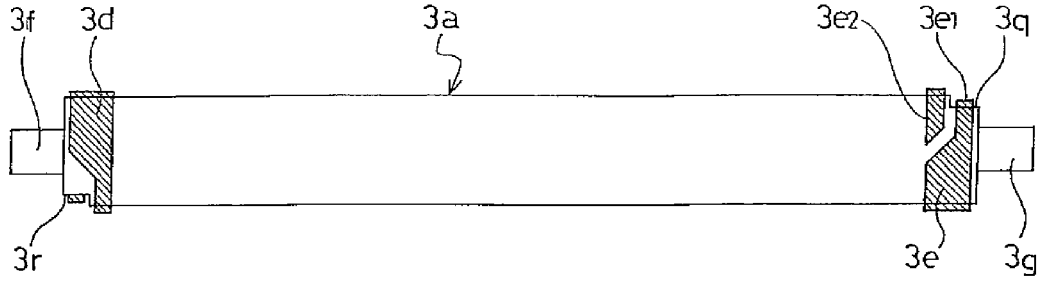
FIG. 33A is an illustration schematically showing a variation of the charging roller of the twentieth through twenty-fourth embodiments.
Figure 33B:
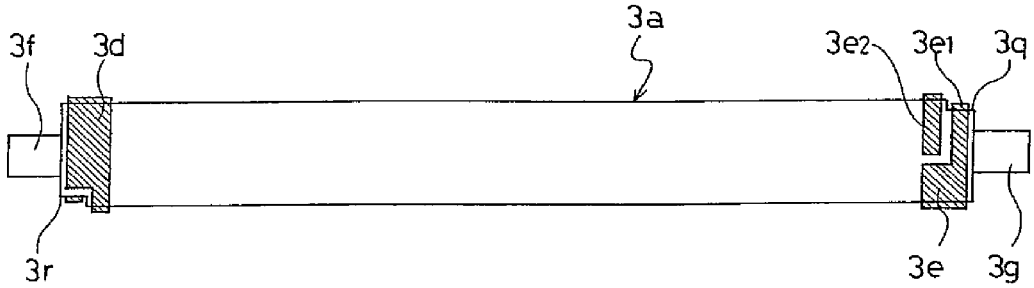
FIG. 33B is an illustration schematically showing another variation of the charging roller of the twentieth through twenty-fourth embodiments.
Figure 33C:
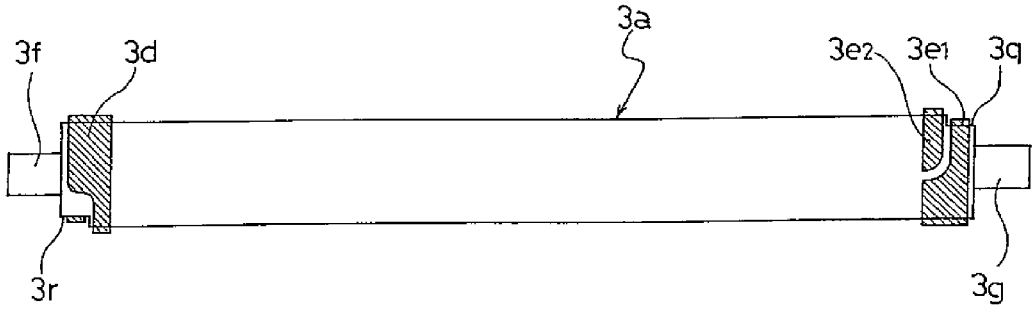
FIG. 33C is an illustration schematically showing still another variation of the charging roller of the twentieth through twenty-fourth embodiments.

Though the respective concavities of the pair of gap members 3*d*, 3*e* are formed at the same position (in the same phase) in the circumferential direction of the charging roller 3*a* in any of the image forming apparatuses 1 of the aforementioned embodiments, the invention is not limited thereto and the respective concavities of the gap members 3*d*, 3*e* may be formed at different positions (in different phases) shifting in the circumferential direction of the charging roller 3*a*. For example, as shown in FIGS. 33A through 33C, the concavity 3*r* of the gap member 3*d* and the concavity 3*q* of the gap member 3*e* are formed in phases shifting by 180° in the circumferential direction from each other. The configuration of the joint portion shown in FIG. 33A corresponds to the twenty-third embodiment shown in FIGS. 31A and 31B and the configuration of the joint portion shown in FIG. 33B corresponds to the twentieth embodiment shown in FIGS. 28A and 28B. The configuration of the joint portion shown in FIG. 33C is such a configuration that the corner between the one end portion $3e_1$ and the step $3e_3$ and the corner between the other end portion $3e_2$ and the step $3e_4$ in the twentieth embodiment shown in FIGS. 28A and 28B are rounded (curved).

The respective concavities 3*r*, 3*q* of the gap members 3*d*, 3*e* are formed in different phases shifting in the circumferential direction of the charging roller 3*a*, thereby further preventing adverse effect of joint portions of the gap members 3*d*, 3*e* and thus setting the charge gap G to be further uniform and stable in the axial direction of the charging roller 3*a*.

Hereinafter, tests which have been conducted for demonstrating the aforementioned works and effects of the charging roller 3*a* and the image forming apparatus 1 of the invention will be described with reference to examples belonging to the invention and comparative examples not belonging to the invention.

Conditions of charging rollers of image forming apparatuses of the examples and the comparative examples used in the tests, and results of the tests are shown in Table 8.

In the same manner as the aforementioned tests, a resistive layer of 20 μm in thickness was formed on the peripheral surface, containing the concavities, of the metal shaft. The electro-conductive $SnO_2$ used in the examples and the comparative examples is Trade name "T-1" of Jemco Inc indicated in Table 2. The "T-1" is tin-antimony oxides. The ion conductive material used in the examples and comparative examples is "YYYP-12" (available from Marubishi Oil Chemical Co., Ltd.). The aforementioned coating liquid used in the tests was coated on an aluminum plate to form a film of 20 μm in thickness. The volume resistivity of the film was measured and the result was $(1.0–5.0)\times10^{10}$ Ωcm.

Each of charging rollers 3*a* used in the tests Nos. 127 through 136 is a roller comprising a metal core covered by a heat shrinkable tube. The metal core of the charging roller 3*a* is the same metal shaft as the metal core of the aforementioned roller coated with conductive material. In the tests Nos. 127 through 130 and Nos. 132 through 135, the metal shaft is provided with concavities which are formed at predetermined positions of the end portions of the metal shaft. In the tests Nos. 131 and 136, the metal shaft is provided with no concavities similarly to the conventional example.

The peripheral surface, containing the concavities, of the metal shaft was covered by a commercially available heat shrinkable tube (Super Tere tube; available from Teijin Chemicals Ltd.) and, after that, was heated to shrink the tube, thereby manufacturing an electro-conductive roller. The

TABLE 8

| Test No. | Charging roller | G configuration | Spring pressure (gf) | Depth of sponge (mm) | Number of sheets before defect | Result | Remarks |
|---|---|---|---|---|---|---|---|
| 117 | Coated with conductive coating material | No. 1 | 200 | 0.2 | No defect in 10,000 sheets | G | |
| 118 | Coated with conductive coating material | No. 2 | 500 | 0.2 | No defect in 10,000 sheets | G | |
| 119 | Coated with conductive coating material | No. 3 | 800 | 0.5 | No defect in 10,000 sheets | G | |
| 120 | Coated with conductive coating material | No. 4 | 500 | 0.5 | No defect in 10,000 sheets | G | |
| 121 | Coated with conductive coating material | No. 5 | 200 | 0.5 | No defect in 10,000 sheets | G | |
| 122 | Coated with conductive coating material | No. 6 | 800 | 0.7 | No defect in 10,000 sheets | G | |
| 123 | Coated with conductive coating material | No. 2 | 200 | 0.7 | No defect in 10,000 sheets | G | |
| 124 | Coated with conductive coating material | No. 3 | 500 | 0.3 | No defect in 10,000 sheets | G | |
| 125 | Coated with conductive coating material | No. 4 | 500 | 0.5 | No defect in 10,000 sheets | G | |
| 126 | Coated with conductive coating material | No. 5 | 500 | 0.2 | 122 | NG | Unsticking of gap tape |
| 127 | Covered by heat shrinkable tube | No. 1 | 200 | 0.2 | No defect in 10,000 sheets | G | |
| 128 | Covered by heat shrinkable tube | No. 2 | 500 | 0.2 | No defect in 10,000 sheets | G | |
| 129 | Covered by heat shrinkable tube | No. 3 | 500 | 0.5 | No defect in 10,000 sheets | G | |
| 130 | Covered by heat shrinkable tube | No. 4 | 500 | 0.5 | No defect in 10,000 sheets | G | |
| 131 | Covered by heat shrinkable tube | No. 5 | 200 | 0.5 | No defect in 10,000 sheets | G | |
| 132 | Covered by heat shrinkable tube | No. 6 | 800 | 0.7 | No defect in 10,000 sheets | G | |
| 133 | Covered by heat shrinkable tube | No. 2 | 200 | 0.7 | No defect in 10,000 sheets | G | |
| 134 | Covered by heat shrinkable tube | No. 3 | 500 | 0.3 | No defect in 10,000 sheets | G | |
| 135 | Covered by heat shrinkable tube | No. 4 | 500 | 0.5 | No defect in 10,000 sheets | G | |
| 136 | Covered by heat shrinkable tube | No. 5 | 500 | 0.2 | 96 | NG | Unsticking of gap tape |

In table 8, photoconductors 2, charging devices 3, charging rollers 3*a*, image forming apparatus for conducting tests used in the tests No. 117 through No. 136 are the same as used in the aforementioned tests No. 97 through No. 116. In the tests Nos. 117 through 120 and Nos. 122 through 125, the metal shaft is provided with concavities formed at predetermined positions of both end portions thereof. In the tests Nos. 121 and 126, the metal shaft is provided with no concavities similarly to the conventional example. The metal shafts were processed by centerless grinding to have run-out accuracy of 0.01 or less.

Super Tere tube contains conductive carbon black as conducting material and polyester resin as binder. The mixing ratio of the conductive carbon black relative to the polyester resin is 1:8. The conductive heat shrinkable tube of 20 μm in thickness used in the tests was cut through and opened on an aluminum plate so as to prepare a test piece. The volume resistivity of the test piece was measured and the result was $(1.0\text{-}7.0)\times10^{10}$ Ωcm.

The gap members 3*d*, 3*e* were formed by sticking a tape (Tape No. 610K; available from Teraoka Seisakusho Co., Ltd.) made of polyester resin having a film thickness of 20 μm and a width of 5 mm onto the peripheral surfaces of both end portions of the charging roller 3*a*. As for the configuration of the gap members 3*d*, 3*e* and the configuration of the concavities, the configuration shown in FIGS. 28A, 28B (G configuration No. 1) was employed in the tests Nos. 117 and 127, the configuration shown in FIGS. 29A, 29B (G configuration No. 2) was employed in the tests Nos. 118, 123, 128, and 133, the configuration shown in FIGS. 30A, 30B (G configuration No. 3) was employed in the tests Nos. 119, 124, 129, and 134, the configuration shown in FIGS. 31A, 31B (G configuration No. 4) was employed in the tests Nos. 120, 125, 130, and 135, the configuration shown in FIG. 34B (G configuration No. 5) was employed in the tests Nos. 121, 126, 131, and 136, and the configuration shown in FIGS. 32A, 32B (G configuration No. 6) was employed in the tests Nos. 122 and 132.

In the G configurations Nos. 1 through 3 and 6, each concavity 3*q* is formed into a D-like cut shape of which maximum depth is 0.5 mm and a portion of the polyester resin tape to be fixed to the concavity 3*q* is set to have a width of 2 mm and a length of 4 mm. An opposite portion of the polyester resin tape is also set to have a width of 2 mm and a length of 4 mm. In the G configuration No. 4, each concavity 3*q* is formed into an inverted truncated cone shape of which maximum depth is 0.5 mm, upper circle is 4.5 mm in diameter, and lower circle is 3.0 mm in diameter such that the centers of these circles are positioned at 2.5 mm from the end of the charging roller 3*a*. A portion of the polyester resin tape to be fixed to the concavity 3*q* is set to have a width of 2 mm and a length of 2.5 mm. In the G configuration No. 5, an end portion of the polyester resin tape is cut to be inclined at 45° relative to the longitudinal direction of the polyester resin tape. The concavities of the gap members 3*d*, 3*e* are positioned at the same position in the circumferential direction, i.e. in the same phase, of the charging roller so as to overlap each other in the axial direction of the charging roller.

One end portion of each gap member 3*d*, 3*e* (on a side entering into the contact portion between the photoconductor and the gap member) was fixed to the concavity such that the one end portion extends to put its tip in the rotational direction E of the charging roller and, after that, the gap member 3*d*, 3*e* was wrapped nearly a circuit around and fixed to the peripheral surface of the charging roller.

As the pressing method, the charging roller 3*a* was pressed by applying load of compression springs 3*o*, 3*p* onto bearings 3*m*, 3*n* (at 10 mm distance from the gap members 3*d*, 3*e*) of the rotary shafts 3*f*, 3*g*.

The load (spring pressure) of the compression springs 3*o*, 3*p* was 200 gf in the tests Nos. 117, 121, 123, 127, 131, and 133, 500 gf in the tests Nos. 118, 120, 124 through 126, 128, 130, and 134 through 136, and 800 gf in the tests Nos. 119, 122, 129, and 132.

The charging roller 3*a* was pressed by sponge of the cleaning member 3*h* as shown in FIG. 22. In this case, the pressing force of the sponge was extremely small as compared to the pressing force of the compression springs 3*o*, 3*p*. The cleaning member 3*h* was a cylindrical urethane sponge (Trade name "EPT-51" available from Bridgestone Kaseihin Tokyo Co., Ltd.). The urethane sponge had an outer diameter of 10 mm and an inner diameter 5 mm and was set to have a contact depth within a range from 0.2 mm to 0.7 mm relative to the charging roller 3*a* and to have a run-out tolerance ±0.1.

The contact depth of the sponge was 0.2 mm in the tests Nos. 117, 118, 126 through 128, and 136, 0.5 mm in the tests Nos. 119 through 121, 125, 129 through 131, and 135, 0.7 mm in the tests Nos. 122, 123, 132, and 133, and 0.3 mm in the tests Nos. 124 and 134.

The driving method for the photoconductor 2, the charging roller 3*a*, and the cleaning member 3*h* was the method of directly driving the charging roller 3*a* as shown in FIG. 22 in the odd-numbered tests and the method of indirectly driving the charging roller 3*a* as shown in FIG. 26 in the even-numbered tests.

As apparent from the above, the tests Nos. 117 through 120, 122 through 125, 127 through 130, and 132 through 135 are the examples of the invention, while the tests Nos. 121, 126, 131, and 136 are the comparative examples of the invention.

Other components (developing device, transfer device, and the like) of the apparatuses for the tests for the image forming apparatus were components of the aforementioned printer LP-9000C.

For conducting image forming tests, the circumferential velocity of the photoconductor 2 was set to about 210 mm/sec for every test. For every test, the applied voltage $V_C$ (V) of the charging roller 3*a* was set to:

$$V_C=V_{DC}+V_{AC}=-650+(1/2)V_{PP}\cdot\sin 2\pi ft$$

(wherein $V_{PP}$=800-1000V, f=1.0-1.3 nHz, $V_{AC}$ is sin wave), that is, a voltage composed of components $V_{DC}$ (V) of direct current voltage DC and components $V_{AC}$ (V) of alternative current voltage AC which are superimposed on the components $V_{DC}$. The tests were carried out under indoor condition with temperature of 23° C. and humidity of 50% by printing continuous 10,000 sheets of A4 size plain paper each on which half tone monochrome toner image of 25% concentration was formed.

The $50^{th}$, $100^{th}$, $500^{th}$, $1{,}000^{th}$, $5{,}000^{th}$, and $10{,}000^{th}$ printed sheets of paper were picked up and observed with human eyes. When t no defect was found in 10,000 printed sheets, it was determined as good charge. In this case, "G" is indicated on Table 8. When defect was found in printed sheets before 10,000 sheets, it was determined as no-good charge. In this case, "NG" is indicated on Table 8.

With any of the image forming apparatuses of the examples in the tests Nos. 117 through 120, 122 through 125, 127 through 130, and 132 through 135 and also the comparative examples in the tests Nos. 121 and 131, it was determined that good charge was obtained, i.e. "G". In the comparative example in the test No. 126, defect was found in the $126^{th}$ printed sheet. In the comparative example in the test No. 136, defect was found in the $96^{th}$ printed sheet. The respective results were "NG". As the gap members of the charging rollers of these tests were looked carefully, it was found that tips of the tapes of the gap members unsticked and rode up. Foreign matters such as toner particles adhered to each rode-up portion of the gap member so as to make the charge gap G at the rode-up portion to have 40 μm (20×2 μm) at a maximum. Accordingly, the charge gap G could not be maintained a certain value or less so as to cause discharge failure.

The aforementioned tests demonstrated that, in non-contact charge on the photoconductor 2 by the charging roller 3*a*, the aforementioned works and effects of the invention can be obtained by designing the one end portions $3d_1$, $3e_1$ of the gap members 3*d*, 3*e* on the side entering into the contact portion between the photoconductor 2 and the charging roller 3*a* not to come in contact with the photoconductor 2.

What is claimed is:

1. An image forming apparatus comprising: at least an image carrier of which rotary shafts extending from both ends thereof are rotatably supported on an apparatus body by bearings; and a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap, and wherein the gap members are each formed to have a small-diameter portion on the inside thereof and a large-diameter portion on the outside thereof such that the respective small-diameter portions are positioned to face each other.

2. An image forming apparatus as claimed in claim 1, wherein each gap member is composed of a single piece.

3. An image forming apparatus as claimed in claim 2, wherein each gap member is formed in a truncated cone shape.

4. An image forming apparatus as claimed in claim 1, wherein each gap member is composed of two or more pieces.

5. An image forming apparatus as claimed in claim 1, further comprising a pressing member for pressing at least one of non-charging areas inside the gap members of the charging roller and the gap members toward the image carrier, wherein at least one of the non-charging areas inside the gap members of the charging roller and the gap members is pressed by the pressing member toward the image carrier so as to bring the gap members in contact with the peripheral surface of the image carrier with some pressure.

6. An image forming apparatus comprising: at least an image carrier of which rotary shafts extending from both ends thereof are rotatably supported on an apparatus body by bearings; and a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap, further comprising pressing members for pressing non-charging areas inside the gap members of the charging roller, wherein the non-charging areas inside the gap members of the charging roller are pressed by the pressing members toward the image carrier so as to bring the gap members in contact with the peripheral surface of the image carrier.

7. An image forming apparatus as claimed in claim 6, wherein the pressing members also press the gap members toward the image carrier.

8. An image forming apparatus as claimed in claim 7, wherein each pressing member is composed of a first pressing member which presses the gap member toward the image carrier and a second pressing member which is formed separately from the first pressing member and presses the non-charging area inside the gap member of the charging roller toward the image carrier.

9. An image forming apparatus as claimed in claim 8, wherein the pressing force of the second pressing member for pressing the non-charging area inside the gap member of the charging roller is set to be larger than the pressing force of the first pressing member for pressing the gap member.

10. An image forming apparatus comprising: at least an image carrier of which rotary shafts extending from both ends thereof are rotatably supported on an apparatus body by bearings; and a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap, further comprising pressing members for pressing the gap members toward the image carrier, respectively, wherein at least one of the pressing members is driven to rotate by driving force of a power source.

11. An image forming apparatus as claimed in claim 10, wherein the charging roller is a non-elastic member.

12. An image forming apparatus as claimed in claim 10, wherein the pressing members are elastic members.

13. An image forming apparatus as claimed in claim 10, further comprising a cleaning member which is disposed between the pressing members, wherein the pressing members and the cleaning member are arranged on a rotary shaft which is driven to rotate by driving force of the power source.

14. An image forming apparatus as claimed in claim 13, wherein the charging roller is a non-elastic member.

15. An image forming apparatus as claimed in claim 13, wherein the pressing members are elastic members.

16. An image forming apparatus as claimed in claim 13, wherein the pressing members and the cleaning member are formed integrally.

17. An image forming apparatus as claimed in claim 16, wherein the charging roller is a non-elastic member.

18. An image forming apparatus as claimed in claim 17, wherein the pressing members are elastic members.

19. An image forming apparatus comprising: at least an image carrier of which rotary shafts extending from both ends thereof are rotatably supported on an apparatus body by bearings; a charging roller having gap members fixed to both end portions thereof, respectively; and a pressing member which is located on the opposite side of the charging roller relative to a line passing through the center of the image carrier and perpendicular to a line connecting the center of the image carrier and the center of the charging roller, wherein the gap members are brought in contact with the peripheral surface of the image carrier with some pressure to form a charge gap between the image carrier and the charging roller so that the charging roller charges the image carrier in non-contact state with the charge gap, and the image carrier is pressed by the pressing member, wherein the width of the pressing member is set to be smaller than the distance between the inner edges of the gap members fixed to the end portions of the charging roller.

20. An image forming apparatus as claimed in claim 19, further comprising a cleaning member which is in contact with the charging roller to clean the charging roller, wherein the width of the cleaning member is set to be larger than the distance between the outer edges of the gap members and the charging roller is pressed by the cleaning member toward the image carrier.

21. An image forming apparatus as claimed in claim 19, wherein the pressing member for pressing the image carrier is an image forming component member which is in contact with the image carrier to perform image forming action, and the width of the image forming component member is set to be smaller than the distance between the gap members.

22. An image forming apparatus as claimed in claim 21, further comprising a cleaning member which is in contact with the charging roller to clean the charging roller, wherein the width of the cleaning member is set to be larger than the distance between the outer edges of the gap members and the charging roller is pressed by the cleaning member toward the image carrier.

23. An image forming apparatus as claimed in claim 21, wherein the image forming component member is a transfer roller which is in contact with the image carrier to transfer an image on the image carrier to a transfer medium, and the width of the transfer roller is set to be smaller than the distance between the gap members.

24. An image forming apparatus as claimed in claim 23, further comprising a cleaning member which is in contact with the charging roller to clean the charging roller, wherein the width of the cleaning member is set to be larger than the distance between the outer edges of the gap members and the charging roller is pressed by the cleaning member toward the image carrier.

25. An image forming apparatus, comprising:

at least an image carrier of which rotary shafts extending from both ends thereof are rotatable supported on an apparatus body by bearings;

a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap;

a cleaning member which is in contact with the charging roller to clean the charging roller, wherein the charging roller is pressed toward the image carrier by the cleaning member; and pressing members for pressing the gap members toward the image carrier.

26. An image forming apparatus as claimed in claim 25, wherein the pressing members are arranged on both ends of the cleaning member.

27. An image forming apparatus, comprising:

at least an image carrier of which rotary shafts extending from both ends thereof are rotatably supported on an apparatus body by bearings;

a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap;

a cleaning member which is in contact with the charging roller to clean the charging roller, wherein the charging roller is pressed toward the image carrier by the cleaning member, wherein the cleaning member has a roller shape; and pressing members for pressing the gap members toward the image carrier.

28. An image forming apparatus as claimed in claim 27, wherein the pressing members are arranged on both ends of the cleaning member.

29. An image forming apparatus comprising:

at least an image carrier of which rotary shafts extending from both ends thereof are rotatably supported on an apparatus body by bearings;

a charging roller having gap members fixed to both end portions thereof, respectively, wherein the gap members are brought in contact with the peripheral surface of the image carrier with some pressure to form a charge gap between the image carrier and the charging roller so that the charging roller charges the image carrier in non-contact state with the charge gap;

a cleaning member which is in contact with the charging roller to clean the charging roller, wherein the charging roller is pressed toward the image carrier by the cleaning member, wherein the cleaning member is formed in a roller and barrel shape of which the outer diameter at the middle is larger than the outer diameter at the both ends.

30. An image forming apparatus as claimed in claim 29, further comprising pressing members for pressing the gap members toward the image carrier.

31. An image forming apparatus as claimed in claim 30, wherein the pressing members are arranged on both ends of the cleaning member.

32. A charging roller comprising: a first gap member of a tape-like shape which is fixed to one end portion of the charging roller and thus has a joint portion; and a second gap member of a tape-like shape which is fixed to the other end portion of the charging roller and thus has a joint portion, wherein the first and second gap members are brought in contact with the peripheral surface of an image carrier with some pressure so as to form a charge gap between the image carrier and the charging roller and the charging roller rotates during the rotation of the image carrier to charge the image carrier in non-contact state with the charge gap, further comprising:

a first gap member entrance side contact-preventing means for preventing one end portion of the first gap member on a side entering into the contact portion relative to the image carrier from having contact with the image carrier, the first gap member entrance side contact-preventing means being formed in one end portion of the charging roller, and a second gap member entrance side contact-preventing means for preventing one end portion of the second gap member on a side entering into the contact portion relative to the image carrier from having contact with the image carrier, the second gap member entrance side contact-preventing means being formed in the other end portion of the charging roller, a first gap member exit side contact-preventing means for preventing the other end portion of the first gap member on a side exiting from the contact portion relative to the image carrier from having contact with the image carrier, the first gap member exit side contact-preventing means being formed in the one end portion of the charging roller, and a second gap member exit side contact-preventing means for preventing the other end portion of the second gap member on a side exiting from the contact portion relative to the image carrier from having contact with the image carrier, the second gap member exit side contact-preventing means being formed in the other end portion of the charging roller.

33. A charging roller as claimed in claim 32, wherein the first and second gap member entrance side contact-preventing means are composed of first and second entrance side concavities, respectively, and the first and second gap member exit side contact-preventing means are composed of first and second exit side concavities, respectively, wherein the one end portion of the first gap member is fixed to the first entrance side concavity, the one end portion of the second gap member is fixed to the second entrance side concavity, the other end portion of the first gap member is fixed to the first exit side concavity, and the other end portion of the second gap member is fixed to the second exit side concavity.

34. A charging roller as claimed in claim 33, wherein the first entrance side concavity and the first exit side concavity are formed at positions which are different from each other in the circumferential direction and the second entrance side concavity and the second exit side concavity are formed at positions which are different from each other in the circumferential direction.

35. A charging roller as claimed in claim 34, wherein the first entrance side concavity and the second entrance side concavity are formed at positions which are different from each other in the circumferential direction and the first exit side concavity and the second exit side concavity are formed at positions which are different from each other in the circumferential direction.

36. A charging roller as claimed in claim 33, wherein the first entrance side concavity and the second entrance side concavity are formed at positions which are different from each other in the circumferential direction and the first exit side concavity and the second exit side concavity are formed at positions which are different from each other in the circumferential direction.

37. A charging roller as claimed in claim 33, wherein the width of the one end portion of the first gap member which is fixed to the first entrance side concavity and the width of the other end portion of the first gap member which is fixed to the first exit side concavity are set to be smaller than the other portion of the first gap member, and the width of the one end portion of the second gap member which is fixed to the second entrance side concavity and the width of the other end portion of the second gap member which is fixed to the second exit side concavity are set to be smaller than the other portion of the second gap member.

38. An image forming apparatus comprising: at least an image carrier on which a latent image and a developer image are formed; a charging roller for charging the image carrier in non-contact state; a writing device for writing the latent image on the image carrier; a developing device for developing the latent image on the image carrier with developer; and a transfer device for transferring the developer image on the image carrier, wherein the charging roller is a charging roller as claimed in claim 32.

39. A charging roller comprising: gap members of tape-like shape which are fixed to both end portions of the charging and thus have respective joint portions, wherein the gap members are brought in contact with the peripheral surface of an image carrier with some pressure so as to form a charge gap between the image carrier and the charging roller and the charging roller rotates during the rotation of the image carrier to charge the image carrier in non-contact state with the charge gap, further comprising:

gap member end contact-preventing means for preventing one end portions of the gap members on a side entering into the contact portion relative to the image carrier from having contact with the image carrier, the gap member end contact-preventing means being disposed on the both end portions of the charging roller, respectively.

40. A charging roller as claimed in claim 39, wherein the gap member end contact-preventing means disposed on the both end portions are both concavities and the respective one end portions of the gap members are at least partially fixed to the concavities.

41. A charging roller as claimed in claim 40, wherein, as for the concavities, the concavity at the one end side and the concavity at the other end side are formed at the same position in the circumferential direction or formed at positions which are different from each other in the circumferential direction.

42. A charging roller as claimed in claim 40, the width of the portions of the gap members which are fixed to the concavities is set to be smaller than the other portions of the gap members.

43. A charging roller as claimed in claim 42, wherein, as for the concavities, the concavity at the one end side and the concavity at the other end side are formed at the same position in the circumferential direction or formed at positions which are different from each other in the circumferential direction.

44. An image forming apparatus comprising: at least an image carrier on which a latent image and a developer image are formed; a charging roller for charging the image carrier in non-contact state; a writing device for writing the latent image on the image carrier; a developing device for developing the latent image on the image carrier with developer; and a transfer device for transferring the developer image on the image carrier, wherein the charging roller is a charging roller as claimed in claim 39.

* * * * *